US010668764B2

(12) United States Patent
Wariishi et al.

(10) Patent No.: US 10,668,764 B2
(45) **Date of Patent: *Jun. 2, 2020**

(54) LITHOGRAPHIC PRINTING PLATE PRECURSOR, MANUFACTURING METHOD THEREFOR, PLATE MANUFACTURING METHOD FOR LITHOGRAPHIC PRINTING PLATE, AND PRINTING METHOD

(71) Applicant: FUJIFILM Corporation, Tokyo (JP)

(72) Inventors: Koji Wariishi, Shizuoka (JP); Shunsuke Hayashi, Shizuoka (JP); Fumiya Shiraki, Shizuoka (JP); Atsushi Ooshima, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/991,674

(22) Filed: May 29, 2018

(65) Prior Publication Data

US 2018/0354290 A1 Dec. 13, 2018

Related U.S. Application Data

(63) Continuation of application No. 15/226,212, filed on Aug. 2, 2016, now abandoned, which is a (Continued)

(30) Foreign Application Priority Data

Feb. 4, 2014 (JP) ..... 2014-019835
May 14, 2014 (JP) ..... 2014-100068

(51) Int. Cl.
*B41N 3/08* (2006.01)
*B41C 1/10* (2006.01)
*B41F 7/02* (2006.01)

(52) U.S. Cl.
CPC ..... *B41N 3/08* (2013.01); *B41C 1/10* (2013.01); *B41C 1/1016* (2013.01); *B41F 7/02* (2013.01)

(58) Field of Classification Search
CPC .... B41N 3/08; B41F 7/02; B41C 1/10; B41C 1/1016
See application file for complete search history.

(56) References Cited

U.S. PATENT DOCUMENTS 5,275,916 A 1/1994 Kato
5,826,512 A 10/1998 Niegawa et al.
(Continued)

FOREIGN PATENT DOCUMENTS

EP 1295715 A 3/2003
JP 952466 A 2/1997
(Continued)

OTHER PUBLICATIONS

The First Office Action, dated Jun. 2, 2017, in related Chinese Application No. 201580006563.4, 21 pages in English and Chinese.
(Continued)

*Primary Examiner* — Michael M. Robinson
(74) *Attorney, Agent, or Firm* — Sughrue Mion, PLLC

(57) ABSTRACT

A lithographic printing plate precursor, comprising a layer arrangement according to any one of the following (i) to (iv):
(i) a support and an image recording layer;
(ii) a support, an undercoat layer, and an image recording layer;
(iii) a support, an image recording layer, and a protective layer; or
(iv) a support, an undercoat layer, an image recording layer, and a protective layer, wherein:
a layer containing a hydrophilic agent is included in the layer arrangement between the support and an inner-
(Continued)

most layer, between adjacent layers, or on an outermost layer other than the protective layer, the layer containing a hydrophilic agent contacts a region of at least one of, but not all of, the support, the undercoat layer, the image recording layer, or the protective layer, and an amount of sag of an end portion of the lithographic printing plate precursor is from 30 μm to 150 μm.

25 Claims, 5 Drawing Sheets

Related U.S. Application Data continuation of application No. PCT/JP2015/052905, filed on Feb. 3, 2015.

(56) References Cited

U.S. PATENT DOCUMENTS

| | | | |
|---|---|---|---|
| 2002/0134266 | A1 | 9/2002 | Yamasaki et al. |
| 2003/0121437 | A1 | 7/2003 | Higashi |
| 2004/0223042 | A1 | 11/2004 | Goto |
| 2009/0181173 | A1 | 7/2009 | Oohashi et al. |
| 2012/0219911 | A1 | 8/2012 | Suzuki et al. |

FOREIGN PATENT DOCUMENTS

| | | | |
|---|---|---|---|
| JP | 2006243408 | A | 9/2006 |
| JP | 200776330 | A | 3/2007 |
| JP | 2007-538279 | A | 12/2007 |
| JP | 2011073212 | A | 4/2011 |
| JP | 2011-177983 | A | 9/2011 |

OTHER PUBLICATIONS

Written Opinion for PCT/JP2015/052905 dated Apr. 21, 2015.

Office Action issued in parent U.S. Appl. No. 15/226,212 dated Aug. 28, 2017.

Office Action issued in parent U.S. Appl. No. 15/226,212 dated Dec. 27, 2017.

Communication dated Aug. 28, 2018, from the Japanese Patent Office in counterpart application No. 2018-036585.

Communication dated Aug. 20, 2018, from the State Intellectual Property Office of People's Republic of China in counterpart Application No. 201580006563.4.

Communication dated Nov. 6, 2018, from the Japanese Patent Office in counterpart application No. 2018-036585.

Communication dated Oct. 31, 2018, from the Japanese Patent Office in counterpart application No. 2018-036585.

Communication dated Mar. 19, 2019 from the Japanese Patent Office in application No. 2018-036585.

Communication dated Apr. 30, 2019 from the European Patent Office in application No. 18210060.2.

Communication dated May 3, 2019 from the Intellectual Property India Patent Office in application No. 201647026451.

Notice of Reasons for Refusal dated Nov. 5, 2019 from the Japanese Patent Office in application No. 2018-036585.

Communication dated Feb. 7, 2018, from the State Intellectual Property Office of People's Republic of China in counterpart Application No. 201580006563.4.

Communication dated Mar. 31, 2017 issued by the European Patent Office in counterpart Application No. 15746806.7.

International Search Report for PCT/JP2015/052905 dated Apr. 21, 2015.

Notification of Reasons for Refusal, dated Jun. 13, 2017, issued in related Japanese Application No. 2015-560978, 5 pages in English and Japanese.

Notice of Trial, dated Feb. 14, 2020, issued in Chinese Application No. 201580006563.4, 14 pages in English and Chinese.

LITHOGRAPHIC PRINTING PLATE PRECURSOR, MANUFACTURING METHOD THEREFOR, PLATE MANUFACTURING METHOD FOR LITHOGRAPHIC PRINTING PLATE, AND PRINTING METHOD

CROSS-REFERENCE TO RELATED APPLICATIONS

This is a continuation application of U.S. application Ser. No. 15/226,212 filed Aug. 2, 2016, which is a continuation of PCT/JP2015/052905 filed Feb. 3, 2015, and which claims priority from Japanese Patent Application No. 2014-019835, filed Feb. 4, 2014, and Japanese Patent Application No. 2014-100068, filed May 14, 2014 in the Japanese Patent Office, the disclosures of which are incorporated herein by reference in their entirety.

All publications, patent applications, and technical standards mentioned in this specification are herein incorporated by reference to the same extent as if each individual publication, patent application, or technical standard was specifically and individually indicated to be incorporated by reference.

BACKGROUND OF THE INVENTION

1. Field of the Invention

The present invention relates to a lithographic printing plate precursor, a manufacturing method therefor, a plate manufacturing method for a lithographic printing plate, and a printing method.

2. Description of the Related Art

Currently, a lithographic printing plate is obtained through computer-to-plate (CTP) technology. That is, the lithographic printing plate is obtained by directly performing scanning exposure and development on a lithographic printing plate precursor without interposing a lithographic film, using a laser or a laser diode.

Problems relating to the lithographic printing plate precursor have been changed to improvements in image forming characteristics, printing characteristics, physical characteristics, and the like which correspond to the CTP technology in accordance with the above-described progress. In addition, an environmental problem relating to a waste liquid in accordance with wet processing such as development processing has been closed up as another problem relating to the lithographic printing plate precursor from the viewpoint of growing interest in the global environment.

With respect to the environmental problem, simplification of development or plate manufacture, or non-processing is oriented. A method called "on-press development" is performed as a simple plate manufacturing method. That is, the method is a method in which removal of an unnecessary portion of an image recording layer is performed in an initial stage of a usual printing step while mounting a lithographic printing plate precursor, which has been exposed to light, on a printing press as it is without performing wet development using a highly alkaline developer in the related art.

In addition, a method called "gum developing", in which the removal of an unnecessary portion of an image recording layer is performed using a finisher or a gum developer of which the pH is nearly neutral without using the highly alkaline developer (hereinafter, also simply referred to as "alkaline developer") in the related art, is also performed as an easy method for development. As lithographic printing plate precursors in the related art, lithographic printing plate precursors disclosed in JP2007-538279A and JP2011-177983A have been known.

SUMMARY OF THE INVENTION

In a case of performing printing using a lithographic printing plate, an end portion of the printing plate is at a position outside the paper surface when performing printing on paper having a size smaller than that of the printing plate using a typical sheet-fed printing machine, and therefore, the end portion does not affect the quality of printing. However, when performing printing on paper having a size larger than that of the printing plate, ink attached to the end portion becomes linear stains (edge stains) after being transferred on the paper, thereby significantly impairing the commercial value of a printed matter.

As a method for preventing such stains of the end portion, there is provided a method for processing the end portion using a desensitizing liquid which contains hydrophilic organic polymer compounds, for example, gum arabic, soybean polysaccharides, and phosphoric acids, to make ink hardly adhere thereto (refer to JP2011-177983A).

In addition, in JP2011-177983A, there is provided a method for obtaining a lithographic printing plate precursor on which edge stains are not caused by processing an end portion of a support using a processing liquid which contains an organic solvent and a water-soluble resin.

However, according to this method, the end portion of the support is processed after the support is cut, and therefore, the processing liquid wraps around the rear surface of the support and components of the processing liquid remain. For this reason, there is a problem in that setter contaminations or vendor contaminations are caused.

An object of the present invention to be solved is to provide a manufacturing method for a lithographic printing plate precursor which can simplify a manufacturing step while maintaining the performance of preventing edge stains and in which there are neither setter contaminations nor vendor contaminations; the lithographic printing plate precursor; a plate manufacturing method for a lithographic printing plate; and a printing method using the above-described lithographic printing plate.

The above-described object of the present invention has been solved by means described in the following <1>, <4>, <16>, and <20> to <22> which will be described below together with <2>, <3>, <5> to <15>, <17> to <19>, and <23> to <29> which are preferred embodiments.

<1> A manufacturing method for a lithographic printing plate precursor, comprising: an image recording layer forming step of forming an image recording layer as an a step; a coating step of coating a partial region of the image recording layer, which is formed in the a step, with a coating liquid containing a hydrophilic agent, as a b step; and a cutting step of cutting the lithographic printing plate precursor such that the region coated with the coating liquid is in a range within 1 cm from an end portion of the lithographic printing plate precursor after being cut, as a c step, in which the c step is performed after performing either the a step and b step in this order or the b step and the a step in this order, on a hydrophilic aluminum support.

<2> The manufacturing method for a lithographic printing plate precursor according to <1>, further comprising: an undercoating step of forming an undercoat layer is further performed as a d step before the a step.

<3> The manufacturing method for a lithographic printing plate precursor according to <1> or <2>, further comprising: a protective layer forming step of forming a protective layer on the image recording layer as an e step before the c step and after the a step.

<4> A manufacturing method for a lithographic printing plate precursor, comprising: an image recording layer forming step of forming an image recording layer as an a step; a coating step of coating a partial region of the image recording layer, which is formed in the a step, with a coating liquid containing a hydrophilic agent, as a b step; a cutting step of cutting the lithographic printing plate precursor such that the region coated with the coating liquid is in a range within 1 cm from an end portion of the lithographic printing plate precursor after being cut, as a c step; an undercoating step of forming an undercoat layer on a support as a d step; and a protective layer forming step of forming a protective layer on the image recording layer as an e step, in which the c step is performed after performing either the b step, the d step, the a step, and the e step in this order, the d step, the b step, the a step, and the e step in this order, the d step, the a step, the b step, the e step in this order, or the d step, the a step, the e step, and the b step in this order, on a hydrophilic aluminum support.

<5> The manufacturing method for a lithographic printing plate precursor according to any one of <1> to <4>, further comprising: a step of overlapping compounded paper on an image recording layer side of the support before the c step.

<6> The manufacturing method for a lithographic printing plate precursor according to any one of <1> to <5>, in which the end portion is cut in the c step such that the sag amount of the end portion becomes 30 μm to 150 μm.

<7> The manufacturing method for a lithographic printing plate precursor according to any one of <1> to <6>, in which the coating liquid contains a phosphoric acid compound and/or a phosphonic acid compound as the hydrophilic agent.

<8> The manufacturing method for a lithographic printing plate precursor according to <7>, in which the phosphoric acid compound and/or the phosphonic acid compound are polymer compounds.

<9> The manufacturing method for a lithographic printing plate precursor according to <7> or <8>, in which the coating liquid further contains an anionic or nonionic surfactant as the hydrophilic agent.

<10> The manufacturing method for a lithographic printing plate precursor according to <9>, in which the anionic or nonionic surfactant is a polymer compound.

<11> The manufacturing method for a lithographic printing plate precursor according to any one of <1> to <10>, in which the image recording layer contains an infrared absorber and polymer particles or a binder polymer.

<12> The manufacturing method for a lithographic printing plate precursor according to any one of <1> to <11>, in which the image recording layer contains the infrared absorber, a polymerization initiator, a polymerizable compound, and the polymer particles or the binder polymer.

<13> The manufacturing method for a lithographic printing plate precursor according to any one of <1> to <12>, in which the image recording layer contains the infrared absorber and a thermoplastic fine particle polymer.

<14> The manufacturing method for a lithographic printing plate precursor for newspaper printing according to any one of <1> to <13>.

<15> The manufacturing method for a lithographic printing plate precursor according to any one of <1> to <14>, the lithographic printing plate precursor being an on-press development type.

<16> A plate manufacturing method for a lithographic printing plate, comprising: a preparation step of preparing the lithographic printing plate precursor obtained through the manufacturing method according to any one of <1> to <15>; an exposure step of performing image exposure on the lithographic printing plate precursor; and a processing step of removing an unexposed portion of the image-exposed lithographic printing plate precursor.

<17> The plate manufacturing method for a lithographic printing plate according to <16>, in which the processing step is performed through development using a processing liquid.

<18> The plate manufacturing method for a lithographic printing plate according to <17>, in which the processing liquid is an alkaline developer or a gum developer.

<19> The plate manufacturing method for a lithographic printing plate according to <18>, in which the processing step is performed through on-press development.

<20> A printing method comprising: printing the lithographic printing plate obtained through the plate manufacturing method according to any one of <16> to <19>, using printing paper of which the width is wider than that of the lithographic printing plate.

<21> A lithographic printing plate precursor comprising: an image recording layer on a quadrilateral-shaped hydrophilic aluminum support, in which a hydrophilic agent is distributed on each region within 1 cm from end portions of two sides, which face each other, of the support, and the hydrophilic agent is not attached to the rear surface of the support.

<22> A lithographic printing plate precursor comprising: a layer arrangement according to any one of the following i to iv; and a layer containing a hydrophilic agent between a support and the innermost layer of the layer arrangement, between adjacent layers, or on the outermost layer other than a protective layer, in which the layer containing a hydrophilic agent comes into contact with partial regions of the support, an undercoat layer, an image recording layer, and the protective layer.

i: support and image recording layer ii: support, undercoat layer, and image recording layer iii: support, image recording layer, and protective layer iv: support, undercoat layer, image recording layer, and protective layer <23> The lithographic printing plate precursor according to <22>, in which the layer containing a hydrophilic agent exists further inside the outermost layer of the layer arrangement.

<24> The lithographic printing plate precursor according to <22> or <23>, in which the layer containing a hydrophilic agent exists further outside the undercoat layer of the layer arrangement.

<25> The lithographic printing plate precursor according to <22> or <23>, in which the layer containing a hydrophilic agent exists further inside the undercoat layer or further outside the image recording layer.

<26> The lithographic printing plate precursor according to any one of <21> to <25>, in which the hydrophilic agent is a phosphoric acid compound and/or a phosphonic acid compound.

<27> The lithographic printing plate precursor according to <26>, in which the phosphoric acid compound and/or the phosphonic acid compound are polymer compounds.

<28> The lithographic printing plate precursor according to <26> or <27>, in which the coating liquid further contains an anionic or nonionic surfactant as the hydrophilic agent.

<29> The lithographic printing plate precursor according to <28>, in which the anionic or nonionic surfactant is a polymer compound.

According to the present invention, it is possible to provide a manufacturing method for a lithographic printing plate precursor which can simplify a manufacturing step while maintaining the function of preventing edge stains and in which there are neither setter contaminations nor vendor contaminations; the lithographic printing plate precursor; a plate manufacturing method for a lithographic printing plate; and a printing method using the above-described lithographic printing plate.

DESCRIPTION OF THE PREFERRED EMBODIMENTS

Figure 1:
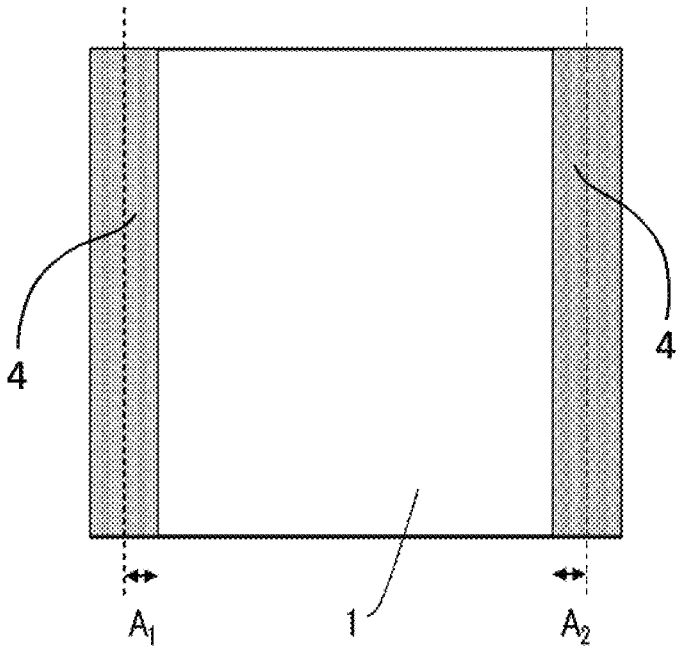
FIG. 1 is a conceptual view showing an example of a lithographic printing plate precursor before being cut of which end portions are coated with a coating liquid (hereinafter, also called a "hydrophilic coating liquid") containing a hydrophilic agent.
Figure 2:
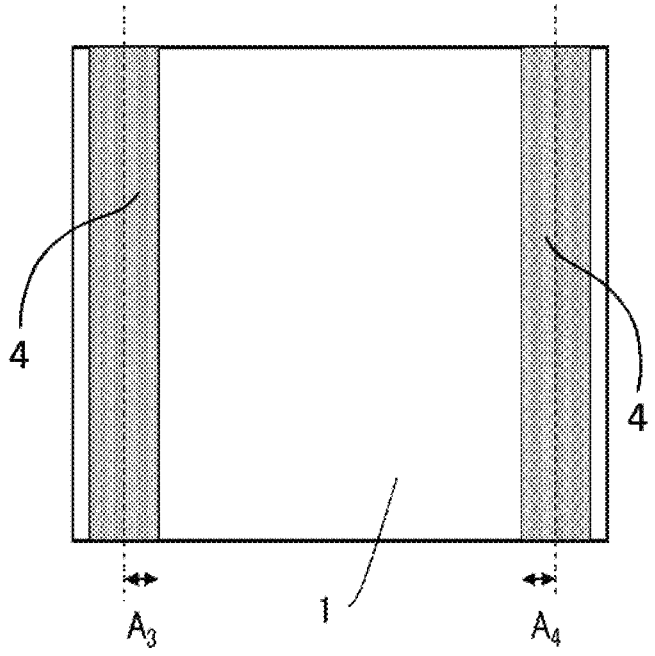
FIG. 2 is a conceptual view showing an example of the lithographic printing plate precursor before being cut which is coated with the hydrophilic coating liquid at positions other than the end portions.
Figure 3:
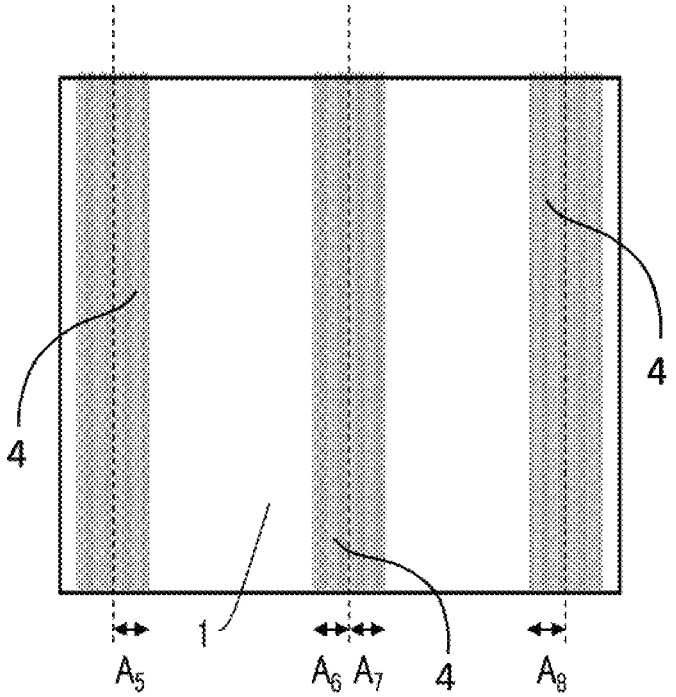
FIG. 3 is a conceptual view showing another example of the lithographic printing plate precursor before being cut which is coated with the hydrophilic coating liquid at positions other than the end portions.
Figure 4:
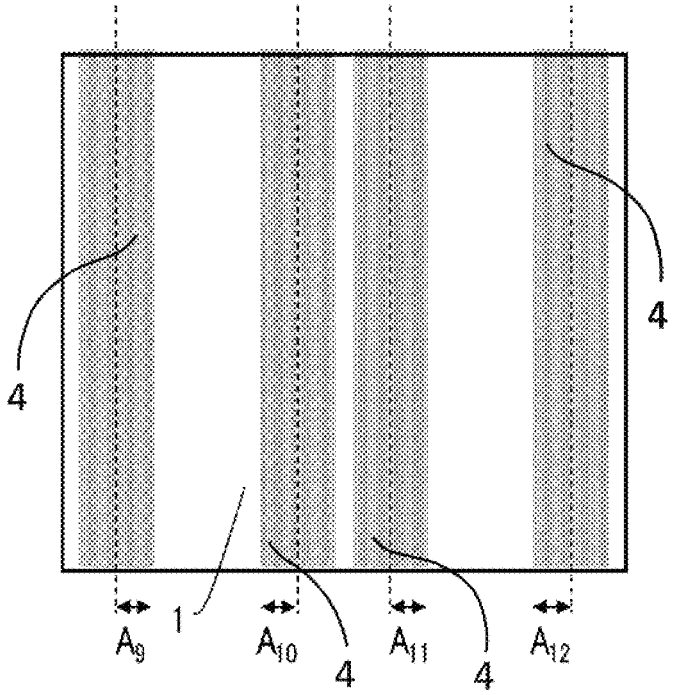
FIG. 4 is a conceptual view showing still another example of the lithographic printing plate precursor before being cut which is coated with the hydrophilic coating liquid at positions other than the end portions.

Hereinafter, the present invention will be described in detail.

The description of "xx to yy" in the present specification represents a numerical range including xx and yy.

An "(a) image recording layer forming step of forming an image recording layer" or the like is also simply called an "a step" or the like.

In addition, in the present invention, the meanings of "mass %" and "wt %" are the same as each other and the meanings of "parts by mass" and "parts by weight" are the same as each other.

Hereinafter, a plate manufacturing method for a lithographic printing plate of the present invention will be described in detail.

(Manufacturing Method for Lithographic Printing Plate Precursor)

The manufacturing method for a lithographic printing plate precursor in the present invention including: (a) an image recording layer forming step of forming an image recording layer; (b) a coating step of coating a partial region of the image recording layer, which is formed in the a step, with a coating liquid containing a hydrophilic agent; and (c) a cutting step of cutting the lithographic printing plate precursor such that the region coated with the above-described coating liquid is in a range within 1 cm from an end portion of the lithographic printing plate precursor after being cut, in which the c step is performed after performing either the a step and b step in this order or the b step and the a step in this order, on a hydrophilic aluminum support.

It is preferable that the manufacturing method for a lithographic printing plate precursor of the present invention is a manufacturing method for a lithographic printing plate precursor for newspaper printing.

In addition, it is preferable that the manufacturing method for a lithographic printing plate precursor of the present invention is a manufacturing method for an on-press development-type lithographic printing plate precursor.

Hereinafter, each of the steps and the components of compositions used in each of the steps will be described.

<Image Recording Layer Forming Step>

The manufacturing method for a lithographic printing plate precursor of the present invention includes the (a) image recording layer forming step of forming an image recording layer.

Specifically, the image recording layer in the present invention is formed by preparing a coating liquid after dispersing or dissolving each component to be described below in a well-known solvent, coating the top of a support with this coating liquid through a well-known method such as bar coater coating, and performing drying.

The coating amount (solid content) of the image recording layer on the support obtained after coating and drying varies depending on the use thereof, but is preferably 0.3 $g/m^2$ to 3.0 $g/m^2$. If the coating amount is within this range, an image recording layer having favorable sensitivity and coating characteristics can be obtained.

[Hydrophilic Aluminum Support]

A hydrophilic aluminum support is used as the support used in the manufacturing method for a lithographic printing plate precursor of the present invention. The "hydrophilic aluminum support" means an aluminum support having a hydrophilic surface. As the support, it is preferable to use an aluminum sheet which is subjected to roughening processing and anodic oxidation processing through a well-known method.

In addition, if necessary, enlargement processing or sealing processing of micropores of anodic oxidation coating disclosed in JP2001-253181A or JP2001-322365A, and surface hydrophilization processing using alkali metal silicate disclosed in U.S. Pat. Nos. 2,714,066A, 3,181,461A, 3,280,734A, and 3,902,734A, or using a polyvinyl phosphonic acid disclosed in U.S. Pat. Nos. 3,276,868A, 4,153,461A, and 4,689,272A are appropriately selected and performed on the above-described aluminum sheet.

The center line average roughness of the surface of the aluminum support is preferably 0.10 μm to 1.2 μm.

If necessary, a back coat layer including an organic polymer compound disclosed in JP1993-45885A (JP-H5-45885A) and a silicon alkoxy compound disclosed in JP1994-35174A (JP-H6-35174A) can be provided to the rear surface of the support used in the present invention.

[Image Recording Layer]

The image recording layer used in the present invention refers to a layer in which a hydrophobic region is formed through infrared exposure and an image, in which the hydrophobic region becomes an ink receiving portion, is formed.

The image recording layer in the present invention contains an infrared absorber and polymer particles or a binder polymer as essential components, and contains a polymerization initiator, a polymerizable compound, and other components as optional components.

In addition, it is preferable that the image recording layer in the present invention contains polymer particles and a binder polymer.

Examples of a representative aspect of the image recording layer include (1) an aspect in which the image recording layer contains an infrared absorber, a polymerization initiator, a polymerizable compound, and a binder polymer, and forms an image portion using a polymerization reaction; and (2) an aspect in which the image recording layer contains an infrared absorber and polymer particles, and a hydrophobic region (image portion) is formed through thermal fusion or a thermal reaction of the polymer particles. In addition, the above-described two aspects may be combined with each other. For example, (1) polymer particles may be contained in a polymerization type image recording layer, or (2) a polymerizable compound or the like may be contained in a polymer particle type image recording layer. Among these, a polymerization type aspect in which the image recording layer contains an infrared absorber, a polymerization initiator, and a polymerizable compound is preferable and an aspect in which the image recording layer contains an infrared absorber, a polymerization initiator, a polymerizable compound, a binder polymer, and/or polymer particles is more preferable.

First, the infrared absorber and the polymer particles or the binder polymer as essential components of the image recording layer of the present invention will be sequentially described below.

<Infrared Absorber>

The image recording layer used in the present invention contains an infrared absorber. The infrared absorber has a function of converting absorbed infrared rays into heat and/or a function of causing electron transfer and/or energy transfer to a polymerization initiator to be described below after being excited by the infrared rays. The infrared absorber used in the present invention is a dye having a maximum absorption at a wavelength of 760 nm to 1,200 nm.

As the above-described infrared absorber, it is possible to use a commercially available dye and a well-known infrared absorber disclosed in literature, for example, "Dye Handbook" (edited by The Society of Synthetic Organic Chemistry, Japan, published in 1970 (S45)) can be used. Specific examples thereof include dyes such as azo dyes, metal complex salt azo dyes, pyrazolone azo dyes, naphthoquinone dyes, anthraquinone dyes, phthalocyanine dyes, carbonium dyes, quinone imine dyes, methine dyes, cyanine dyes, squarylium coloring matters, pyrylium salts, and metal thiolate complexes.

Particularly preferred examples of these dyes include cyanine coloring matters, squarylium coloring matters, pyrylium salts, nickel thiolate complexes, and indolenine cyanine coloring matters. Furthermore, cyanine coloring matters or indolenine cyanine coloring matters are preferable, and particularly preferred examples thereof include cyanine coloring matters represented by the following Formula (a).

Formula (a)

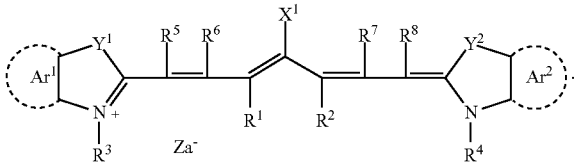

In Formula (a), $X^1$ represents a hydrogen atom, a halogen atom, —$N(R^9)(R^{10})$, —$X^2$-$L^1$, or groups shown below. Here, $R^9$ and $R^{10}$ may be identical to or different from each other, and represent an aryl group having 6 to 10 carbon atoms that may have a substituent, an alkyl group having 1 to 8 carbon atoms, and a hydrogen atom. Alternately, $R^9$ and $R^{10}$ may be bonded to each other, to form a ring. Among these, a phenyl group is preferable (—$NPh_2$). $X^2$ represents an oxygen atom or a sulfur atom, and L' represents a hydrocarbon group having 1 to 12 carbon atoms and a hydrocarbon group having 1 to 12 carbon atoms which contains a heteroaryl group and a heteroatom. Here, the heteroatom represents N, S, O, a halogen atom, and Se. In the groups shown below, $Xa^-$ is defined in the same manner as $Za^-$ as described below, and $R^a$ represents a substituent selected from a hydrogen atom, an alkyl group, an aryl group, a substituted or unsubstituted amino group, and a halogen atom.

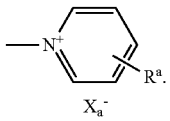

Each of $R^1$ and $R^2$ independently represents a hydrocarbon group having 1 to 12 carbon atoms. In view of storage stability of an image recording layer coating liquid, $R^1$ and $R^2$ each are preferably a hydrocarbon group having 2 or more carbon atoms. In addition, $R^1$ and $R^2$ may be linked to each other to form a ring, and when forming a ring, it is particularly preferable to form a 5-membered ring or a 6-membered ring.

$Ar^1$ and $Ar^2$ may be identical to or different from each other, and each represents an aryl group that may have a substituent. Preferred examples of an aryl group include a benzene ring and a naphthalene ring. In addition, preferred examples of a substituent include a hydrocarbon group having 12 or less carbon atoms, a halogen atom, and an alkoxy group having 12 or less carbon atoms. $Y^1$ and $Y^2$ may be identical to or different from each other, and each represents a sulfur atom or a dialkyl methylene group having 12 or less carbon atoms. $R^3$ and $R^4$ may be identical to or different from each other, and each represents a hydrocarbon group having 20 or less carbon atoms that may have a substituent. Preferred examples of a substituent include an alkoxy group having 12 or less carbon atoms, a carboxy group, and a sulfo group. $R^5$, $R^6$, $R^7$, and $R^8$ may be identical to or different from each other, and each represents a hydrogen atom or a hydrocarbon group having 12 or less carbon atoms. In view of ease of acquisition of raw materials, a hydrogen atom is preferable. In addition, $Za^-$ represents a counter anion. However, if a cyanine coloring matter represented by Formula (a) has an anionic substituent in a structure thereof and charges are not required to be neutralized, $Za^-$ is not necessary. In view of storage stability of an image recording layer coating liquid, preferred examples of $Za^-$ include a halide ion, a perchlorate ion, a tetrafluoroborate ion, a hexafluorophosphate ion, and a sulfonic acid ion, and particularly preferred examples thereof include a perchlorate ion, a hexafluorophosphate ion, and an arylsulfonate ion.

Specific examples of the cyanine coloring matter represented by Formula (a) which can be suitably used include compounds disclosed in paragraphs 0017 to 0019 of JP2001-133969A, and compounds disclosed in paragraphs 0016 to 0021 of JP2002-023360A and paragraphs 0012 to 0037 of JP2002-040638A. Preferred examples thereof include compounds disclosed in paragraphs 0034 to 0041 of JP2002-278057A, and paragraphs 0080 to 0086 of JP2008-195018A, and most preferred examples thereof include compounds disclosed in paragraphs 0035 to 0043 of JP2007-90850A.

In addition, compounds disclosed in paragraphs 0008 and 0009 of JP1993-5005A (JP-H5-5005A) and paragraphs 0022 to 0025 of JP2001-222101A can also be preferably used.

These infrared absorbers may be used singly or two or more types thereof may be used in combination, and an infrared absorber, such as a pigment, other than the infrared absorber may be used in combination. Preferable examples of the pigment include compounds described in paragraphs 0072 to 0076 of JP2008-195018A.

The content of the infrared absorber in the image recording layer in the present invention is preferably 0.1 mass % to 10.0 mass % of the total solid content of the image recording layer, and more preferably 0.5 mass % to 5.0 mass % of the total solid content of the image recording layer.

<Polymer Particles>

The image recording layer in the present invention contains polymer particles. The polymer particles in the present invention mean fine particles which can convert the characteristics of the image recording layer into hydrophobic properties when heated. The volume average particle diameter of a polymer particle used in the present invention is preferably 0.01 μm to 3.0 μm. As fine particles, at least one selected from hydrophobic thermoplastic polymer fine particles, thermally reactive polymer fine particles, a fine particle polymer having a polymerizable group, a microcapsule including a hydrophobic compound, or microgel (cross-linking fine particle polymer) is preferable. Among these, a fine particle polymer having a polymerizable group, a hydrophobic thermoplastic fine particle polymer, and microgel are preferable, a hydrophobic thermoplastic fine particle polymer and microgel are more preferable, and microgel is still more preferable.

[Hydrophobic Thermoplastic Fine Particle Polymer]

Suitable examples of the hydrophobic thermoplastic fine particle polymer include hydrophobic thermoplastic fine particle polymers disclosed in Research Disclosure No. 333003 of January 1992, JP1997-123387A (JP-H9-123387A), JP1997-131850A (JP-H9-131850A), JP1997-171249A (JP-H9-171249A), JP1997-171250A (JP-H9-171250A), EP931,647B, and the like.

Specific examples of the polymer constituting such hydrophobic thermoplastic fine particle polymers include a homopolymer or a copolymer of a monomer such as ethylene, styrene, vinyl chloride, methyl acrylate, ethyl acrylate, methyl methacrylate, ethyl methacrylate, vinylidene chloride, acrylonitrile, vinyl carbazole, acrylate having a polyalkylene structure, or methacrylate, or a mixture thereof. Among these, more suitable examples thereof include polystyrene, a copolymer containing styrene and acrylonitrile, and polymethyl methacrylate.

The volume average particle diameter of the hydrophobic thermoplastic fine particle polymer used in the present invention is preferably 0.01 μm to 3.0 μm.

[Thermally Reactive Fine Particle Polymer]

Examples of the thermally reactive fine particle polymer used in the present invention include a fine particle polymer having a thermally reactive group, and these form a hydrophobic region through cross-linking due to a thermal reaction and through the change in functional groups during the cross-linking.

As the thermally reactive group in the fine particle polymer having a thermally reactive group used in the present invention, a functional group performing any reaction may be used as long as a chemical bond is formed. However, a polymerizable group is preferable, and suitable examples thereof include an ethylenically unsaturated group (for example, an acryloyl group, a methacryloyl group, a vinyl group, and an allyl group) which performs a radical polymerization reaction, a cationic polymerizable group (for example, a vinyl group, a vinyloxy group, an epoxy group, and an oxetanyl group), an isocyanate group that performs an addition reaction or a block body thereof, an epoxy group, a vinyloxy group, and a functional group (for example, an amino group, a hydroxy group, and a carboxy group) which has an active hydrogen atom which is a reaction counterpart thereof, a carboxy group that performs a condensation reaction, a hydroxy group or an amino group which is a reaction counterpart, an acid anhydride that performs a ring-opening addition reaction, and an amino group or a hydroxy group which is a reaction counterpart.

[Microcapsule]

Examples of the microcapsule used in the present invention include a microcapsule containing all or a portion of constituent components of the image recording layer as disclosed in JP2001-277740A and JP2001-277742A. The constituent components of the image recording layer can be contained in a portion other than the microcapsule. Furthermore, a preferred aspect of the image recording layer containing the microcapsule is to contain a hydrophobic constituent component in the microcapsule and contain a hydrophilic constituent component in a portion other than the microcapsule.

As a method for preparing the microcapsule, any well known method can be used.

The volume average particle diameter of the above-described microcapsule is preferably 0.01 μm to 3.0 μm, more preferably 0.05 μm to 2.0 μm, and particularly preferably 0.10 μm to 1.0 μm. In this range, favorable resolution and temporal stability can be obtained.

[Microgel]

The microgel particles are reactive or non-reactive resin particles which are dispersed in an aqueous medium. An aspect, in which this microgel is set to be reactive microgel by making the inside or preferably the surface of a particle thereof have a polymerizable group, is preferable from the viewpoint of image formation sensitivity or printing durability.

As a method of preparing microgel, a well-known method can be used.

Preferred microgel used in the present invention has cross-linking reactivity. From this viewpoint, the material to be used is preferably polyureas, polyurethanes, polyesters, polycarbonates, polyamides, and mixtures thereof, more preferably polyureas and polyurethanes, and particularly preferably polyurethanes.

A method for producing microgel will be exemplified. Monohydric alcohol having an ethylenically unsaturated group is reacted with an adduct of polyhydric alcohol and diisocyanate as an oily ingredient, and is dissolved in ethyl acetate together with a small amount of surfactant. An aqueous solution of polyvinyl alcohol is prepared as an aqueous component. An oily component and an aqueous component are mixed and are emulsified and dispersed after being stirred at a high speed using a mechanical stirring machine. Desired microgel is obtained by adjusting the solid content concentration.

The volume average particle diameter of microgel is preferably 0.01 μm to 3.0 μm, still more preferably 0.05 μm to 2.0 μm, and particularly preferably 0.10 μm to 1.0 μm. In this range, favorable cross-linking properties and time stability can be obtained.

It is preferable that the content of the polymer particle is preferably within a range of 5 mass % to 90 mass % of the total solid content of the image recording layer.

<Binder Polymer>

It is possible to use a hinder polymer for the image recording layer used in the present invention in order to enhance the film strength of the image recording layer. As the binder polymer that can be used in the present invention, any well-known binder polymer in the related art can be used without restriction, and a polymer having coating properties is preferable. Among these, an acrylic resin, a polyvinyl acetal resin, and a polyurethane resin are preferable.

In addition, the binder polymer in the present invention does not contain the above-described polymer particles.

[Polymer Compound with Star Shape (Star-Shaped Polymer Compound)]

It is preferable that the image recording layer in the present invention contains a polymer compound (hereinafter, also referred to as a "polymer compound with a star shape" or a "star-shaped polymer compound") which has a polymer chain bonded to a nucleus, as which a trifunctional to decafunctional polyfunctional thiol is used, through sulfide bonding as a binder polymer, and in which the above-described polymer chain has a polymerizable group.

In addition, a tetrafunctional to decafunctional polyfunctional thiol is preferable as the above-described polyfunctional thiol.

In the above-described star-shaped polymer compound, any trifunctional to decafunctional polyfunctional thiol which is used as a nucleus can be suitably used as long as the polymer compound is a compound having 3 to 10 thiol groups in one molecule. Examples of the polyfunctional thiol compound include compounds A, B, C, D, E, and F disclosed in paragraphs 0021 to 0040 of JP2012-148555A. In these polyfunctional thiols, compounds A to E are preferable, the compounds A, B, D, and E are more preferable, the compounds A, B, and D are still more preferable, and the compound B is particularly preferable, from the viewpoint of printing durability and developability.

Hereinafter, the particularly preferable compound B will be described in detail.

(Compound B)

The compound B is a compound which is obtained through a dehydration condensation reaction between alcohol and a carboxylic acid having a thiol group.

Among these, a compound which is obtained through a condensation reaction between trifunctional to decafunctional polyfunctional alcohol and a carboxylic acid having one thiol group is preferable. A method for performing deprotection after subjecting a polyfunctional alcohol and a carboxylic acid which has a thiol group and has been protected, to dehydration condensation can also be used.

Specific examples of the polyfunctional alcohol include pentaerythritol, dipentaerythritol, tripentaerythritol, sorbitol, mannitol, iditol, dulcitol, and inositol. Pentaerythritol, dipentaerythritol, tripentaerythritol, and sorbitol are preferable and pentaerythritol, dipentaerythritol, and tripentaerythritol are particularly preferable.

Specific examples of the carboxylic acid having a thiol group include a mercaptoacetic acid, a 3-mercaptopropionic acid, a 2-mercaptopropionic acid, N-acetylcysteine, N-(2-mercaptopropionyl)glycine, and a thiosalicylic acid. A mercaptoacetic acid, a 3-mercaptopropionic acid, a 2-mercaptopropionic acid, N-acetylcysteine, and N-(2-mercaptopropionyl)glycine are preferable, a mercaptoacetic acid, a 3-mercaptopropionic acid, a 2-mercaptopropionic acid, N-acetylcysteine, and N-(2-mercaptopropionyl)glycine are more preferable, and a mercaptoacetic acid, a 3-mercaptopropionic acid, N-acetylcysteine, and N-(2-mercaptopropionyl)glycine are particularly preferable.

Specific examples of the compound B include compounds in Table 1 below. The present invention is not limited thereto.

TABLE 1

| | Carboxylic acid having thiol group | | | | | |
|---|---|---|---|---|---|---|
| Polyfunctional-alcohol | Mercapto-acetic acid | 3-mercapto-propionic acid | 2-mercapto-propionic acid | N-acetyl cysteine | N-(2-mercapto-propionyl) glycine | Thiosalicylic acid |
| Dipentaerythritol | SB-1 | SB-2 | SB-3 | SB-4 | SB-5 | SB-6 |
| Tripentaerythritol | SB-7 | SB-8 | SB-9 | SB-10 | SB-11 | SB-12 |
| Sorbitol | SB-13 | SB-14 | SB-15 | SB-16 | SB-17 | SB-18 |
| Mannitol | SB-19 | SB-20 | SB-21 | SB-22 | SB-23 | SB-24 |
| Iditol | SB-25 | SB-26 | SB-27 | SB-28 | SB-29 | SB-30 |
| Dulcitol | SB-31 | SB-32 | SB-33 | SB-34 | SB-35 | SB-36 |
| Inositol | SB-37 | SB-38 | SB-39 | SB-40 | SB-41 | SB-42 |
| Pentaerythritol | SB-43 | SB-44 | SB-45 | SB-46 | SB-47 | SB-48 |

In the specific examples, SB-1 to SB-23, SB-25 to SB-29, SB-31 to SB-35, SB 37 to SB 41, and SB-43 to SB-48 are preferable, SB-2 to SB-5, SB-8 to SB-11, SB-14 to SB-17, and SB-43 to SB-48 are more preferable, and SB-2, SB-4, SB-5, SB-8, SB-10, SB-11, and SB-43 are particularly preferable. In a polyfunctional thiol synthesized using these compounds, the distance between thiol groups is long and steric hindrance is small, and therefore, it is possible to form a desired star-shaped structure.

The star-shaped polymer compound used in the present invention is a polymer compound which has a polymer chain bonded to a nucleus, as which the above-described polyfunctional thiol is used, through sulfide bonding, and the above-described polymer chain has a polymerizable group. Examples of the polymer chain in the star-shaped polymer compound used in the present invention include a vinyl polymer, a (meth)acrylic acid-based polymer, and a styrene-based polymer which are well known and can be respectively produced through radical polymerization from a vinyl monomer, a (meth)acrylic acid-based monomer, and a styrene-based monomer, and a (meth)acrylic acid-based polymer is particularly preferable.

Examples of the star-shaped polymer compound used in the present invention include a star-shaped polymer compound which has a polymerizable group, such as an ethylenically unsaturated bond for enhancing the coating strength of an image portion as disclosed in JP2008-195018A, in a main chain or a side chain, and preferably in a side chain. A crosslink is formed between polymer molecules using the polymerizable group, and curing is promoted.

As the polymerizable group, an ethylenically unsaturated group such as a (meth)acrylic group, a vinyl group, an allyl group, or a styryl group, an epoxy group, or the like is preferable, a (meth)acrylic group, a vinyl group, or a styryl group are more preferable from the viewpoint of polymerization reactivity, and a (meth)acrylic group is particularly preferable. These groups can be introduced into a polymer through a polymer reaction or copolymerization. For example, it is possible to use a reaction between glycidyl methacrylate and a polymer which has a carboxy group in a side chain; or a reaction between an ethylenically unsaturated group-containing carboxylic acid such as a methacrylic acid and a polymer which has an epoxy group. These groups may be used in combination.

The content of the crosslinkable group in a star-shaped polymer compound is preferably 0.1 mmol to 10.0 mmol, more preferably 0.25 mmol to 7.0 mmol, and most preferably 0.5 mmol to 5.5 mmol, per 1 g of the star-shaped polymer compound.

In addition, it is preferable that the star-shaped polymer compound used in the present invention further has a hydrophilic group. The hydrophilic group contributes to provision of on-press developability to the image recording layer. Particularly, the printing durability and the developability can be made compatible due to coexistence of the polymerizable group and the hydrophilic group.

Examples of the hydrophilic group include $—SO_3M^1$, —OH, $—CONR^1R^2$ ($M^1$ represents a metal ion, an ammonium ion, or a phosphonium ion; $R^1$ and $R^2$ each independently represent a hydrogen atom, an alkyl group, an alkenyl group, or an aryl group; and $R^1$ and $R^2$ may be bonded to each other to form a ring), $—N^+R^3R^4R^5X^-$ ($R^3$ to $R^5$ each independently represent an alkyl group having 1 to 8 carbon atoms; and $X^-$ represents an counter anion), a group represented by the following Formula (1-1) and a group represented by the following Formula (1-2).

$$—(CH_2CH_2O)_nR \qquad \text{Formula(1-1)}$$

$$—(C_3H_6O)_mR \qquad \text{Formula (1-2)}$$

In the above formulas, n and m each independently represent an integer of 1 to 100 and Rs each independently represent a hydrogen atom or an alkyl group having 1 to 18 carbon atoms.

Among these hydrophilic groups, $—CONR^1R^2$, a group represented by Formula (1-1), and a group represented by Formula (1-2) are preferable, $—CONR^1R^2$ and a group represented by Formula (1-1) are more preferable, and a group represented by Formula (1-1) is particularly preferable. Furthermore, in the group represented by Formula (1-1), n is more preferably 1 to 10 and particularly preferably 1 to 4. In addition, R is more preferably a hydrogen atom or an alkyl group having 1 to 4 carbon atoms and is particularly preferably a hydrogen atom or a methyl group. Two or more types of these hydrophilic groups may be used in combination.

In addition, it is preferable that the star-shaped polymer compound used in the present invention does not substantially have a carboxylic acid group, a phosphoric acid group, and a phosphonic acid group. Specifically, less than 0.1 mmol/g is preferable, less than 0.05 mmol/g is more preferable, and less than or equal to 0.03 mmol/g is particularly preferable. If the proportion of these acid groups is less than 0.1 mmol/g, the developability is more improved.

In addition, it is possible to introduce a lipophilic group such as an alkyl group, an aryl group, an aralkyl group, or an alkenyl group into the star-shaped polymer compound used in the present invention in order to control depositing properties. Specifically, a lipophilic group-containing monomer such as a methacrylic acid alkyl ester may be copolymerized.

Specific examples of the star-shaped polymer compound used in the present invention will be shown below, but the present invention is not limited thereto.

SC-1, SC-2, SC-4, SC-5, SD-2 to SD-5, SD-8, SD-14, SA-1 to SA-3, SE-2, SE-3, SE-5 to SE-7, SE-9, and SF-1 in Tables are respectively the same as those of compounds disclosed in paragraphs 0021 to 0040 of JP2012-148555A.

TABLE 2
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-1 | SB-2 | 1 | 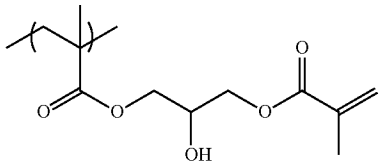 | 10 | 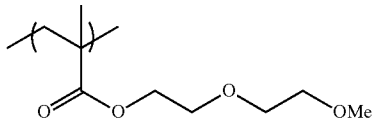 | 40 | 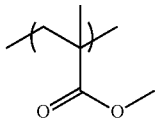 | 50 | 65000 |
| P-2 | SB-2 | 1 | 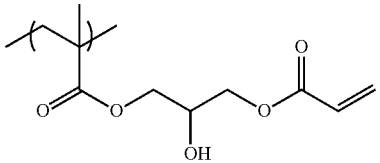 | 10 | 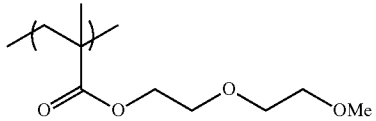 | 40 | 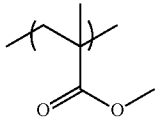 | 50 | 64000 |
| P-3 | SB-2 | 1 | 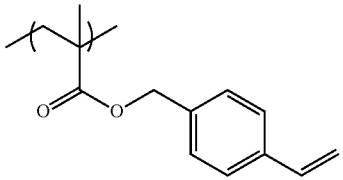 | 10 | 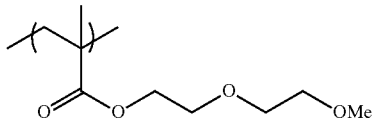 | 40 | 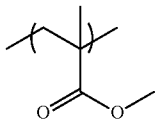 | 50 | 62000 |
| P-4 | SB-2 | 1 | 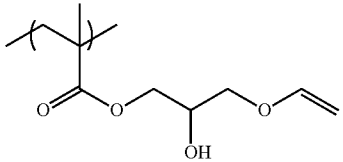 | 10 | 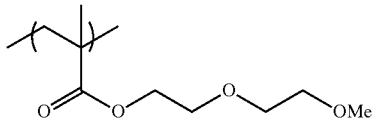 | 40 | 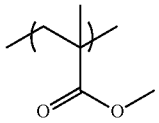 | 50 | 66000 |
| P-5 | SB-2 | 1 | 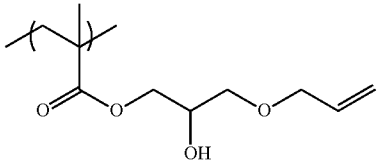 | 10 | 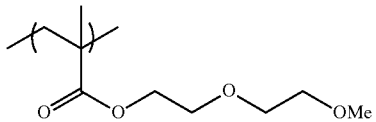 | 40 | 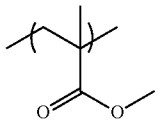 | 50 | 67000 |

TABLE 2-continued
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-6 | SB-2 | 1 | 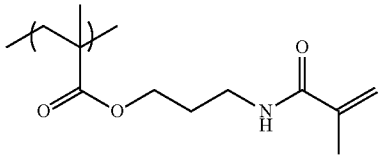 | 10 | 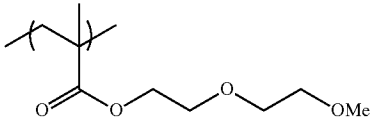 | 40 | 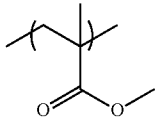 | 50 | 69000 |
| P-7 | SB-2 | 1 | 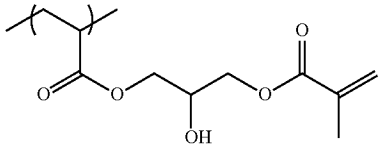 | 10 | 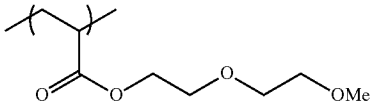 | 40 | 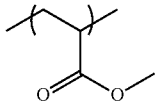 | 50 | 61000 |
| P-8 | SB-2 | 1 | 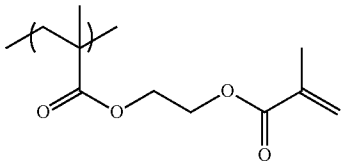 | 10 | 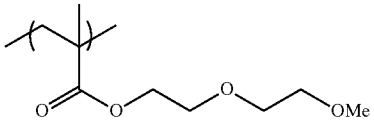 | 40 | 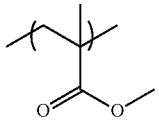 | 50 | 71000 |
| P-9 | SB-2 | 1 | 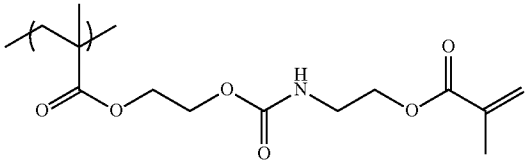 | 10 | 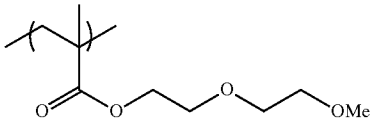 | 50 | 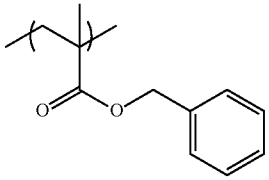 | 40 | 66000 |
| P-10 | SB-2 | 1 | 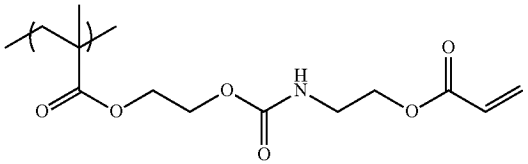 | 10 | 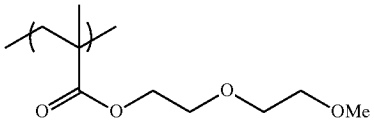 | 50 | 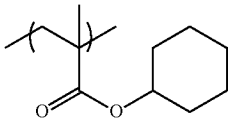 | 40 | 62000 |

TABLE 2-continued
| | Central nucles | | polymer chain | | | | | | |
|---|---|---|---|---|---|---|---|---|---|
| Polymer number | Number | Mol %*[1] | polymerizable group | Mol % | Hydrophilic group | Mol % | others | Mol % | Mw |
| P-11 | SB-2 | 1 | 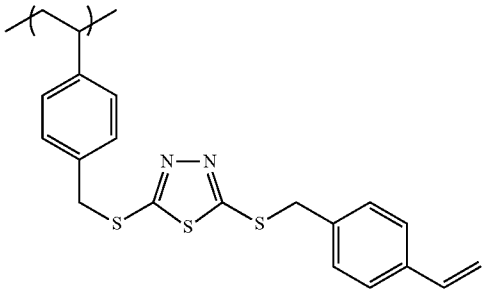 | 10 | 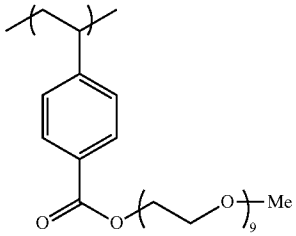 | 60 | 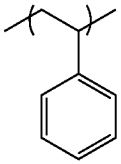 | 30 | 58000 |
| P-12 | SB-2 | 1 | 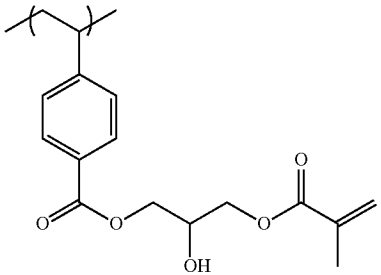 | 10 | 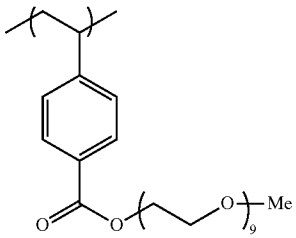 | 60 | 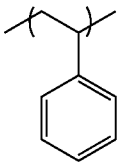 | 30 | 57000 |
| P-13 | SB-2 | 1 | 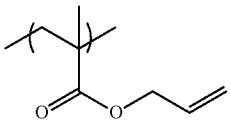 | 10 | 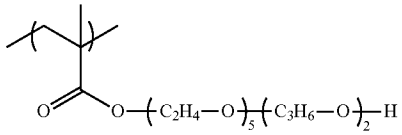 | 50 | 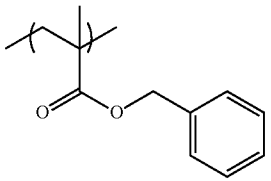 | 40 | 78000 |
| P-14 | SB-2 | 1 | 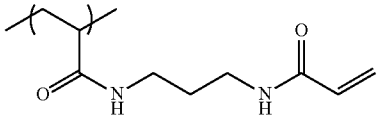 | 10 | 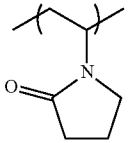 | 40 | 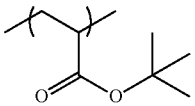 | 50 | 70000 |
*[1]Ratio (%) of number of moles of SH group to number of total moles of monomer TABLE 3
| | Central nucles | | polymer chain | | | | | | | |
|---|---|---|---|---|---|---|---|---|---|---|
| Polymer number | Number | Mol %*1 | polymerizable group | Mol % | Hydrophilic group | Mol % | others | | Mol % | Mw |
| P-15 | SB-2 | 1 | 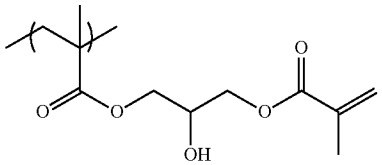 | 5 | 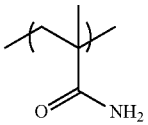 | 8 | 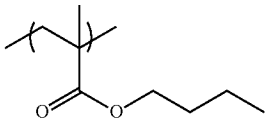 | | 87 | 63000 |
| P-16 | SB-2 | 1 | 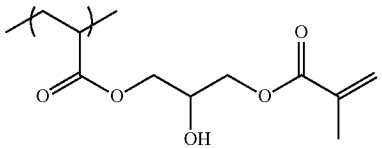 | 5 | 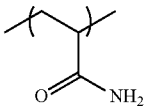 | 6 | 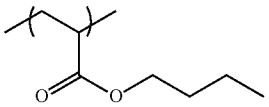 | 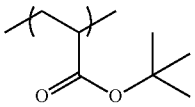 (4:6)*2 | 89 | 64000 |
| P-17 | SB-2 | 1 | 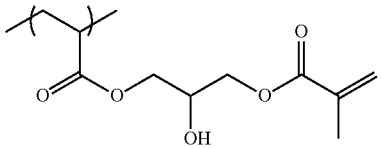 | 5 | 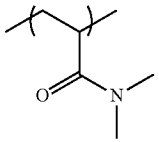 | 10 | 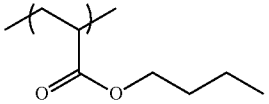 | 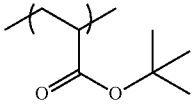 (4:6)*2 | 85 | 61000 |
| P-18 | SB-2 | 1 | 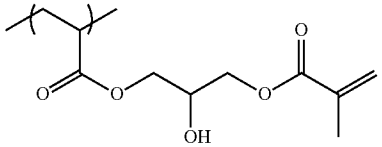 | 5 | 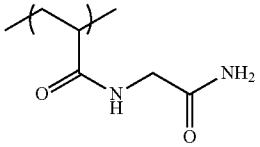 | 5 | 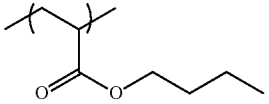 | 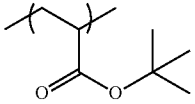 (4:6)*2 | 90 | 59000 |
| P-19 | SB-2 | 1 | 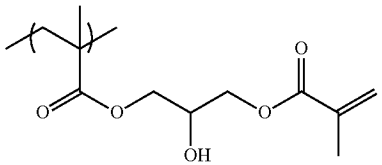 | 5 | 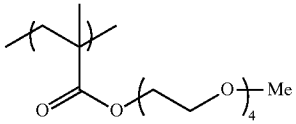 | 26 | 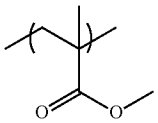 | | 69 | 72000 |

TABLE 3-continued
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-20 | SB-2 | 1 | 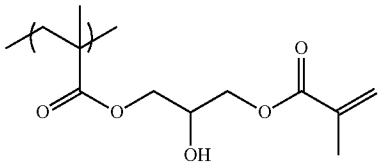 | 5 | 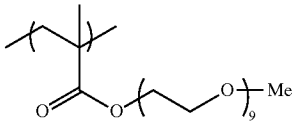 | 12 | 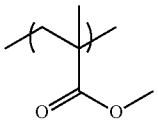 | 83 | 71000 |
| P-21 | SB-2 | 1 | 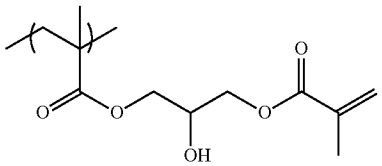 | 5 | 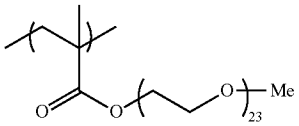 | 8 | 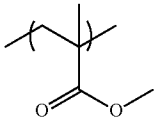 | 87 | 69000 |
| P-22 | SB-2 | 1 | 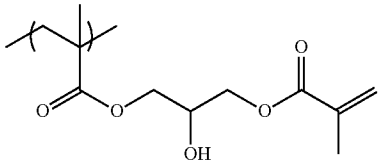 | 5 | 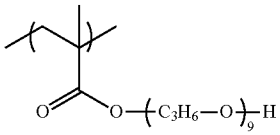 | 15 | 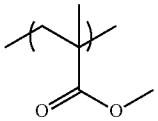 | 80 | 67000 |
| P-23 | SB-2 | 1 | 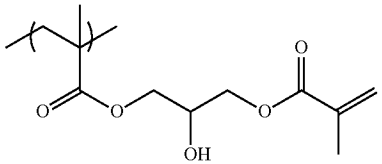 | 5 | 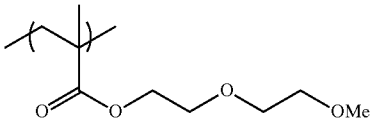 | 52 | 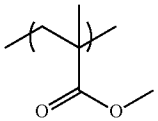 | 43 | 73000 |
*1Ratio (%) of number of moles of SH group to number of total moles of monomer
*2The inside of ( ) represents each molar ratio of unit.

TABLE 4
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-24 | SB-1 | 1 | 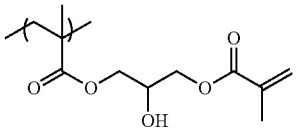 | 5 | 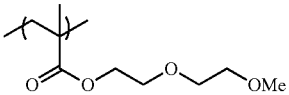 | 52 | 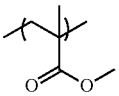 | 43 | 67000 |
| P-25 | SB-3 | 1 | 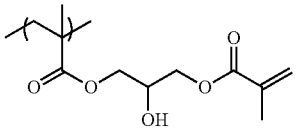 | 5 | 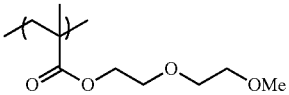 | 52 | 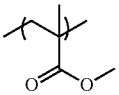 | 43 | 62000 |
| P-26 | SB-4 | 1 | 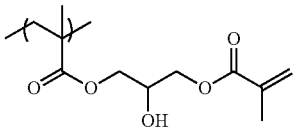 | 5 | 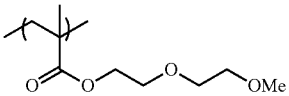 | 52 | 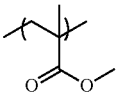 | 43 | 66000 |
| P-27 | SB-5 | 1 | 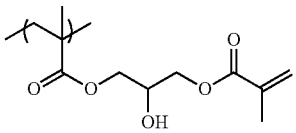 | 5 | 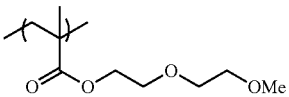 | 52 | 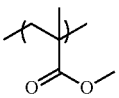 | 43 | 66000 |
| P-28 | SB-6 | 1 | 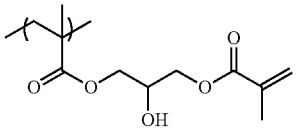 | 5 | 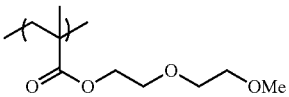 | 52 | 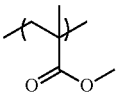 | 43 | 65000 |
| P-29 | SB-7 | 0.6 | 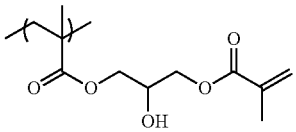 | 5 | 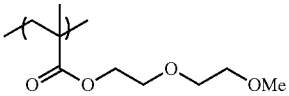 | 52 | 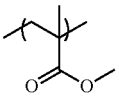 | 43 | 71000 |
| P-30 | SB-8 | 0.6 | 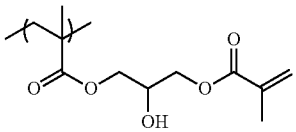 | 5 | 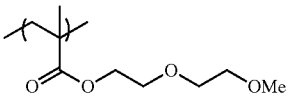 | 52 | 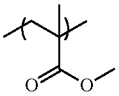 | 43 | 71000 |
| P-31 | SB-9 | 0.6 | 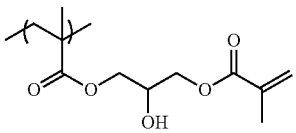 | 5 | 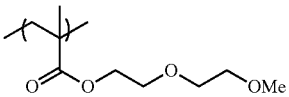 | 52 | 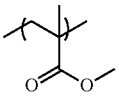 | 43 | 69000 |
| P-32 | SB-10 | 0.6 | 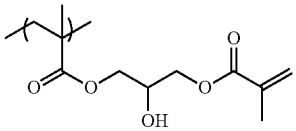 | 5 | 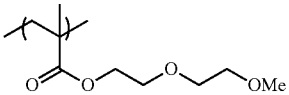 | 52 | 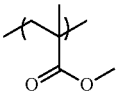 | 43 | 63000 |
| P-33 | SB-11 | 0.6 | 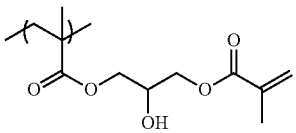 | 5 | 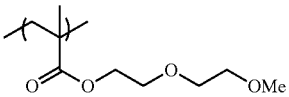 | 52 | 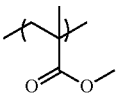 | 43 | 65000 |

TABLE 4-continued

| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-34 | SB-12 | 0.6 | 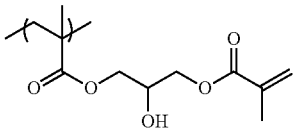 | 5 | 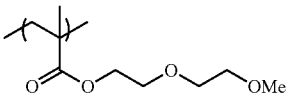 | 52 | 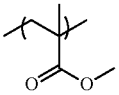 | 43 | 66000 |
| P-35 | SB-14 | 1 | 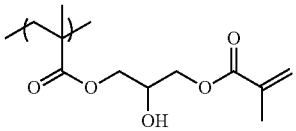 | 5 | 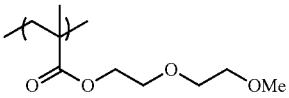 | 52 | 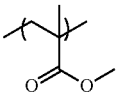 | 43 | 62000 |
| P-36 | SB-15 | 1 | 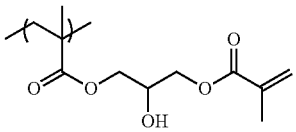 | 5 | 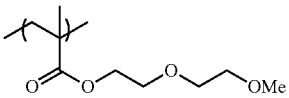 | 52 | 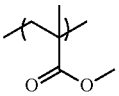 | 43 | 61000 |
| P-37 | SB-16 | 1 | 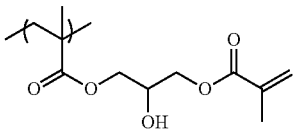 | 5 | 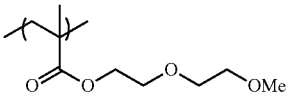 | 52 | 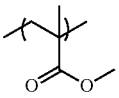 | 43 | 63000 |
| P-38 | SB-17 | 1 | 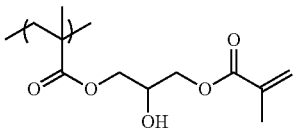 | 5 | 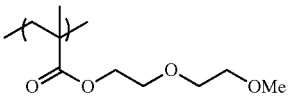 | 52 | 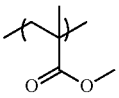 | 43 | 64000 |
| P-39 | SB-20 | 1 | 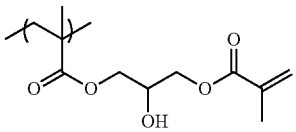 | 5 | 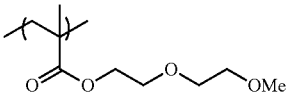 | 52 | 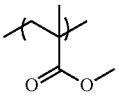 | 43 | 63000 |

*1Ratio (%) of number of moles of SH group to number of total moles of monomer

TABLE 5

| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-40 | SB-26 | 1 | 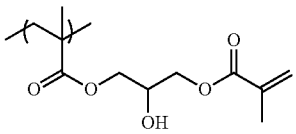 | 5 | 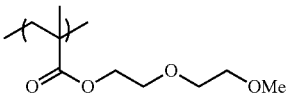 | 52 | 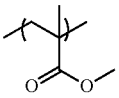 | 43 | 63000 |
| P-41 | SB-32 | 1 | 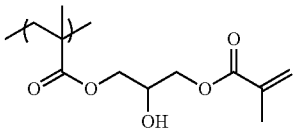 | 5 | 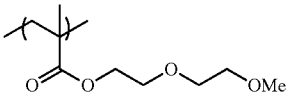 | 52 | 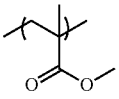 | 43 | 62000 |
| P-42 | SB-38 | 1 | 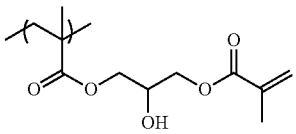 | 5 | 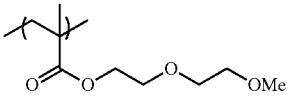 | 52 | 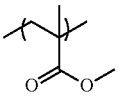 | 43 | 63000 |

TABLE 5-continued
| | Central nucles | | polymer chain | | | | | | |
|---|---|---|---|---|---|---|---|---|---|
| Polymer number | Number | Mol %*[1] | polymerizable group | Mol % | Hydrophilic group | Mol % | others | Mol % | Mw |
| P-43 | SB-37 | 1 | 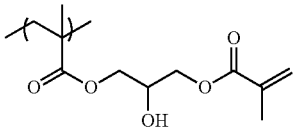 | 5 | 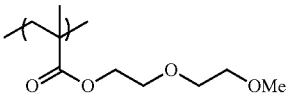 | 52 | 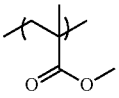 | 43 | 63000 |
| P-44 | SC-1 | 1 | 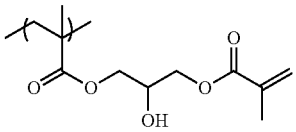 | 5 | 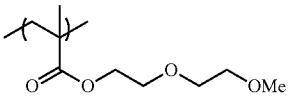 | 52 | 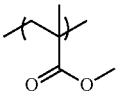 | 43 | 63000 |
| P-45 | SC-2 | 1 | 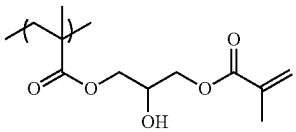 | 5 | 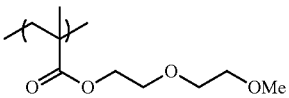 | 52 | 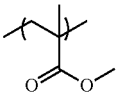 | 43 | 64000 |
| P-46 | SC-4 | 1 | 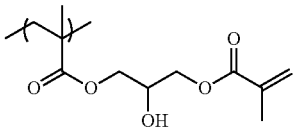 | 5 | 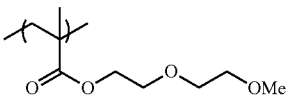 | 52 | 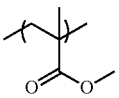 | 52 | 64000 |
| P-47 | SC-5 | 1 | 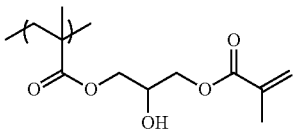 | 5 | 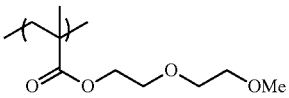 | 52 | 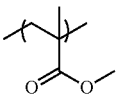 | 43 | 63000 |
| P-48 | SD-2 | 0.8 | 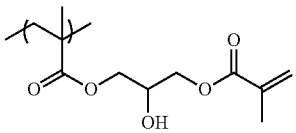 | 5 | 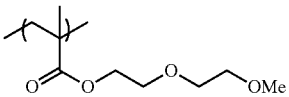 | 52 | 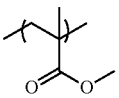 | 43 | 61000 |
| P-49 | SD-3 | 0.8 | 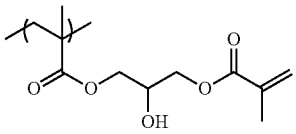 | 5 | 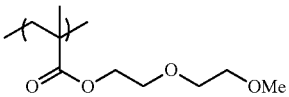 | 52 | 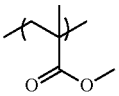 | 43 | 61000 |
| P-50 | SD-4 | 0.8 | 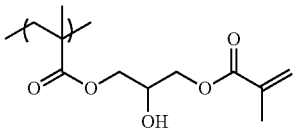 | 5 | 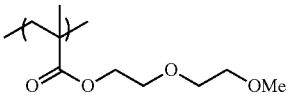 | 52 | 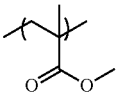 | 43 | 61000 |
| P-51 | SD-5 | 0.8 | 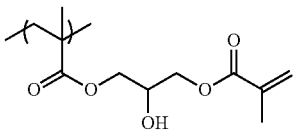 | 5 | 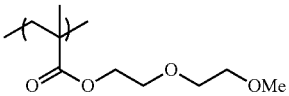 | 52 | 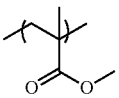 | 43 | 62000 |
*[1]Ratio (%) of number of moles of SH group to number of total moles of monomer TABLE 6
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-52 | SD-8 | 1 | 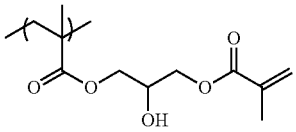 | 5 | 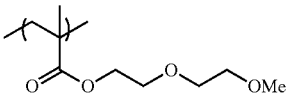 | 52 | 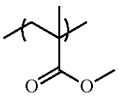 | 43 | 63000 |
| P-53 | SD-14 | 1 | 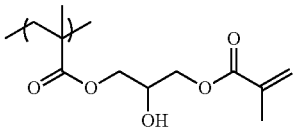 | 5 | 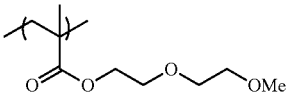 | 52 | 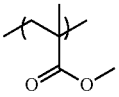 | 43 | 63000 |
| P-54 | SA-1 | 1 | 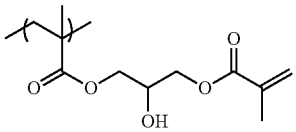 | 5 | 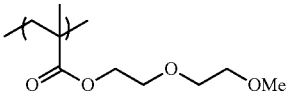 | 52 | 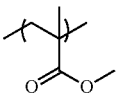 | 43 | 60000 |
| P-55 | SA-2 | 0.6 | 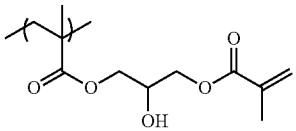 | 5 | 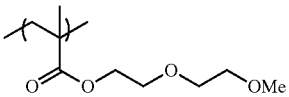 | 52 | 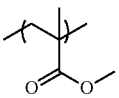 | 43 | 61000 |
| P-56 | SA-3 | 1 | 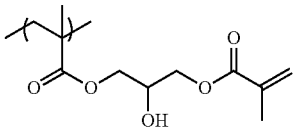 | 5 | 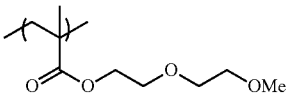 | 52 | 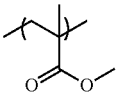 | 43 | 58000 |
| P-57 | SE-2 | 1 | 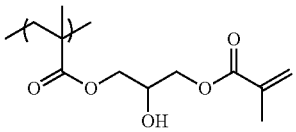 | 5 | 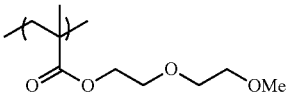 | 52 | 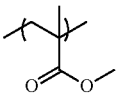 | 43 | 61000 |
| P-58 | SE-3 | 1 | 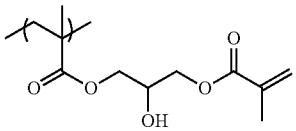 | 5 | 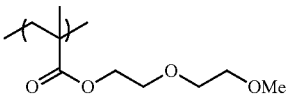 | 52 | 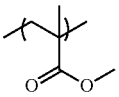 | 43 | 60000 |
| P-59 | SE-5 | 1 | 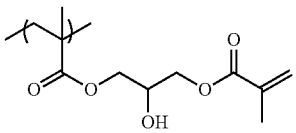 | 5 | 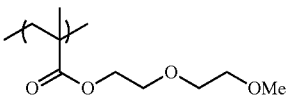 | 52 | 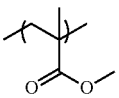 | 43 | 60000 |
| P-60 | SE-6 | 1 | 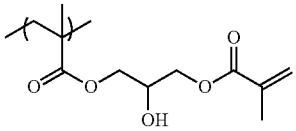 | 5 | 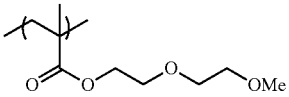 | 52 | 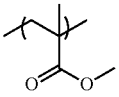 | 43 | 61000 |
| P-61 | SE-7 | 1 | 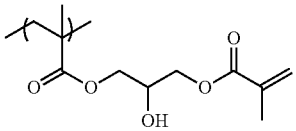 | 5 | 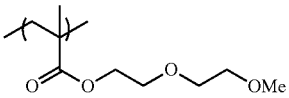 | 52 | 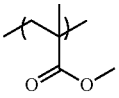 | 43 | 62000 |

TABLE 6-continued
| | Central nucles | | polymer chain | | | | | | |
|---|---|---|---|---|---|---|---|---|---|
| Polymer number | Number | Mol %*[1] | polymerizable group | Mol % | Hydrophilic group | Mol % | others | Mol % | Mw |
| P-62 | SE-9 | 1 | 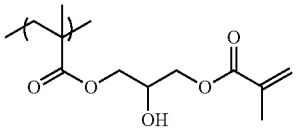 | 5 | 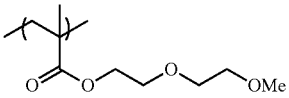 | 52 | 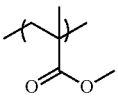 | 43 | 62000 |
| P-63 | SF-1 | 1 | 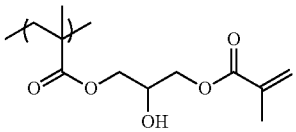 | 5 | 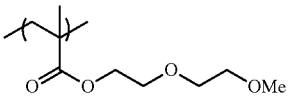 | 52 | 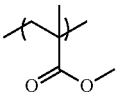 | 43 | 61000 |
*[1]Ratio (%) of number of moles of SH group to number of total moles of monomer TABLE 7
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-64 | SB-43 | 1 | 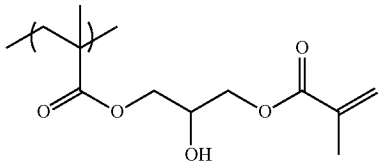 | 10 | 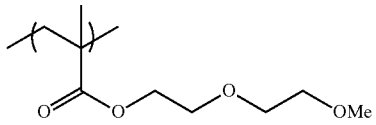 | 40 | 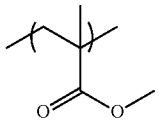 | 50 | 65000 |
| P-65 | SB-43 | 1 | 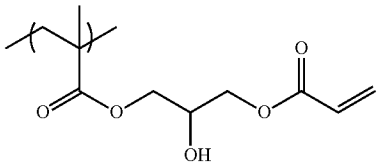 | 10 | 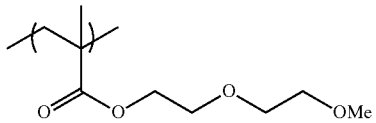 | 40 | 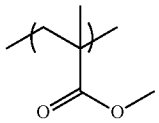 | 50 | 64000 |
| P-66 | SB-43 | 1 | 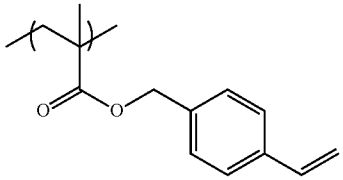 | 10 | 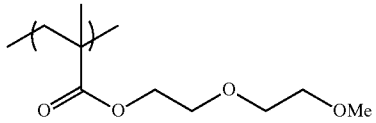 | 40 | 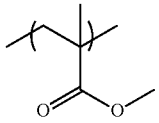 | 50 | 62000 |
| P-67 | SB-43 | 1 | 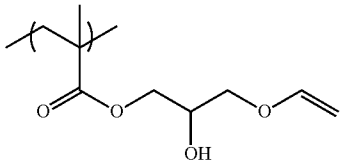 | 10 | 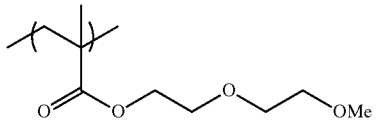 | 40 | 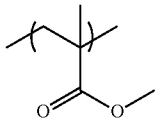 | 50 | 66000 |
| P-68 | SB-43 | 1 | 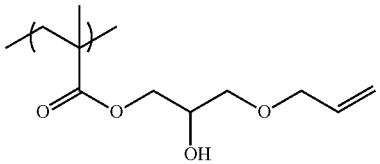 | 10 | 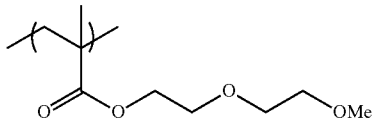 | 40 | 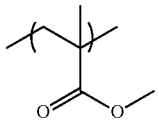 | 50 | 67000 |

TABLE 7-continued
| | Central nucles | | polymer chain | | | | | | |
|---|---|---|---|---|---|---|---|---|---|
| Polymer number | Number | Mol %*1 | polymerizable group | Mol % | Hydrophilic group | Mol % | others | Mol % | Mw |
| P-69 | SB-43 | 1 | 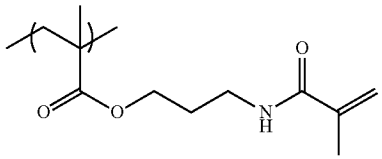 | 10 | 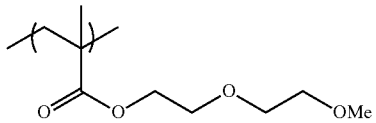 | 40 | 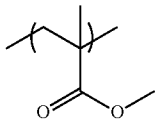 | 50 | 69000 |
| P-70 | SB-43 | 1 | 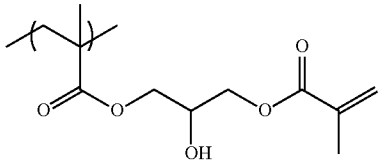 | 10 | 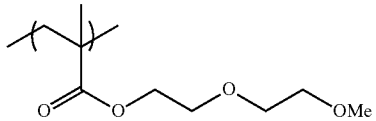 | 40 | 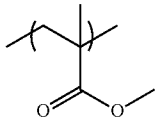 | 50 | 61000 |
| P-71 | SB-43 | 1 | 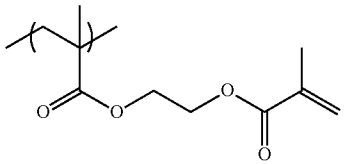 | 10 | 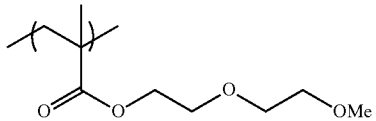 | 40 | 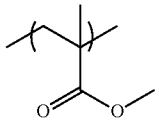 | 50 | 71000 |
| P-72 | SB-43 | 1 | 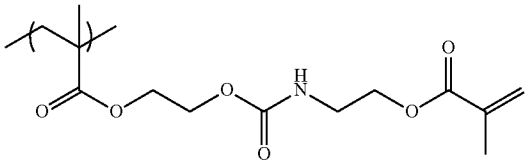 | 10 | 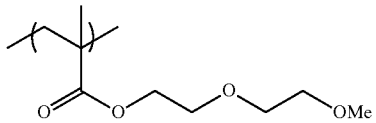 | 50 | 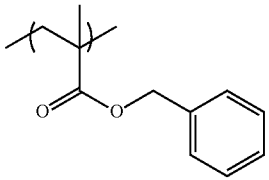 | 40 | 66000 |
| P-73 | SB-43 | 1 | 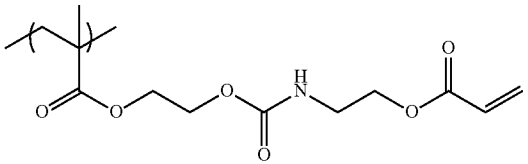 | 10 | 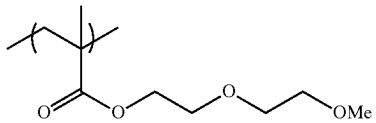 | 50 | 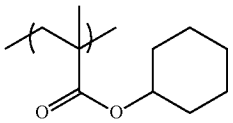 | 40 | 62000 |

TABLE 7-continued
| | Central nucles | | polymer chain | | | | | | |
|---|---|---|---|---|---|---|---|---|---|
| Polymer number | Number | Mol %*[1] | polymerizable group | Mol % | Hydrophilic group | Mol % | others | Mol % | Mw |
| P-74 | SB-43 | 1 | 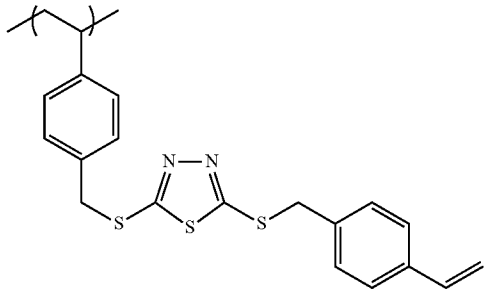 | 10 | 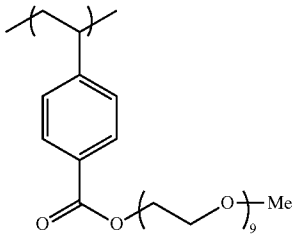 | 60 | 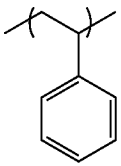 | 30 | 58000 |
| P-75 | SB-43 | 1 | 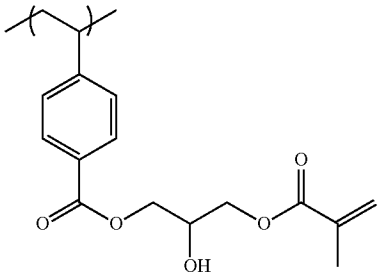 | 10 | 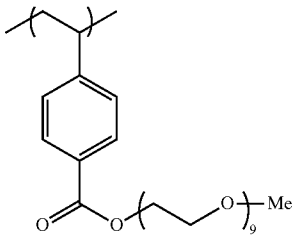 | 60 | 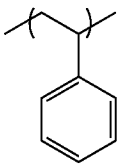 | 30 | 57000 |
| P-76 | SB-43 | 1 | 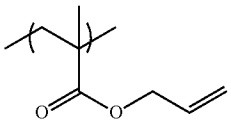 | 10 | 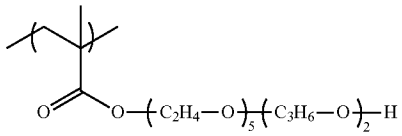 | 50 | 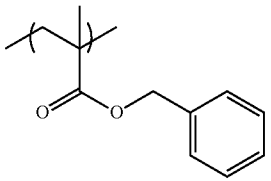 | 40 | 78000 |
| P-77 | SB-43 | 1 | 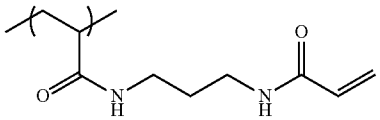 | 10 | 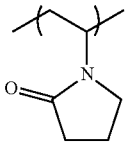 | 40 | 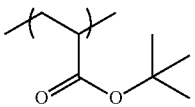 | 50 | 70000 |
*[1]Ratio (%) of number of moles of SH group to number of total moles of monomer The star-shaped polymer compound used in the present invention can be synthesized through a well-known method such as radical polymerization of the above-described monomer constituting a polymer chain in the presence of the above-described polyfunctional thiol compound.

The weight average molecular weight (Mw) of the star-shaped polymer compound used in the present invention is preferably 5,000 to 500,000, more preferably 10,000 to 250,000, and particularly preferably 20,000 to 150,000. In this range, the developability and the printing durability becomes more favorable.

The star-shaped polymer compound used in the present invention may be used singly, or two or more types thereof may be used in combination. In addition, other binder polymers to be described below may be used in combination.

The content rate of the star-shaped polymer compound used in the present invention, in the image recording layer is preferably 5 mass % to 95 mass %, more preferably 10 mass % to 90 mass %, and particularly preferably 15 mass % to 85 mass % with respect to the total solid content of the image recording layer.

The star-shaped polymer compound disclosed in JP2012-148555A is particularly preferable in that permeability of a hydrophilic coating liquid is promoted and on-press developability is improved.

[Other Binder Polymers]

Examples of the other binder polymers suitable for the present invention include a binder polymer which is disclosed in JP2008-195018A and has a crosslinkable functional group for enhancing the coating strength of an image portion, in a main chain or a side chain, and preferably in a side chain. A crosslink is formed between polymer molecules using the crosslinkable group, and curing is promoted.

As the crosslinkable functional group, an ethylenically unsaturated group such as a (meth)acryloyl group, a vinyl group, an allyl group, or a styryl group, an epoxy group, or the like is preferable, and these groups can be introduced into a polymer through a polymer reaction or copolymerization. For example, it is possible to use a reaction between glycidyl methacrylate and polyurethane or an acrylic polymer which has a carboxy group in a side chain; or a reaction between an ethylenically unsaturated group-containing carboxylic acid such as a methacrylic acid and a polymer which has an epoxy group.

The content of the crosslinkable group in a binder polymer is preferably 0.1 mmol to 10.0 mmol, more preferably 1.0 mmol to 7.0 mmol, and most preferably 2.0 mmol to 5.5 mmol, per 1 g of the binder polymer.

In addition, it is preferable that the binder polymer used in the present invention further has a hydrophilic group. The hydrophilic group contributes to provision of on-press developability to the image recording layer. Particularly, the printing durability and the developability can be made compatible due to coexistence of the crosslinkable group and the hydrophilic group.

Examples of the hydrophilic group include hydroxy group, a carboxy group, an alkylene oxide structure, an amino group, an ammonium group, an amido group, a sulfo group, and a phosphoric acid group. Among these, an alkylene oxide structure having 1 to 9 alkylene oxide units having 2 or 3 carbon atoms is preferable. A monomer having a hydrophilic group may be copolymerized in order to provide a binder polymer with a hydrophilic group.

In addition, it is possible to introduce a lipophilic group such as an alkyl group, an aryl group, an aralkyl group, or an alkenyl group into the binder polymer used in the present invention in order to control depositing properties. Specifically, a lipophilic group-containing monomer such as a methacrylic acid alkyl ester may be copolymerized.

Specific examples (1) to (11) of binder polymers used in the present invention will be shown below, but the present invention is not limited thereto.

(1)

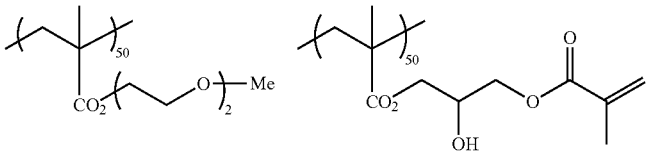

(2)

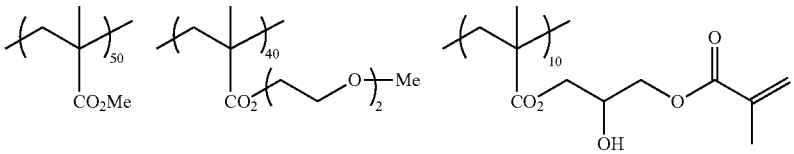

(3)

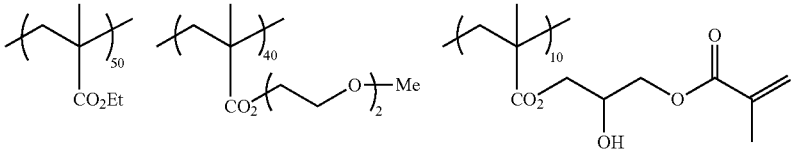

(4)

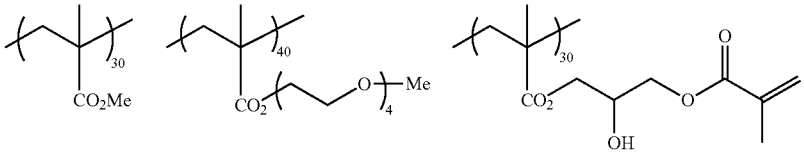

-continued
(5)
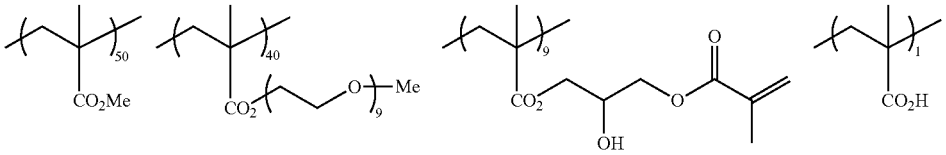
(6)
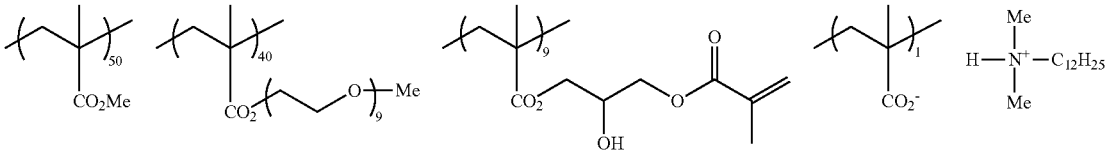
(7)
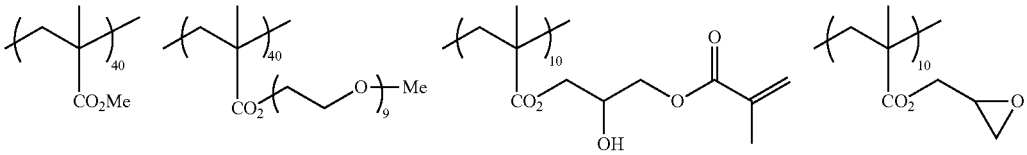
(8)
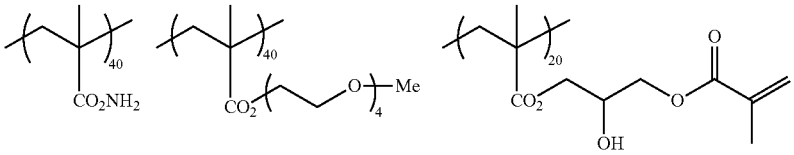
(9)
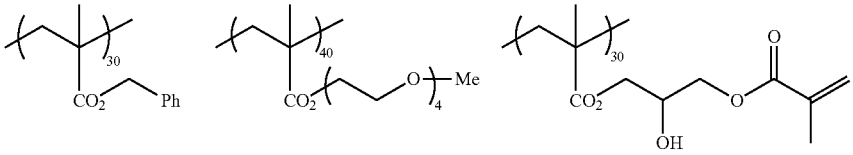
(10)
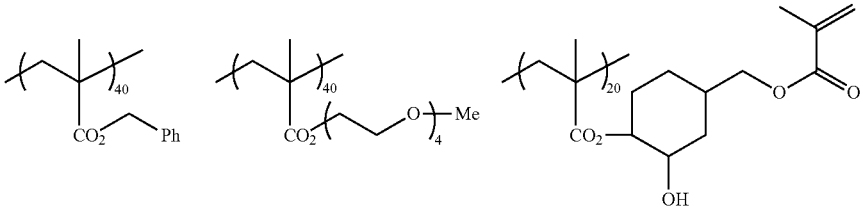

-continued (11)

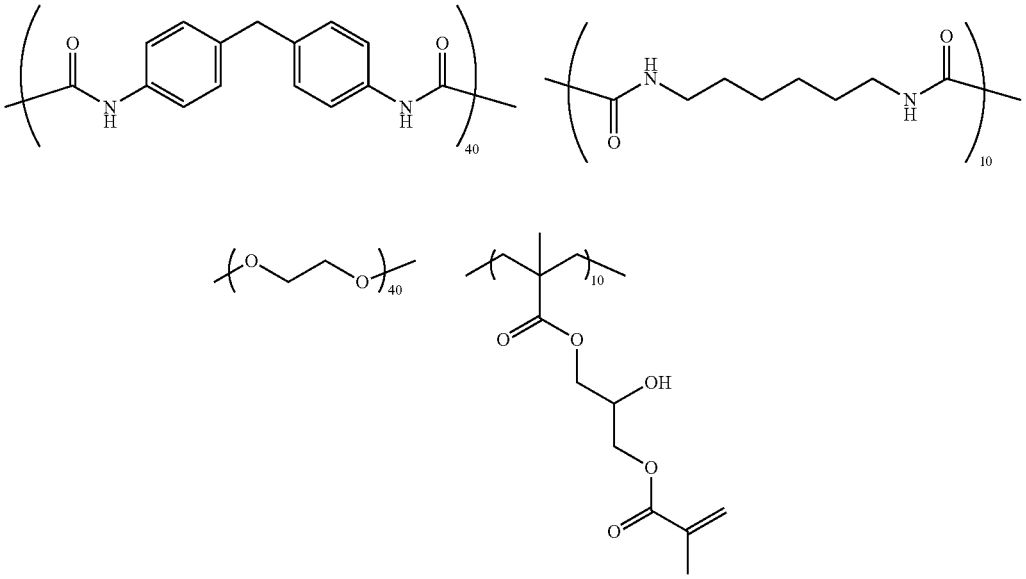

The weight average molecular weight (Mw) of the binder polymers used in the present invention is preferably greater than or equal to 2,000, more preferably greater than or equal to 5,000, and still more preferably 10,000 to 300,000.

In the present invention, if necessary, it is possible to use hydrophobic polymers such as polymethyl methacrylate or hydrophilic polymers such as polyvinyl alcohol and cellulose derivatives (for example, carboxymethyl cellulose, carboxyethyl cellulose, methyl cellulose, hydroxypropyl cellulose, and methylpropyl cellulose), and polyacrylic acid which are disclosed in JP2008-195018A, in an image recording layer.

In addition, a lipophilic binder polymer and a hydrophilic binder polymer can be used in combination.

The total content of the binder polymers is preferably 5 mass % to 90 mass %, more preferably 5 mass % to 80 mass %, and still more preferably 10 mass % to 70 mass % with respect to the total solid content of the image recording layer.

Hereinafter, a polymerization initiator, a polymerizable compound, and other components which are arbitrary components of the image recording layer of the present invention will be sequentially described.

<Polymerization Initiator>

The image recording layer used in the present invention preferably contains a polymerization initiator. As the above-described polymerization initiator, it is possible to use a well-known polymerization initiator without any particular limitation, and a radical polymerization initiator is preferable.

The radical polymerization initiator indicates a compound which generates a radical using light, heat, or energy of both of them, and starts and promotes polymerization of a radical polymerizable compound.

Examples of the radical polymerization initiator used in the image recording layer used in the present invention include (a) an organic halide, (b) a carbonyl compound, (c) an azo compound, (d) organic peroxide, (e) a metallocene compound, (f) an azide compound, (g) a hexaarylbiimidazole compound, (h) a borate compound, (i) a disulfone compound, (j) an oxime ester compound, and (k) an onium salt compound.

As (a) the organic halide, compounds disclosed in paragraphs 0022 to 0023 of JP2008-195018A are preferable.

As (b) the carbonyl compound, compounds disclosed in paragraph 0024 of JP2008-195018A are preferable.

As (c) the azo compound, for example, azo compounds disclosed in JP1996-108621A (JP-H8-108621A) and the like can be used.

As (d) the organic peroxide, for example, compounds disclosed in paragraph 0025 of JP2008-195018A are preferable.

As (e) the metallocene compound, for example, compounds disclosed in paragraph 0026 of JP2008-195018A are preferable.

Examples of (f) the azide compound include a compound such as 2,6-bis(4-azidobenzylidene)-4-methylcyclohexanone.

As (g) the hexaarylbiimidazole compound, for example, compounds disclosed in paragraph 0027 of JP2008-195018A are preferable.

Examples of (h) the borate compound include organic borate compounds disclosed in paragraph 0028 of JP2008-195018A.

Specific examples of the borate compound include tetraphenylborate salts, tetratolylborate salts, tetrakis(4-methoxyphenyl)borate salts, tetrakis(pentafluorophenyl)borate salts, tetrakis(3,5-bis(trifluoromethyl)phenyl)borate salts, tetrakis(4-chlorophenyl)borate salts, tetrakis(4-fluorophenyl)borate salts, tetrakis(2-thienyl)borate salts, tetrakis (4-phenyl-phenyl)borate salts, tetrakis(4-t-butylphenyl)borate salts, ethyltriphenylborate salts, and butyltriphenylborate salts. In view of compatibility between printing durability, tone reproducibility and temporal stability, tetraphenylborate salts are preferable. Examples of counter cations of borate compound include well-known cations, such as alkaline metal cations, alkaline earth metal cations, ammonium cations, phosphonium cations, sulfonium cations, iodonium cations, diazonium cations, and azinium cations.

Examples of (i) the disulfone compound include compounds disclosed in JP1986-166544A (JP-S61-166544A).

As (j) the oxime ester compound, for example, compounds disclosed in paragraphs 0028 to 0030 of JP2008-195018A are preferable.

Examples of (k) the onium salt compound include onium salts such as diazonium salts disclosed in S. I. Schlesinger, Photogr. Sci. Eng., 18, 387 (1974), T. S. Bal et al, Polymer, 21, 423 (1980) and JP1993-158230A (JP-H5-158230A) (corresponding to diazonium of NI3), ammonium salts disclosed in U.S. Pat. No. 4,069,055A and JP1992-365049A (JP-H4-365049A), phosphonium salts disclosed in U.S. Pat. Nos. 4,069,055A and 4,069,056A, iodonium salts disclosed in EP104,143B, US2008/0311520A, JP1990-150848A (JP-H2-150848A), JP2008-195018A, or J. V. Crivello et al, Macromolecules, 10(6), 1307 (1977), sulfonium salts disclosed in EP370,693B, EP233,567B, EP297,443B, EP297,442B, U.S. Pat. Nos. 4,933,377A, 4,760,013A, 4,734,444A, 2,833,827A, DE2,904,626B, DE3,604,580B, and DE3,604,581B, selenonium salts disclosed in J. V. Crivello et al, J. Polymer Sci., Polymer Chem. Ed., 17, 1047 (1979), arsonium salts disclosed in C. S. Wen et al, Tech, Proc. Conf. Rad. Curing ASIA, p. 478, Tokyo, October (1988), and azinium salts disclosed in JP2008-195018A.

As an example of the iodonium salt, a diphenyliodonium salt is preferable, an electron donating group, for example, a diphenyliodonium salt substituted with an alkyl group or an alkoxyl group is particularly preferable, and an asymmetrical diphenyliodonium salt is most preferable. Specific examples thereof include diphenyliodonium=hexafluorophosphate, 4-methoxyphenyl-4-(2-methylpropyl) phenyliodonium=hexafluorophosphate, 4-(2-methylpropyl) phenyl-p-tolyl iodonium=hexafluorophosphate, 4-hexyloxy phenyl-2,4,6-trimethoxyphenyliodonium=hexafluorophosphate, 4-hexyloxyphenyl-2,4-diethoxyphenyliodonium=tetrafluoroborate, 4-octyloxyphenyl-2,4,6-trimethoxyphenyliodonium=1-perfluorobutanesulfonate, 4-octyloxyphenyl-2,4,6-trimethoxyphenyliodonium=hexafluorophosphate, bis(4-t-butylphenyl)iodonium=tetraphenylborate, 4-methylphenyl-4-isobutyl phenyliodonium=hexafluorophosphate.

As a counter ion of the iodonium salt, hexafluorophosphate and tetraphenylborate are preferable and tetraphenylborate is more preferable.

Examples of the sulfonium salts include triphenylsulfonium=hexafluorophosphate, triphenylsulfonium=benzoyl formate, bis(4-chlorophenyl) phenylsulfonium=benzoyl formate, bis(4-chlorophenyl)-4-methylphenylsulfonium=tetrafluoroborate, tris(4-chlorophenyl)sulfonium=3,5-bis(methoxycarbonyl) benzenesulfonate, and tris(4-chlorophenyl) sulfonium=hexafluorophosphate.

As the above-described radical polymerization initiator, (k) the onium salt compound is preferably used and (h) the borate compound and (k) the onium salt compound are more preferably used in combination.

The radical polymerization initiator is preferably added at a ratio of 0.1 mass % to 50 mass %, more preferably 0.5 mass % to 30 mass %, and particularly preferably 0.8 mass % to 20 mass % with respect to the total solid content constituting the image recording layer. In this range, favorable sensitivity and favorable stain resistance of a non-image portion during printing can be obtained.

<Polymerizable Compound>

The image recording layer used in the present invention preferably contains a polymerizable compound. The above-described polymerizable compound is preferably a radical polymerizable compound and can be selected from an addition-polymerizable compound having at least one ethylenically unsaturated group and a compound having at least one and preferably two or more terminal ethylenically unsaturated groups. These compounds have, for example, a chemical form of a monomer, a dimer, a trimer, and an oligomer, or a mixture thereof.

In addition, the above-described polymer particles are not contained in the polymerizable compound in the present invention.

Examples of the monomer include unsaturated carboxylic acids (for example, an acrylic acid, a methacrylic acid, an itaconic acid, a crotonic acid, an isocrotonic acid, and a maleic acid), esters thereof, and amides thereof. An ester between an unsaturated carboxylic acid and a polyhydric alcohol compound; amides between an unsaturated carboxylic acid and a polyvalent amine compound are preferably used. In addition, an addition-reaction product of an unsaturated carboxylic ester or amides having a nucleophilic substituent such as a hydroxy group, an amino group, or a mercapto group, with monofunctional or multifunctional isocyanates or epoxies; a dehydration condensation reaction product thereof with a monofunctional or multifunctional carboxylic acid, and the like are also suitably used. An addition-reaction product of an unsaturated carboxylic ester or amides having an electrophilic substituent such as an isocyanate group or an epoxy group, with monofunctional or multifunctional alcohols, amines, or thiols; or a substitution-reaction product of an unsaturated carboxylic ester or amides having a dissociative substituent such as a halogen group or a tosyloxy group, with monofunctional or multifunctional alcohols, amines or thiols are also suitable. In addition, as other examples, compound groups in which the above-described unsaturated carboxylic acid is replaced with an unsaturated phosphonic acid, styrene, vinyl ether, or the like can be used. These are disclosed in reference documents including JP2006-508380A, JP2002-287344A, JP2008-256850A, JP2001-342222A, JP1997-179296A (JP-H9-179296A), JP1997-179297A (JP-H9-179297A), JP1997-179298A (JP-H9-179298A), JP2004-294935A, JP2006-243493A, JP2002-275129A, JP2003-64130A, JP2003-280187A, and JP1998-333321A (JP-H10-333321A).

Specific examples of a monomer of the ester between a polyhydric alcohol compound and an unsaturated carboxylic acid include, as an acrylic acid ester, ethylene glycol diacrylate, 1,3-butanediol diacrylate, tetramethylene glycol diacrylate, propylene glycol diacrylate, trimethylol propane triacrylate, hexane diol diacrylate, tetraethylene glycol diacrylate, pentaerythritol tetraacrylate, sorbitol triacrylate, isocyanuric acid ethylene oxide (EO)-modified triacrylate, and a polyester acrylate oligomer. Examples of the methacrylic acid ester include tetramethylene glycol dimethacrylate, neopentyl glycol dimethacrylate, trimethylolpropane trimethacrylate, ethylene glycol dimethacrylate, pentaerythritol trimethacrylate, bis[p-(3-methacryloxy-2-hydroxypropoxy)phenyl]dimethylmethane, and bis-[p-(methacryloxyethoxy)phenyl]dimethylmethane. In addition, specific examples of a monomer of the amide between a polyvalent amine compound and an unsaturated carboxylic acid include methylene bis-acrylamide, methylene bis-methacrylamide, 1,6-hexamethylene bis-acrylamide, 1,6-hexamethylene bismethacrylamide, diethylene triamine trisacrylamide, xylylene bisacrylamide, and xylylene bismethacrylamide.

In addition, a urethane-based addition-polymerizable compound produced by an addition reaction between isocyanate and a hydroxyl group is also suitable. Specific examples thereof include a vinyl urethane compound containing two or more polymerizable vinyl groups in one molecule in which a vinyl monomer containing a hydroxyl group represented by the following Formula (A) is added to a polyisocyanate compound having two or more isocyanate groups in one molecule disclosed in JP1973-41708B (JP-548-41708B).

$$CH_2{=}C(R^4)COOCH_2CH(R^5)OH \quad (A)$$

(However, each of $R^4$ and $R^5$ independently represents H or $CH_3$.)

In addition, urethane acrylates disclosed in JP1976-37193A (JP-551-37193A), JP1990-32293B (JP-H2-32293B), JP1990-16765B (JP-H2-16765B), JP2003-344997A, and JP2006-65210A, urethane compounds having an ethylene oxide-based skeleton disclosed in JP1983-49860B (JP-S58-49860B), JP1981-17654B (JP-556-17654B), JP1987-39417B (JP-S62-39417B), JP1987-39418B (JP-S62-39418B), JP2000-250211A, and JP2007-94138A, and urethane compounds having hydrophilic groups disclosed in U.S. Pat. No. 7,153,632B, JP1996-505958A (JP-H8-505958A), JP2007-293221A, and JP2007-293223A are also suitable.

Among the above-described compounds, from the viewpoint of excellent balance between hydrophilicity involved in on-press developability and polymerization ability involved in printing durability, isocyanuric acid ethylene oxide-modified acrylates such as tris(acryloyloxyethyl)isocyanurate and bis(acryloyloxyethyl)hydroxyethyl isocyanurate are particularly preferable.

Details of usage methods such as structures of these polymerizable compounds, single use or combined use thereof, or addition amounts of these polymerizable compounds can be arbitrarily set according to the performance design of the final lithographic printing plate precursor. The above-described polymerizable compound is used within a preferable range of 5 mass % to 75 mass %, more preferable range of 25 mass % to 70 mass %, and particularly preferable range of 30 mass % to 60 mass % with respect to the total solid content of the image recording layer.

The weight average molecular weight (Mw) of the polymerizable compound in the present invention is preferably greater than or equal to 100 and less than 2,000 and more preferably 200 to 1,000.

<Other Components>

The image recording layer in the present invention may further contain other components as necessary.

[Anionic or Nonionic Surfactant]

The image recording layer used in the present invention, preferably contains at least one of an anionic surfactant or a nonionic surfactant.

As the anionic surfactant and the nonionic surfactant, the same compound as that of a surfactant which can be used in a hydrophilic coating liquid to be described below is preferably used.

Furthermore, the image recording layer used in the present invention may contain an anionic or nonionic surfactant based on fluorine or silicone.

As the above-described surfactant, the same type of a surfactant as that of the surfactant contained in the hydrophilic coating liquid is preferably used, and a compound having the same structure as that of the surfactant thereof is more preferably used. That is, in a case where an anionic surfactant is used in the hydrophilic coating liquid, it is preferable that the anionic surfactant is also contained in the image recording layer, and in a case where a nonionic surfactant is used in the hydrophilic coating liquid, it is preferable that the nonionic surfactant is also contained in the image recording layer.

Anionic surfactants having a high effect of promoting on-press development are particularly preferably used. However, two or more types of these surfactants can also be used in combination. For example, it is preferable to use two or more types of anionic surfactants which are different from each other in combination or to use an anionic surfactant and a nonionic surfactant in combination.

[Low Molecular Hydrophilic Compound]

It is preferable that the image recording layer in the present invention contains a low molecular hydrophilic compound in order to increase on-press developability without decreasing printing durability.

Examples of the low molecular hydrophilic compound include glycols such as ethylene glycol, diethylene glycol, triethylene glycol, propylene glycol, dipropylene glycol, and tripropylene glycol, ethers thereof, or ester derivatives thereof, polyols such as glycerol, pentaerythritol, and tris (2-hydroxyethyl)isocyanurate, organic amines such as triethanolamine, diethanolamine, and monoethanolamine, and salts thereof, organic sulfonic acids such as an alkylsulfonic acid, a toluenesulfonic acid, and a benzenesulfonic acid, and salts thereof, an organic sulfamic acid such as an alkyl sulfamic acid, and salts thereof, organic sulfuric acids such as alkyl sulfates and alkyl ether sulfate, and salts thereof, an organic phosphonic acid such as a phenylphosphonic acid, and salts thereof, an organic carboxylic acid such as a tartaric acid, an oxalic acid, a citric acid, a malic acid, a lactic acid, a gluconic acid, and an amino acid, and salts thereof, and betaines.

In the present invention, among these, the image recording layer preferably contains at least one selected from the group consisting of polyols, organic sulfates, organic sulfonates, or betaines.

Specific compounds of organic sulfonate include alkyl sulfonates such as sodium n-butyl sulfonate, sodium n-hexyl sulfonate, sodium 2-ethylhexyl sulfonate, sodium cyclohexyl sulfonate, and sodium n-octyl sulfonate; alkyl sulfonates containing an ethylene oxide chain such as sodium 5,8,11-trioxapentadecane-1-sulfonate, sodium 5,8,11-trioxaheptadecane-1-sulfonate, sodium 13-ethyl-5,8,11-trioxaheptadecane-1-sulfonate, and sodium 5,8,11,14-tetraoxatetracosane-1-sulfonate; aryl sulfonates such as sodium benzenesulfonate, a sodium p-toluenesulfonate, sodium p-hydroxybenzenesulfonate, sodium p-styrenesulfonate, sodium dimethyl isophthalate-5-sulfonate, sodium 1-naphthyl sulfonate, sodium 4-hydroxy-naphthyl sulfonate, disodium 1,5-naphthalene disulfonate, and trisodium 1,3,6-naphthalene trisulfonate; and compounds disclosed in paragraphs 0026 to 0031 of JP2007-276454A and paragraphs 0020 to 0047 of JP2009-154525A. These salts may be potassium salts or lithium salts.

Examples of the organic sulfates include alkyl, alkenyl, alkynyl, and aryl of polyethylene oxide or sulfates of heterocyclic monoether. The ethylene oxide unit is preferably 1 to 4, and the salts are preferably sodium salts, potassium salts, or lithium salts. Specific examples thereof include compounds disclosed in paragraphs 0034 to 0038 of JP2007-276454A, As betaines, a compound in which a hydrocarbon substituent to a nitrogen atom has 1 to 5 carbon atoms is preferable, and specific examples thereof include trimethylammonium acetate, dimethyl propyl ammonium acetate, 3-hydroxy-4-trimethylammonio butyrate, 4-(1-pyridinio) butyrate, 1-hydroxyethyl-1-imidazolio acetate, trimethylammonium methanesulfonate, dimethyl propyl ammonium methanesulfonate, 3-trimethyl ammonio-1-propane sulfonate, and 3-(1-pyridinio)-1-propane sulfonate.

The above-described low molecular hydrophilic compound has a small structure of a hydrophobic portion, and thus, there is almost no surfactant action. Therefore, dampening water does not permeate an exposed portion (image portion) of the image recording layer to decrease hydrophobicity of the image portion and coating strength, and ink receptivity of the image recording layer and printing durability can be favorably maintained.

The addition amount of these low molecular hydrophilic compounds to the image recording layer is preferably 0.5 mass % to 20 mass %, more preferably 1 mass % to 15 mass %, and still more preferably 2 mass % to 10 mass % of the total solid content amount of the image recording layer. In this range, favorable on-press developability and printing durability can be obtained.

These compounds may be used singly, or two or more types thereof may be used in combination.

[Sensitizing Agent]

In order to enhance depositing properties, sensitizing agents such as a phosphonium compound, a nitrogen-containing low molecular compound, and an ammonium group-containing polymer are preferably used in the image recording layer used in the present invention. Particularly, if an inorganic layer-shaped compound is contained in a protective layer, these compounds function as a surface coating agent of the inorganic layer-shaped compound, and prevent a decrease in depositing properties in the middle of printing due to the inorganic layer-shaped compound.

Examples of the phosphonium compound suitably include phosphonium compounds disclosed in JP2006-297907A and JP2007-50660A. Specific examples thereof include tetrabutylphosphonium iodide, butyl triphenyl phosphonium bromide, tetraphenyl phosphonium bromide, 1,4-bis(triphenylphosphonio)butane=di(hexafluorophosphate), 1,7-bis(triphenylphosphonio)heptane=sulfate, and 1,9-bis(triphenylphosphonio)nonane=naphthalene-2,7-disulfonate.

Examples of the above-described nitrogen-containing low molecular compound include amine salts and quaternary ammonium salts. In addition, examples thereof also include imidazolinium salts, benzo imidazolinium salts, pyridinium salts, and quinolinium salts. Among these, quaternary ammonium salts and pyridinim salts are preferable. Specific examples thereof include tetramethylammonium=hexafluorophosphate, tetrabutylammonium=hexafluorophosphate, dodecyltrimethylammonium=p-toluenesulfonate, benzyltriethylammonium=hexafluorophosphate, benzyl dimethyl octyl ammonium=hexafluorophosphate, benzyl dimethyl dodecyl ammonium=hexafluorophosphate, and compounds disclosed in paragraphs 0021 to 0037 of JP2008-284858A and paragraphs 0030 to 0057 of JP2009-90645A.

Any ammonium group-containing polymer may be used, as long as the above-described ammonium group-containing polymer has an ammonium group in a structure thereof, but a polymer containing 5 mol % to 80 mol % of (meth)acrylate having an ammonium group in a side chain as a copolymerization component is preferable. Specific examples thereof include polymers disclosed paragraphs 0089 to 0105 of JP2009-208458A.

The value of a reduced specific viscosity (unit: ml/g) of the above-described ammonium group-containing polymer which is obtained through the following measurement method is preferably within a range of 5 to 120, more preferably within a range of 10 to 110, and particularly preferably within a range of 15 to 100. When the above-described reduced specific viscosity is converted into the weight average molecular weight, 10,000 to 150,000 is preferable, 17,000 to 140,000 is more preferable, and 20,000 to 130,000 is particularly preferable.

[Method for Measuring Reduced Specific Viscosity]

3.33 g (1 gas a solid content) of a 30% polymer solution is weighed into a 20 ml volumetric flask and is diluted with N-methyl pyrrolidone. This solution is allowed to stand for 30 minutes in a thermostatic tube at 30° C. and is placed in a Ubbelohde reduction viscosity tube (viscometer constant=0.010 cSt/s), and the running down time is measured at 30° C. The measurement is performed on an identical sample twice, and an average value thereof is calculated. Measurement is also similarly performed in a case of a blank (only N-methyl pyrrolidone) to calculate the reduced specific viscosity (ml/g) from the following Formula.

$$\text{Reduced specific viscosity (ml/g)} = \frac{\dfrac{\text{Outflow time (seconds) of sample solution} - \text{outflow time (seconds) of blank}}{\text{Outflow time (seconds) of blank}}}{\dfrac{3.33\ (\text{g}) \times \dfrac{30}{100}}{20\ (\text{ml})}}$$

Specific examples of the ammonium group-containing polymer will be shown below.

(1) 2-(trimethylammonio)ethyl methacrylate=p-toluenesulfonate/3,6-dioxaheptyl methacrylate copolymer (molar ratio of 10/90 and weight average molecular weight of 45,000)

(2) 2-(trimethylammonio)ethyl methacrylate= hexafluorophosphate/3,6-dioxaheptyl methacrylate copolymer (molar ratio of 20/80 and weight average molecular weight of 60,000)

(3) 2-(ethyldimethylammonio)ethyl methacrylate=p-toluenesulfonate/hexyl methacrylate copolymer (molar ratio of 30/70 and weight average molecular weight of 45,000)

(4) 2-(trimethylammonio)ethyl methacrylate= hexafluorophosphate/2-ethylhexyl methacrylate copolymer (molar ratio of 20/80 and weight average molecular weight of 60,000)

(5) 2-(trimethylammonio)ethyl methacrylate=methyl sulfate/hexyl methacrylate copolymer (molar ratio of 40/60 and weight average molecular weight of 70,000)

(6) 2-(buthyldimethylammonio)ethyl methacrylate= hexafluorophosphate/3,6-dioxaheptyl methacrylate copolymer (molar ratio of 25/75 and weight average molecular weight of 65,000)

(7) 2-(buthyldimethylammonio)ethyl acrylate= hexafluorophosphate/3,6-dioxaheptyl methacrylate copolymer (molar ratio of 20/80 and weight average molecular weight of 65,000)

(8) 2-(buthyldimethylammonio)ethyl methacrylate=13-ethyl-5,8,11-trioxa-1-heptadecane sulfonate/3,6-dioxaheptyl methacrylate copolymer (molar ratio of 20/80 and weight average molecular weight of 75,000)

(9) 2-(buthyldimethylammonio)ethyl methacrylate= hexafluorophosphate/3,6-dioxaheptyl methacrylate/2-hydroxy-3-methacryloyloxy propyl methacrylate copolymer (molar ratio of 15/80/5 and weight average molecular weight of 65,000)

The content of the above-described sensitizing agent is preferably 0.01 mass % to 30.0 mass %, more preferably 0.1 mass % to 15.0 mass %, and still more preferably 1 mass % to 10 mass % with respect to the total solid content of the image recording layer.

[Other Components]

As other components, a surfactant, a colorant, a printing agent, a polymerization inhibitor, a higher fatty acid derivative, a plasticizer, inorganic fine particles, an inorganic layer-shaped compound, a co-sensitizer, a chain transfer agent, or the like can be further added to the image recording layer used in the present invention. Specifically, compounds and addition amounts disclosed in paragraphs 0114 to 0159 of JP2008-284817A, paragraphs 0023 to 0027 of JP2006-091479A, and paragraph 0060 of US2008/0311520A are preferable.

In addition, the image recording layer in the present invention preferably contains organic fine particles. Examples of the organic fine particles include fine particle bodies of a binder polymer in the present invention. The volume average particle diameters of these organic fine particle bodies are preferably 0.1 μm to 100 μm.

<Preferred Aspect of Image Recording Layer>

In addition, there are three aspects of the following (1) to (3) as preferred aspects of the image recording layer used in the present invention.

(1) An aspect of containing infrared absorber, polymerization initiator, polymerizable compound, binder polymer, and microgel.

(2) An aspect of containing infrared absorber, polymerization initiator, polymerizable compound, binder polymer, and thermoplastic fine particle polymer.

(3) An aspect of containing infrared absorber, thermoplastic fine particle polymer, and binder polymer.

In the above-described (1), it is preferable to use a cyanine coloring matter as the infrared absorber.

In addition, as the polymerization initiator, a radical polymerization initiator is preferably used, a borate compound and/or an onium salt compound are more preferably used, a borate compound and/or an iodonium salt compound are still more preferably used, and a borate compound and an iodonium salt compound are particularly preferably used.

As the polymerizable compound, a radical polymerizable compound is preferably used and a urethane-based addition-polymerizable compound is more preferably used.

As the binder polymer, a star-shaped polymer compound is preferably used.

As the microgel, polyurethane having cross-linking reactivity is preferably used.

In addition, in a case of using the image recording layer of the aspect of the above-described (1) as a printing plate precursor, three-layered structure which includes an undercoat layer, an image recording layer, and a protective layer and is obtained by forming the undercoat layer and the protective layer, to be described below, on a support is preferable.

In the aspect of the above-described (2), it is preferable to use a cyanine coloring matter as the infrared absorber.

In addition, as the polymerization initiator, a radical polymerization initiator is preferably used, a borate compound and/or an onium salt compound are more preferably used, a borate compound and/or an iodonium salt compound are still more preferably used, and a borate compound and an iodonium salt compound are particularly preferably used.

As the polymerizable compound, a radical polymerizable compound is preferably used and a monomer of an ester between a polyhydric alcohol and an unsaturated carboxylic acid is more preferably used.

As the binder polymer, it is preferable to use a lipophilic binder polymer and a hydrophilic binder polymer in combination.

In addition, as the thermoplastic fine particle polymer, it is preferable to use a copolymer containing styrene and acrylonitrile.

In the aspect of the above-described (3), it is preferable to use a cyanine coloring matter as the infrared absorber.

In addition, as the thermoplastic fine particle polymer, it is preferable to use a copolymer containing styrene and acrylonitrile.

As the binder polymer, it is preferable to use a hydrophilic polymer.

<Coating Step>

The manufacturing method for a lithographic printing plate precursor of the present invention includes (b) a coating step of coating a partial region of the image recording layer, which is formed in the a step, with a hydrophilic coating liquid containing a hydrophilic agent.

Hereinafter, the region which is coated with the hydrophilic coating liquid is also called a "coated region".

The partial region on the above-described support is a partial region on an image recording layer on the support, and means that the entire surface of the support is not coated. It is possible to prevent a decrease in adhesiveness and printing durability of the image recording layer by coating a partial region without coating the entire surface of the support with a hydrophilic coating liquid as described above. In addition, it is possible to prevent any damage to an image portion by usually coating a part of the support within 1 cm from an end portion which is not the image portion.

The hydrophilic coating liquid (hereinafter, also simply referred to as a "coating liquid") used in the present invention is prepared after dissolving a hydrophilic agent and other components, which will be described below, in water.

As the coating method of the hydrophilic coating liquid, it is possible to use well-known methods such as a die coating method, a dip coating method, an air knife coating method, a curtain coating method, a roller coating method, a wire bar coating method, a gravure coating method, a slide coating method, an inkjet method, a dispenser method, and a spray method. An inkjet method or a dispenser method is preferable in view of necessity of coating a part on a support with a coating liquid.

The coating amount of the hydrophilic coating liquid used in the present invention is preferably 0.1 $g/m^2$ to 2.0 $g/m^2$ and more preferably 0.2 $g/m^2$ to 1.0 $g/m^2$. If the coating amount is within this range, it is possible to obtain a lithographic printing plate precursor having favorable performance of preventing edge stains.

In addition, it is preferable that coated regions are on two sides, which face each other, of the lithographic printing plate precursor after being cut.

The support may be coated with the hydrophilic coating liquid from end portions thereof, or may be coated with the hydrophilic coating liquid at a position other than the end portions thereof, or these coating positions may be combined.

In addition, in either case of coating the support from the end portions thereof or coating the support at a position other than the end portions thereof, it is preferable to coating the support in a strip shape having a certain width.

A preferred coating width is 1 mm to 50 mm. It is preferable that the tops of the coated regions with a coating width are cut and the coated regions are existed within 1 cm from the end portions after the cutting. The cutting may be performed on one site on the regions coated with the hydrophilic coating liquid, or may be performed on two sites on an identical region coated with the hydrophilic coating liquid.

Each of FIGS. 1 to 8 is an example of a lithographic printing plate precursor before being cut which has been coated with a hydrophilic coating liquid. A hatched portion 4 and a wavy line portion respectively show a region coated with a hydrophilic coating liquid and a cutting position.

FIG. 1 shows an aspect in which a support is coated from end portions.

Figure 5:
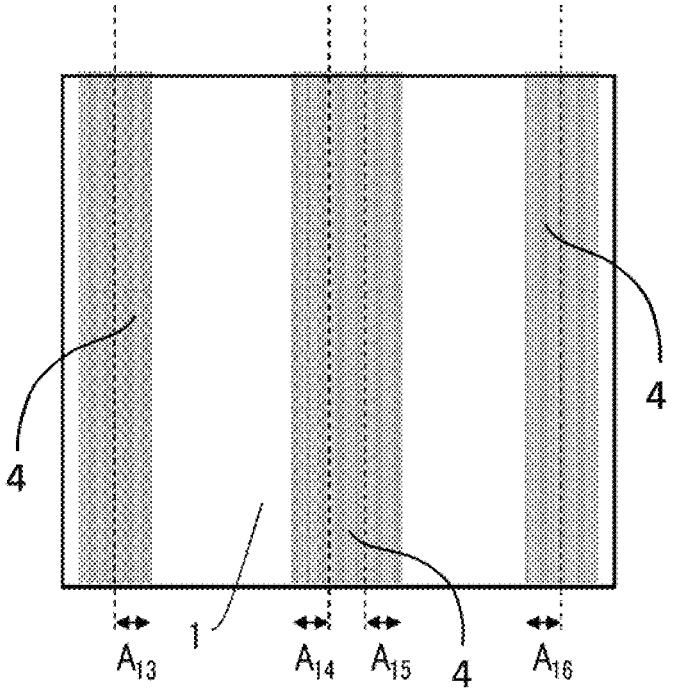
FIG. 5 is a conceptual view showing still another example of the lithographic printing plate precursor before being cut which is coated with the hydrophilic coating liquid at positions other than the end portions.

FIGS. 2 to 5 show aspects in which the support is coated at a position away from the end portions thereof. In addition, FIG. 5 is an aspect in which the cutting is performed at two sites on an identical region coated with the hydrophilic coating liquid.

Figure 6:
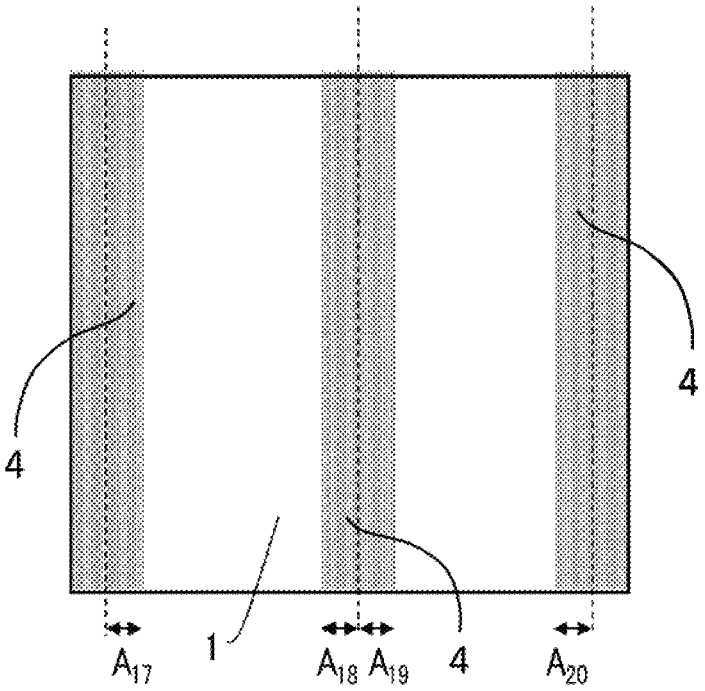
FIG. 6 is a conceptual view showing an example of the lithographic printing plate precursor before being cut which is coated with the hydrophilic coating liquid at positions of end portions and at a position other than the end portions.
Figure 7:
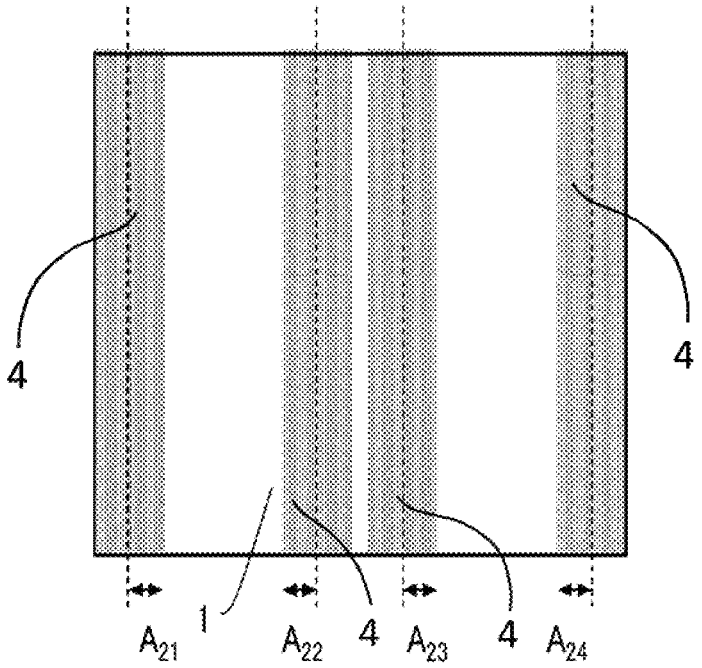
FIG. 7 is a conceptual view showing another example of the lithographic printing plate precursor before being cut which is coated with the hydrophilic coating liquid at positions of end portions and at positions other than the end portions.
Figure 8:
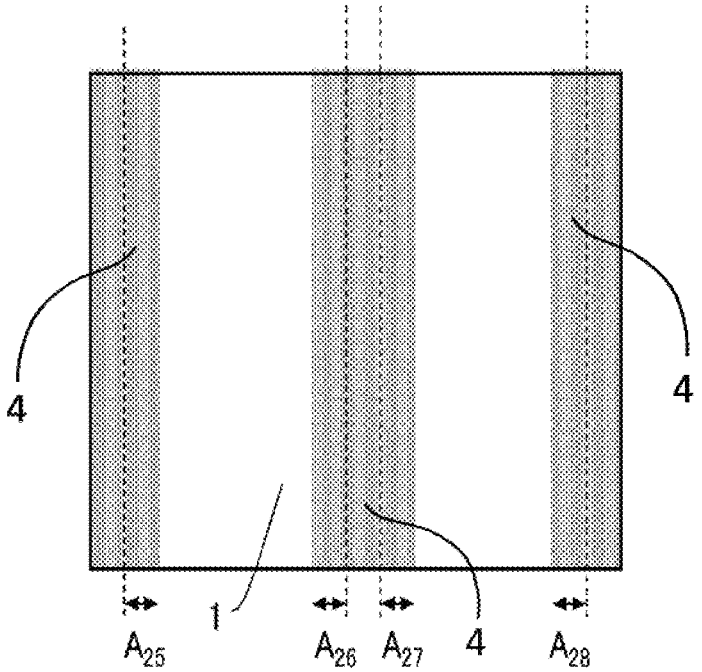
FIG. 8 is a conceptual view showing still another example of the lithographic printing plate precursor before being cut which is coated with the hydrophilic coating liquid at positions of end portions and at a position other than the end portions.

FIGS. 6 to 8 show aspects in which the support is coated with the hydrophilic coating liquid and an aspect of coating the support from the end portions and an aspect of coating the support at a position in the vicinity of the center. FIG. 8 shows an aspect in which the cutting is performed at two sites on an identical region coated with the hydrophilic coating liquid and in which the cutting is performed in a wavy portion after coating a hatched portion (coated region) with the hydrophilic coating liquid in a belt shape while transporting the support in an arrow direction. The cutting position is set at a position at which all of widths $A_1$ to $A_{28}$ of the regions coated with the hydrophilic coating liquid in the end portions after being cut are within 1 cm. Using the above-described aspect, it is possible to obtain a lithographic printing plate precursor which has an image recording layer on a quadrilateral-shaped hydrophilic aluminum support and in which a hydrophilic agent is distributed on the surface of the support on the image recording layer side in each region within 1 cm from end portions of two sides, which face each other, of the above-described support, and the hydrophilic agent is not attached to the rear surface of the support.

[Coating Liquid Containing Hydrophilic Agent]

The coating liquid (as described above, also referred to as a "hydrophilic coating liquid") containing a hydrophilic agent which is used in the present invention contains a hydrophilic agent as an essential component. As preferred arbitrary components, there is a plasticizer, an organic solvent for swelling the image recording layer, and the like. As other arbitrary components, there is a preservative, an anti-foaming agent, and the like.

These hydrophilic coating liquids may be aqueous solutions and may be liquids which are obtained by emulsifying an oil phase component and a water phase component, but are preferably aqueous solutions.

In addition, the hydrophilic coating liquid used in the present invention preferably contains a phosphoric acid compound and/or a phosphonic acid compound as a hydrophilic agent and more preferably contains a phosphoric acid compound and/or a phosphonic acid compound and a surfactant as a hydrophilic agent.

Furthermore, in the above-described two aspects, the hydrophilic coating liquid preferably contains at least a phosphoric acid compound.

In addition, the viscosity of the hydrophilic coating liquid is preferably 0.5 mPa·s to 1,000 mPa·s and more preferably 1 mPa·s to 100 mPa·s. If the viscosity is within the above-described range, bead rupture hardly occurs, and therefore, the coating is favorably performed at the beginning of the coating.

The surface tension of the hydrophilic coating liquid is preferably 25 mN/m to 70 mN/m and more preferably 40 mN/m to 65 mN/m. If the surface tension is within the above-described range, it is easy to control the coating liquid, and therefore, head rupture hardly occurs.

<Hydrophilic Agent>

—Surfactant—

As a hydrophilic agent of the hydrophilic coating liquid used in the present invention, it is preferable to use a surfactant. Examples of the surfactant which can be used in the present invention include an anionic surfactant, a nonionic surfactant, a cationic surfactant, and an amphoteric surfactant. As the surfactant which can be used in the present invention, at least one surfactant selected from the group consisting of an anionic surfactant, a nonionic surfactant, or an amphoteric surfactant is preferable, and an anionic surfactant and/or a nonionic surfactant are more preferable. According to the above-described aspect, it is possible to obtain a hydrophilic coating liquid excellent in coating properties.

An anionic or nonionic surfactant based on fluorine, silicone, or the like (typically, anionic or nonionic surfactant based on fluorine or silicone) is not preferable as the anionic or nonionic surfactant in the present invention. If these surfactants are used, the coating properties of the hydrophilic coating liquid are deteriorated, which is not preferable.

Examples of the anionic surfactant include fatty acid salts, abietic acid salts, hydroxyalkane sulfonic acid salts, alkanesulfonic acid salts, dialkyl sulfosuccinate salts, linear alkyl benzene sulfonic acid salts, branched alkyl benzene sulfonic acid salts, alkyl naphthalene sulfonic acid salts, alkyl phenoxy polyoxyethylene propyl sulfonic acid salts, polyoxyethylene aryl ether sulfuric acid ester salts, polyoxyethylene alkyl sulfophenyl ether salts, N-methyl-N-oleyl taurine sodiums, N-alkyl sulfosuccinic acid monoamide disodium salts, petroleum sulfonic acid salts, sulfated castor oil, sulfated beef tallow oil, sulfate ester salts of a fatty acid alkyl ester, alkyl sulfate ester salts, polyoxyethylene alkyl ether sulfuric ester salts, fatty acid monoglyceride sulfuric acid ester salts, polyoxyethylene alkylphenyl ether sulfuric acid ester salts, polyoxyethylene styryl phenyl ether sulfuric acid ester salts, alkyl phosphoric acid ester salts, polyoxyethylene alkyl ether phosphoric acid ester salts, polyoxyethylene alkyl phenyl ether phosphoric acid ester salts, partially saponified products of a styrene-maleic anhydride copolymer, partially saponified products of an olefin-maleic anhydride copolymer, and naphthalene sulfonate formalin condensates. Among these, dialkyl sulfosuccinate salts, alkyl sulfuric acid salts, polyoxyethylene aryl ether sulfuric acid ester salts, and alkylnaphthalene sulfonic acid salts are particularly preferably used.

Specific examples thereof include at least one type of anionic surfactant selected from the group consisting of anionic surfactants represented by Formula (I-A) or Formula (I-B).

$$(R_1)_p—Ar_1—(SO_3^{\ominus})_q \quad M_1^{\oplus} \tag{I-A}$$

$$(R_2)_m—Ar_2—Y—O(R_3O)_n—SO_3^{\ominus} \quad M_2^{\oplus} \tag{I-B}$$

In the above-described Formula (1-A), $R_1$ represents a liner or branched alkyl group having 1 to 20 carbon atoms; p represents 0, 1, or 2; $Ar_1$ represents an aryl group having 6 to 10 carbon atoms; q represents 1, 2, or 3; and $M_1^+$ represents $Na^+$, $K^+$, $Li^+$, or $NH_4^+$. In a case where p is 2, $R_1$s existing in plural numbers may be the same as or different from each other.

In the above-described Formula (I-B), $R_2$ represents a linear or branched alkyl group having 1 to 20 carbon atoms; m represents 0, 1, or 2; $Ar_2$ represents an aryl group having 6 to 10 carbon atoms; Y represents a single bond or an alkylene group having 1 to 10 carbon atoms; $R^3$ represents a linear or branched alkylene group having 1 to 5 carbon atoms; n represents an integer of 1 to 100; and $M_2^+$ represents $Na^+$, $K^+$, $Li^+$, or $NH_4^+$. In a case where m is 2, $R_2$s existing in plural numbers may be the same as or different from each other; and in a case where n is greater than or equal to 2, $R_a$s existing in plural numbers may be the same as or different from each other.

In preferred embodiments of the present invention, preferred examples of $R_1$ and $R_2$ in the above-described Formula (I-A) and Formula (I-B) include $CH_3$, $C_2H_5$, $C_3H_7$, or $C_4H_9$. In addition, preferred examples of $R_3$ include —$CH_2$—, —$CH_2CH_2$—, or —$CH_2CH_2CH_2$—, and —$CH_2CH(CH_3)$—, and more preferred examples thereof include —$CH_2CH_2$—. In addition, p and m are preferably 0 or 1 and p is particularly preferably 0. Y is preferably a single bond. In addition, n is preferably an integer of 1 to 20.

Specific examples of compounds represented by Formula (I-A) or Formula (I-B) include the following compounds.

(1)

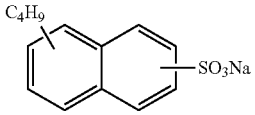

(2)

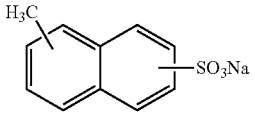

(3)

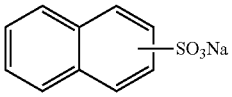

(4)

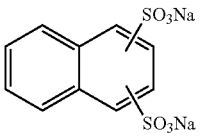

(5)

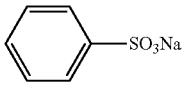

(6)

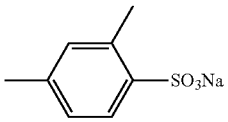

(7)

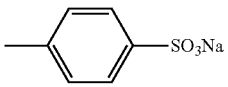

(8)

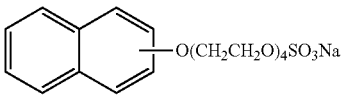

-continued (9)

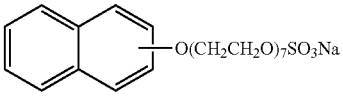

(10)

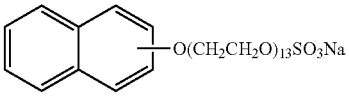

(11)

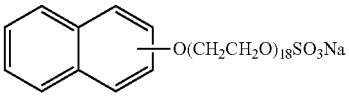

(12)

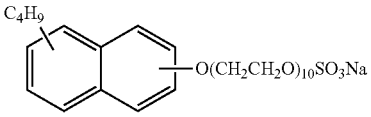

(13)

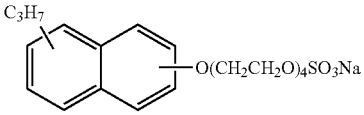

(14)

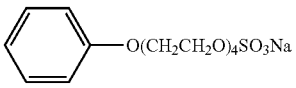

(15)

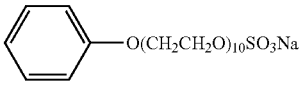

(16)

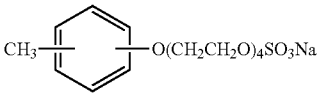

(17)

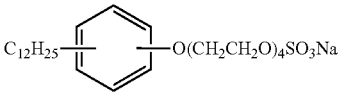

It is preferable that the anionic surfactant of the present invention is a polymer compound (anionic polymer surfactant). According to the above-described aspect, it is possible to obtain an excellent hydrophilic coating liquid in a surface shape after a support is coated with the hydrophilic coating liquid. There is no particular limitation as long as the above-described polymer compound contains at least one anionic group as a hydrophilic group.

Examples of the anionic group include a sulfonic acid group, a sulfate group, and a carboxy group. Among these, a sulfonic acid group is preferable.

These anionic groups may constitute a salt. The above-described salt may be a salt with an inorganic cation or a salt with an organic cation.

Examples of the inorganic cation include a lithium cation, a sodium cation, a potassium cation, a calcium cation, and a magnesium cation. A lithium cation, a sodium cation, and a potassium cation are preferable and a sodium cation and a potassium cation are more preferable.

Examples of the organic cation include ammonium ($NH_4^+$), quaternary ammonium, quaternary pyridinium, and quaternary phosphonium. Ammonium, quaternary ammonium, and quaternary pyridinium are preferable and quaternary ammonium is more preferable.

Examples of the above-described polymer compound include a polymer of a monomer having an anionic group in a molecule, a copolymer of the polymer of a monomer having an anionic group in a molecule and one or more types of other monomers, and a polymer which is obtained by introducing a hydrophilic group into a polymer having no anionic group, later.

Examples of the monomer having an anionic group in a molecule include styrene derivatives having a sulfonic acid group, such as an acrylic acid, a methacrylic acid, a maleic acid, an itaconic acid, a styrene sulfonic acid, a sodium styrene sulfonate, and an α-methyl styrene sulfonic acid; acrylamide derivatives having a sulfonic acid group such as maleic anhydride, a vinyl sulfonic acid, sodium allyl sulfonate, sodium methallyl sulfonate, sodium isoprene sulfonate, olefin sulfonic acids such as 3-vinyloxypropane sulfonic acid, 2-acrylamido-2-methylpropanesulfonic acid, sodium 2-acrylamido-2-methylpropane sulfonate; (meth) acrylate derivatives such as sodium 2-sulfoethyl methacrylate; a diene sulfonic acid such as butadiene sulfonic acid; and a naphthalene sulfonic acid. In the above-described monomer, styrene derivatives having a sulfonic acid group or acrylamide derivatives having a sulfonic acid group are preferable and sodium 4-styrene sulfonate or sodium 2-acrylamido-2-methylpropane sulfonate are more preferable, from the viewpoint of the performance of preventing edge stains.

A copolymer of the above-described monomer having an anionic group and a monomer having a phosphoric acid ester group in a molecule to be described below does not correspond to an anionic surfactant, but to a phosphoric acid compound. A copolymer of the above-described monomer having an anionic group and a monomer having a phosphonic acid ester group in a molecule to be described below does not correspond to the anionic surfactant, but to a phosphonic acid compound.

Examples of the above-described polymer compound include partially saponified products of a styrene-maleic anhydride copolymer, a formalin condensate of a sulfonated aromatic compound containing a polynuclear aromatic compound (particularly, sodium naphthalene sulfonate formalin condensates), partially saponified products of an ethylene-maleic anhydride copolymer, a sodium salt of a polyacrylic acid, a sodium salt of a polystyrene sulfonic acid, and a sodium salt of a poly 2-acrylamido-2-methylpropanesulfonic acid.

The weight average molecular weight of the above-described polymer compound is preferably 2,000 to 1,000,000, more preferably 3,000 to 700,000, and particularly preferably 5,000 to 500,000.

In addition, examples of the nonionic surfactant include polyoxyethylene alkyl ethers, polyoxyethylene aryl ethers, glycerin fatty acid partial esters, sorbitan fatty acid partial esters, pentaerythritol fatty acid partial esters, propylene glycol mono fatty acid esters, sucrose fatty acid partial esters, polyoxyethylene sorbitan fatty acid partial esters, polyoxyethylene sorbitol fatty acid partial esters, polyethylene glycol fatty acid esters, polyglycerol fatty acid partial esters, polyoxyethylene glycerin fatty acid partial esters, fatty acid diethanolamides, N,N-bis-2-hydroxyalkylamines, polyoxyethylene alkylamines, triethanolamine fatty acid esters, and trialkylamine oxides, and polyoxyethylene-polyoxypropylene block copolymers. Among these, polyoxyethylene aryl ethers, polyoxyethylene-polyoxypropylene block copolymers, and the like are preferably used.

Examples of other surfactants used in the hydrophilic coating liquid according to the present invention include nonionic surfactants such as polyoxyethylene alkyl ethers such as a polyoxyethylene naphthyl ether, a polyoxyethylene alkyl phenyl ether, a polyoxyethylene lauryl ether, a polyoxyethylene cetyl ether, and a polyoxyethylene stearyl ether; polyoxyethylene alkyl esters such as polyoxyethylene stearate; sorbitan alkyl esters such as sorbitan monolaurate, sorbitan monostearate, sorbitan distearate, sorbitan monooleate, sorbitan sesquioleate, sorbitan trioleate; monoglyceride alkyl esters such as glycerol monostearate and glycerol monooleate.

In addition, the nonionic surfactants used in the present invention are preferably polymer compounds. The weight average molecular weight of the above-described polymer compound is preferably 2,000 to 1,000,000, more preferably 3,000 to 700,000, and particularly preferably 5,000 to 500,000.

Preferred examples of the nonionic surfactants include a surfactant represented by the following Formula (II-A) and a surfactant represented by the following Formula (II-B).

(II-A)

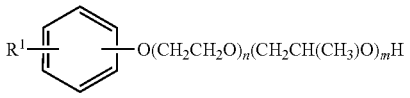

(II-B)

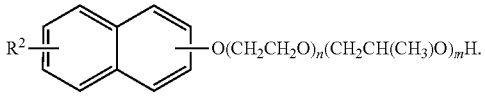

(In the above-described Formula (II-A), R' represents a hydrogen atom or an alkyl group having 1 to 100 carbon atoms, and n and m each represent an integer of 0 to 100, but there is no case where both n and m are 0.

In the above-described Formula (II-B), $R^2$ represents a hydrogen atom or an alkyl group having 1 to 100 carbon atoms, and n and m each represent an integer of 0 to 100, but there is no case where both n and m are 0.)

Examples of the compound represented by Formula (II-A) include polyoxyethylene phenyl ether, polyoxyethylene methyl phenyl ether, polyoxyethylene octyl phenyl ether, and polyoxyethylene nonyl phenyl ether. Examples of the compound represented by Formula (II-B) include polyoxyethylene naphthyl ether, polyoxyethylene methyl naphthyl ether, polyoxyethylene octyl naphthyl ether, and polyoxyethylene nonyl naphthyl ether.

In the compound represented by the above-described Formula (II-A) and Formula (II-B), the number (n) of repeating units of polyoxyethylene chains is preferably 3 to 50 and more preferably 5 to 30. The number (m) of repeating units of polyoxypropylene chains is preferably 0 to 10 and more preferably 0 to 5. The polyoxyethylene moiety and the polyoxypropylene moiety may be a copolymer at random or in blocks.

The nonionic aromatic ether-based surfactant represented by the above-described Formula (II-A) and Formula (II-B) is singly used or two or more types thereof are used in combination.

A specific example of the compound represented by the following Formula (II-A) and Formula (II-B) will be shown. The oxyethylene repeating unit and the oxypropylene repeating unit in the following exemplified compound "Y-5" can take any aspects of the random bond and the block link.

Y-1

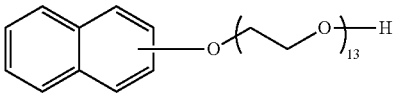

Y-2

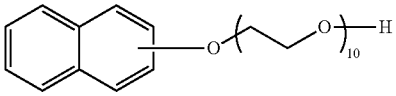

Y-3

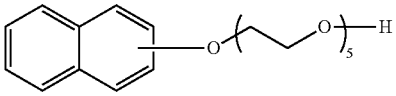

Y-4

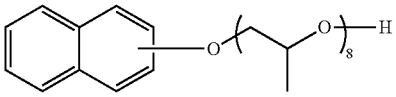

Y-5

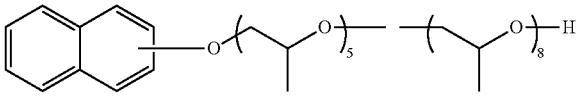

Y-6

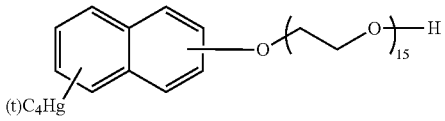

Y-7

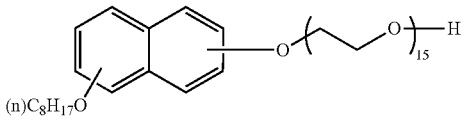

Y-8

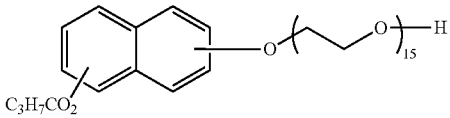

Y-9

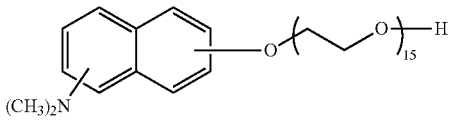

Y-10

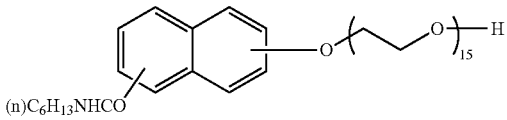

Y-11

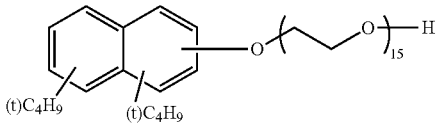

Y-12

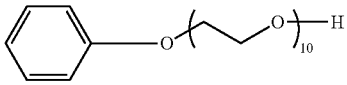

Y-13

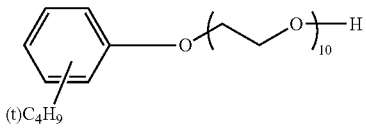

-continued

Y-14

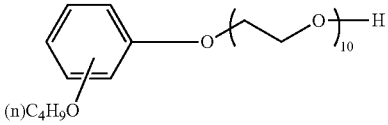

Y-15

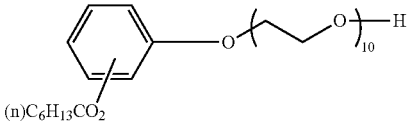

Y-16

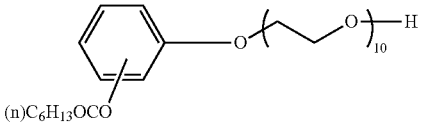

The hydrophilic coating liquid according to the present invention preferably contains an amphoteric surfactant.

Examples of the amphoteric surfactant used in the present invention include carboxy betaines, amino carboxylic acids, sulfobetaines, amino sulfuric acid esters, and imidazolines.

In addition, the above-described amphoteric surfactant is preferably a polymer compound (amphoteric surfactant polymer). As the amphoteric surfactant, a sulfobetaine-based polymer compound, a carboxybetaine-based polymer compound, and a phosphobetaine polymer compound are preferable, and examples thereof include compounds disclosed in JP2013-57747A and JP2012-194535A.

In the above-described surfactants, an anionic surfactant having a high effect of promoting on-press development is particularly preferably used, but it is also possible to use two or more types of these surfactants in combination. For example, combined use of two or more types of anionic surfactants different from each other or combined use of an anionic surfactant and a nonionic surfactant is preferable.

Sodium naphthalene sulfonate, sodium alkyl naphthalene sulfonate, or a polyoxyethylene aryl ether is preferably used, and sodium naphthalene sulfonic acid or sodium t-butyl naphthalene sulfonate is more preferably used.

It is unnecessary that the amount of the above-described surfactant used is particularly limited, but is preferably 0.01 mass % to 20 mass %, more preferably 0.5 mass % to 15 mass %, and still more preferably 1.0 mass % to 10 mass % with respect to the total mass of a hydrophilic coating liquid. In a case where the amount of a surfactant used is within the above-described range, the on-press developability is promoted.

It is possible to use other cationic surfactants well known in the related art in combination. Examples of the cationic surfactants include alkylamine salts, quaternary ammonium salts, polyoxyalkylamine salts, and polyethylene polyamine derivatives.

—Phosphoric Acid Compound—

As a hydrophilic agent of the hydrophilic coating liquid used in the present invention, a phosphoric acid compound is preferably used. Examples of the phosphoric acid compound include a phosphoric acid, a metaphosphoric acid, ammonium primary phosphate, ammonium secondary phosphate, sodium dihydrogen phosphate, sodium monohydrogen phosphate, potassium primary phosphate, potassium secondary phosphate, sodium tripolyphosphate, potassium pyrophosphate, and sodium hexametaphosphate. Among these, sodium dihydrogen phosphate, sodium monohydrogen phosphate, and sodium hexametaphosphate can be suitably used.

The content of the phosphoric acid compound in the hydrophilic coating liquid used in the present invention is preferably 0.5 mass % to 3.0 mass % and more preferably 0.5 mass % to 2.5 mass % based on the total mass of the hydrophilic coating liquid. If the content of the phosphoric acid compound is within this range, it is possible to obtain a hydrophilic coating liquid excellent in controlling crystal precipitation after the coating.

A phosphoric acid monoester and a phosphoric acid diester compound can be used as the phosphoric acid compound.

As the phosphoric acid compound used in the present invention, a polymer compound is preferably used and a polymer compound having a phosphoric acid monoester group is more preferable. According to the above-described aspect, it is possible to obtain a hydrophilic coating liquid excellent in coating properties with respect to a support.

Examples of the above-described polymer compound include a polymer consisting of one or more types of monomers having a phosphoric acid ester group in a molecule, a copolymer of one or more types of monomers containing a phosphoric acid ester group and one or more types of monomers containing no phosphoric acid ester group, or a polymer which is obtained by introducing a phosphoric acid ester group into a polymer having no phosphoric acid ester group, later.

Examples of the monomer having a phosphoric acid ester group include mono(2-methacryloyloxyethyl)acid phosphate, mono(2-methacryloyloxy polyoxyethylene glycol) acid phosphate, mono(2-acryloyloxyethyl)acid phosphate, 3-chloro-2-acid phosphoxypropyl methacrylate, acid phosphoxy polyoxyethylene glycol monomethacrylate, acid phosphoxy polyoxypropylene glycol methacrylate, (meth) acryloyloxyethyl acid phosphate, (meth)acryloyloxypropyl acid phosphate, (meth)acryloyloxy-2-hydroxypropyl acid phosphate, (meth)acryloyloxy-3-hydroxypropyl acid phosphate, (meth)acryloyloxy-3-chloro-2-hydroxypropyl acid phosphate, and allyl alcohol acid phosphate. Among the above-described monomers, from the viewpoint of the performance of preventing edge stains, mono(2-acryloyloxyethyl)acid phosphate is preferably used. Examples of representative products include LIGHTESTER P-1M (manufactured by KYOEISHA CHEMICAL Co., Ltd) and PHOSMER PE (manufactured by Uni-Chemical Co., Ltd.).

As the above-described polymer compound, either of a homopolymer and a copolymer of a monomer having a phosphoric acid ester group is used. Examples of the copolymer include a copolymer of the monomer having a phosphoric acid ester group and the above-described monomer having an anionic group, or a copolymer of the monomer having a phosphoric acid ester group and a monomer having neither a phosphoric acid ester group nor an anionic group.

A preferred aspect of the above-described polymer compound is a copolymer or a homopolymer of which the proportion of a monomer unit having a phosphoric acid ester group in a molecule is preferably 1 mol % to 100 mol %, more preferably 5 mol % to 100 mol %, and still more preferably 10 mol % to 100 mol %.

As the monomer containing neither the phosphoric acid ester group nor the anionic group, a monomer having a hydrophilic group is preferable. Examples of the hydrophilic group include a hydroxy group, an alkylene oxide structure, an amino group, an ammonium group, and an amido group. Among these, a hydroxy group, an alkylene oxide structure, and an amido group are preferable, an alkylene oxide structure having 1 to 20 alkylene oxide units having 2 or 3 carbon atoms is more preferable, and a polyethylene oxide structure having 2 to 10 alkylene oxide units is still more preferable. Examples thereof include 2-hydroxyethyl acrylate, ethoxy diethylene glycol acrylate, methoxy triethylene glycol acrylate, poly(oxyethylene)methacrylate, N-isopropylacrylamide, and acrylamide.

In addition, as the phosphoric acid compound, a copolymer of the above-described monomer having a phosphoric acid ester group in a molecule and the above-described monomer having an anionic group is preferably used. According to the above-described aspect, it is possible to obtain a hydrophilic coating liquid having high coating properties and a high performance of preventing edge stains.

In the copolymer of the above-described monomer having a phosphoric acid ester group in a molecule and the above-described monomer having an anionic group, the proportion of the monomer unit having the phosphoric acid ester group in a molecule is preferably 2 mol % to 99 mol %, more preferably 2 mol % to 80 mol %, still more preferably 5 mol % to 70 mol %, and particularly preferably 5 mol % to 50 mol % with respect to the total monomer units.

The weight average molecular weight of the above-described polymer compound is preferably 5,000 to 1,000,000, more preferably 7,000 to 700,000, and particularly preferably 10,000 to 500,000.

—Phosphonic Acid Compound—

As a hydrophilic agent of the hydrophilic coating liquid used in the present invention, a phosphonic acid compound is preferably used. Examples of the phosphoric acid compound include an ethylphosphonic acid, a propylphosphonic acid, an i-propylphosphonic acid, a butylphosphonic acid, a hexylphosphonic acid, an octylphosphonic acid, a dodecylphosphonic acid, an octadecylphosphonic acid, a 2-hydroxyethylphosphonic acid, and sodium salts or potassium salts thereof; alkylphosphonic acid monoalkyl esters such as methyl methylphosphonic acid, methyl ethylphosphonic acid, and methyl 2-hydroxyethyl phosphonic acid, and sodium salts or potassium salts thereof; alkylene diphosphonic acids such as a methylene diphosphonic acid, an ethylene diphosphonic acid, and sodium salts or potassium salts thereof; and a polyvinyl phosphonic acid.

Among these, a polyvinyl phosphonic acid is preferably used.

The content of the phosphoric acid compound in the hydrophilic coating liquid used in the present invention is preferably 0.5 mass % to 3.0 mass % and more preferably 0.5 mass % to 2.5 mass %, based on the total mass of the hydrophilic coating liquid. If the content of the phosphoric acid compound is within this range, it is possible to obtain a hydrophilic coating liquid excellent in controlling crystal precipitation after the coating.

As the phosphonic acid compound used in the present invention, a polymer compound is preferable. Using the above-described aspect, it is possible to obtain a hydrophilic coating liquid excellent in coating properties with respect to a support.

Examples of preferred polymer compounds as phosphonic acid compounds include a polymer consisting of one or more types of monomers having a phosphonic acid group or a phosphonic acid monoester group in a molecule or a copolymer of one or more types of monomers having a phosphonic acid group or a phosphonic acid monoester group and one or more types of monomers having neither a phosphonic acid group nor a phosphonic acid, in addition to the polyvinyl phosphonic acid.

Examples of the monomer having a phosphonic acid group include a vinylphosphonic acid, an ethyl phosphonic acid monovinyl ester, an acryloyl aminomethyl phosphonic acid, and a 3-methacryloyloxy propyl phosphonic acid.

As the above-described polymer compound, either of a homopolymer and a copolymer of a monomer having a phosphonic acid ester group is used. Examples of the copolymer include a copolymer of the monomer having a phosphonic acid ester group and the above-described monomer having an anionic group, or a copolymer of the monomer having a phosphonic acid ester group and a monomer having neither a phosphonic acid ester group nor an anionic group.

As the monomer having neither a phosphonic acid ester group nor an anionic group, a monomer having a hydrophilic group is preferable. Examples of the hydrophilic group include a hydroxy group, an alkylene oxide structure, an amino group, an ammonium group, and an amido group. Among these, a hydroxy group, an alkylene oxide structure, and an amido group are preferable, an alkylene oxide structure having 1 to 20 alkylene oxide units having 2 or 3 carbon atoms is more preferable, and a polyethylene oxide structure having 2 to 10 alkylene oxide units is still more preferable. Examples thereof include 2-hydroxyethyl acrylate, ethoxy diethylene glycol acrylate, methoxy triethylene glycol acrylate, poly(oxyethylene)methacrylate, N-isopropylacrylamide, and acrylamide.

A preferred aspect of the above-described polymer compound is a copolymer or a homopolymer of which the proportion of a monomer unit having a phosphoric acid ester group in a molecule is preferably 1 mol % to 100 mol %, more preferably 3 mol % to 100 mol %, and still more preferably 5 mol % to 100 mol %.

In addition, as the phosphonic acid compound, a copolymer of the above-described monomer having a phosphonic acid ester group in a molecule and the above-described monomer having an anionic group can be used. According to the above-described aspect, it is possible to obtain a hydrophilic coating liquid having high coating properties and a high performance of preventing edge stains, which is preferable.

In the copolymer of the above-described monomer having a phosphonic acid ester group in a molecule and the above-described monomer having an anionic group, the proportion of a monomer unit having a phosphonic acid ester group in a molecule is preferably 2 mol % to 99 mol %, more preferably 2 mol % to 80 mol %, still more preferably 5 mol % to 70 mol %, and particularly preferably 10 mol % to 50 mol % with respect to the total monomer units.

The weight average molecular weight of the above-described polymer compound is preferably 5,000 to 1,000,000, more preferably 7,000 to 700,000, and particularly preferably 10,000 to 500,000.

—Water-Soluble Resin—

A hydrophilic agent of the hydrophilic coating liquid used in the present invention preferably contains a water-soluble resin. Examples of the water-soluble resin include water-soluble resins which are classified as polysaccharides, polyvinyl alcohol, polyvinyl pyrrolidone, polyacrylamide, and copolymers thereof, a vinyl methyl ether/maleic anhydride copolymer, a vinyl acetate/maleic anhydride copolymer, and a styrene/maleic anhydride copolymer.

As the polysaccharide, starch derivatives (for example, dextrin, enzymatic degradation dextrin, a hydroxypropylated starch, a carboxymethylated starch, a phosphoric acid-esterified starch, a polyoxyalkylene grafted starch, and a cyclodextrin), celluloses (for example, carboxymethyl cellulose, carboxyethyl cellulose, methyl cellulose, hydroxypropyl cellulose, and methylpropyl cellulose), carrageenan, an alginic acid, guar gum, Locust bean gum, xanthan gum, gum arabic, and soybean polysaccharides.

Among these, starch derivatives such as a polyoxyalkylene grafted starch, gum arabic, carboxymethyl cellulose, and soybean polysaccharides can be preferably used.

Two or more types of these water-soluble resins can also be used in combination. The water-soluble resins can be contained within a preferable range of 5 mass % to 40 mass % and a more preferable range of 10 mass % to 30 mass %. In this range, it becomes easy to perform the coating since the hydrophilic coating liquid has a high viscosity, and therefore, it is possible to obtain favorable hydrophilic protective film.

A hydrophilic agent of the hydrophilic coating liquid used in the present invention may be used singly. However, two or more types of hydrophilic agents are preferably used in combination, one type to four types of hydrophilic agents are more preferably used in combination, one type to three types of hydrophilic agents are still more preferably used in combination, and two types of hydrophilic agents are particularly preferably used in combination.

In a case of using a plurality of hydrophilic agents in combination, a surfactant and a phosphoric acid compound or a phosphonic acid compound are preferably used in combination, and an anionic surfactant and a phosphoric acid compound or a phosphonic acid compound are more preferably used in combination.

In addition, in a case of singly using a hydrophilic agent, a copolymer of a monomer having a phosphoric acid ester group or a phosphonic acid ester group in a molecule or a monomer having an anionic group in a molecule is preferably used, a copolymer of a monomer having a phosphoric acid ester group in a molecule and a monomer having an anionic group in a molecule is more preferably used, and a copolymer of a monomer having a phosphoric acid ester group in a molecule and a monomer having a sulfonic acid group in a molecule is still more preferably used.

<Organic Solvent>

In addition, it is preferable that the hydrophilic coating liquid used in the present invention further contains an organic solvent.

Examples of the organic solvent used in the present invention include an alcohol-based solvent, a ketone-based solvent, an ester-based solvent, an amide-based solvent, and a hydrocarbon-based solvent. Among these, an alcohol-based solvent and a hydrocarbon-based solvent are preferable.

As the alcohol-based solvent, monohydric alcohol or polyhydric alcohol may be used. Examples of the monohydric alcohol include methyl alcohol, n-propyl alcohol, isopropylalcohol, n-butyl alcohol, tert-butyl alcohol, n-amyl alcohol, diacetone alcohol, 1-methoxy-2-propanol, furfuryl alcohol, 2-octanol, 2-ethylhexanol, nonanol, n-decanol, undecanol, n-dodecanol, trimethylnonyl alcohol, benzyl alcohol, phenethyl alcohol, ethylene glycol monoisoamyl ether, ethylene glycol monophenyl ether, ethylene glycol monobenzyl ether, and ethylene glycol monohexyl ether.

Examples of the polyhydric alcohol include ethylene glycol, propylene glycol, triethylene glycol, butylene glycol, hexylene glycol, diethylene glycol, dipropylene glycol, and glycerin.

Among these, benzyl alcohol, phenethyl alcohol, furfuryl alcohol, and glycerin are particularly preferable.

Examples of the hydrocarbon-based solvent include aromatic and aliphatic compounds (mineral spirits) of a petroleum distillate, and squalane.

The organic solvent may be used singly, or two or more types thereof can be used in combination. The amount of the organic solvent used is preferably 0.5 mass % to 10 mass % and more preferably 1 mass % to 5 mass % based on the total mass of the hydrophilic coating liquid. If the amount of organic solvent is within this range, a portion coated with the hydrophilic coating liquid does not become sticky, and therefore, is favorable and excellent in permeability to the image recording layer.

<Plasticizer>

It is possible to make the hydrophilic coating liquid used in the present invention contain a plasticizer. Examples of the plasticizer include plasticizer having lower than or equal to 15° C. of a solidifying point, for example, phthalic acid diesters, such as dibutyl phthalate, diheptyl phthalate, di-n-octyl phthalate, di(2-ethylhexyl)phthalate, dinonyl phthalate, didecyl phthalate, dilauryl phthalate, and butyl benzyl phthalate; aliphatic dibasic acid esters such as dioctyl adipate, butyl glycol adipate, dioctyl azelate, dibutyl sebacate, di(2-ethylhexyl)sebacate, and dioctyl sebacate; epoxidized triglycerides such as epoxidized soybean oil; phosphoric acid esters such as tricresyl phosphate, trioctyl phosphate, and tris chloroethyl phosphate; and benzoic acid esters such as benzyl benzoate.

The plasticizer may be used singly, or two or more types thereof can be used in combination. The amount of the plasticizer used is preferably 0 mass % to 10 mass % and more preferably 0 mass % to 5 mass % based on the total mass of the hydrophilic coating liquid.

<Other Arbitrary Components>

It is possible to make the hydrophilic coating liquid, with which an end portion of a lithographic printing plate precursor used in the present invention is processed, contain mineral salts such as nitrate and sulfate, a preservative, and an anti-foaming agent in addition to the above-described components. Examples of the mineral salts include magnesium nitrate, sodium nitrate, potassium nitrate, ammonium nitrate, sodium sulfate, potassium sulfate, ammonium sulfate, sodium hydrogen sulfate, and nickel sulfate.

Examples of the prevervative include phenol or derivatives thereof, formalin, imidazole derivatives, sodium dehydroacetate, 4-isothiazolin-3-one derivatives, benzisothiazolin-3-one, benzotriazole derivatives, amidine guanidine derivatives, quaternary ammonium salts, derivatives of pyridine, quinoline, and guanidine, diazine, triazole derivatives, oxazole, oxazine derivatives, nitro bromo alcohol-based 2-bromo-2-nitropropane-1,3diol, 1,1-dibromo-1-nitro-2-ethanol, and 1,1-dibromo-1-nitro-2-propanol.

As the anti-foaming agent, general silicon-based self-emulsifying type and emulsifying type anti-foaming agents and nonionic surfactant-based compounds with HLB of 5 or less may be used.

<Culling Step>

The manufacturing method for a lithographic printing plate precursor include (c) a cutting step of cutting the lithographic printing plate precursor such that the above-described coated region is in a range within 1 cm from an end portion of the lithographic printing plate precursor after being cut.

The conditions of cutting the lithographic printing plate precursor of the present invention is not particularly limited, and any well-known cutting method can be used. Methods disclosed in JP1996-58257A (JP-H8-58257A), JP1997-211843A (JP-H9-211843A), JP1998-100556A (JP-H10-100556A), and JP1999-52579A (JP-H11-52579A) are preferably used.

As the cutting position, it is necessary to cut the lithographic printing plate precursor such that the region coated with a coating liquid is in a range within 1 cm from the end portion of the lithographic printing plate precursor, and the region coated with a coating liquid is preferably within 0.5 cm and more preferably within 0.3 cm. If the coated region is within 1 cm from the end portion, there is no influence on a region in which an image can be formed. The lower limit value of the width of the coated region is not particularly limited, but is preferably greater than or equal to 0.1 mm.

In addition, in the cutting step in the manufacturing method for a lithographic printing plate precursor of the present invention, the cutting is preferably performed such that the end portion is provided with a sag shape. According to the above-described aspect, the effect of the present invention is further exhibited.

[Sag Shape]

Figure 9:
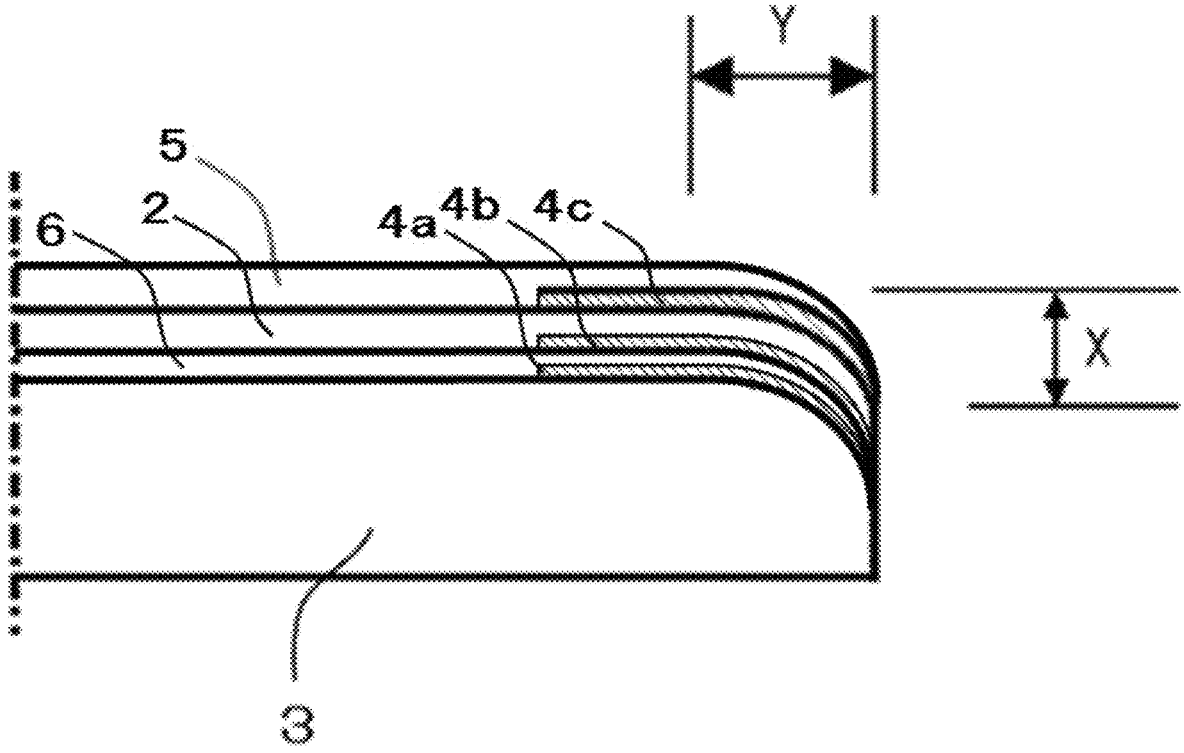
FIG. 9 is a schematic view showing an example of a sectional shape of an end portion of the lithographic printing plate precursor which is cut by a cutting device.

FIG. 9 is an example of a sectional shape of an end portion of the lithographic printing plate precursor which is cut by a cutting device. The distance X in a vertical direction of a portion which is curved downward from an extension line of the surface of the image recording layer is called a "sag amount" and the distance Y in a horizontal direction is called a "sag width". Edge stains in the lithographic printing plate precursor are caused by components of printing ink which are driven to the end portion from a non-image portion and are transferred to a blanket. Therefore, it is necessary to increase the sag amount of the end portion in order to avoid contact between the end portion and the blanket.

The sag amount is preferably 30 μm to 150 μm and more preferably 50 μm to 100 μm. In a case where the sag amount is within the above-described range, the on-press developability and the suppression of the ink transfer due to the contact between the end portion and the blanket can be made compatible.

The sag width is preferably within a range of 50 μm to 300 μm and more preferably 70 μm to 250 μm. In a case where the sag width is within the above-described range, generation of cracks at the end portion and generation of stains are suppressed.

The above-described preferred ranges of the sag amount and the sag width are not related to the shape of an edge of the surface of the substrate.

The lithographic printing plate precursor shown in FIG. 9 comprises the support 3, the recording layer 2, the protective layer 5 and the undercoat layer 6. One or both of the protective layer 5 and the undercoat layer 6 may be omitted.

Furthermore, the lithographic printing plate precursor shown in FIG. 9 comprises at least one layer selected from the group consisting of the layers 4*a* to 4*c* containing the hydrophilic agent. Preferably, the lithographic printing plate precursor of the present invention comprises one layer selected from the group consisting of the layers 4*a* to 4*c*.

The layers 4*a* to 4*c* shown in FIG. 9 are in a range within 1 cm from the end portion of the lithographic printing plate precursor.

[Cutting Method for Provision of Sag Shape]

The shape shown in FIG. 9 is produced by adjusting the gap between an upper cutting blade and a lower cutting blade of a slitter device, the biting amount, and the blade tip angle.

Figure 10:
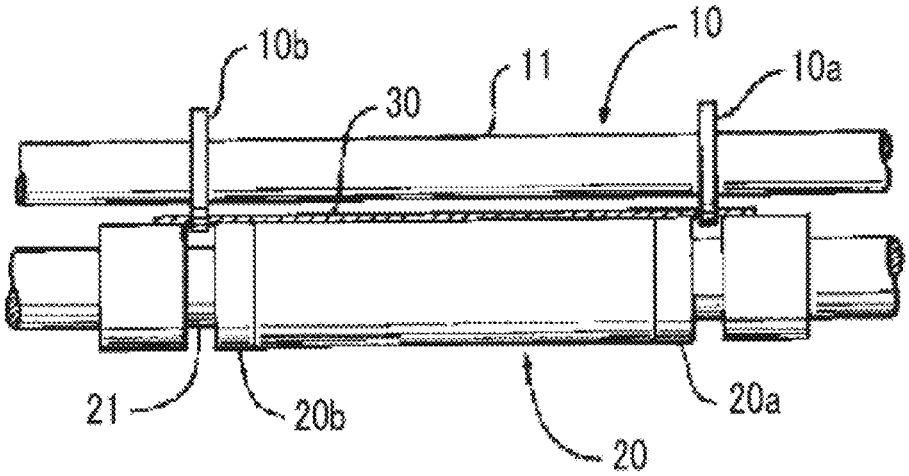
FIG. 10 is a conceptual view showing an example of a cutting unit of a slitter device.

FIG. 10 is a conceptual view showing a cutting unit of a slitter device. In the slitter device, a pair of upper and lower cutting blades 10 and 20 are disposed on right and left sides.

These cutting blades 10 and 20 are formed of a disc-shaped round blade. Upper cutting blades 10*a* and 10*b* are coaxially supported by a rotary shaft 11 and lower cutting blades 20*a* and 20*b* are coaxially supported by a rotary shaft 21. The upper cutting blades 10*a* and 10*b* and the lower cutting blades 20*a* and 20*b* are rotated in directions opposite to each other. An aluminum support 30 is cut in a predetermined width by being passed through the gap between the upper cutting blades 10*a* and 10*b* and the lower cutting blades 20*a* and 20*b*. More specifically, it is possible to form an end portion having a shape shown in FIG. 9 by adjusting the gap between the upper cutting blade 10*a* and the lower cutting blade 20*a* and the gap between the upper cutting blade 10*b* and the lower cutting blade 20*b* of the cutting unit of the slitter device in FIG. 10.

<Other Steps>

The manufacturing method for a lithographic printing plate precursor of the present invention preferably includes an undercoating step of forming an undercoat layer, a protective layer forming step of forming a protective layer on an image recording layer, and a step of overlapping compounded paper on an image recording layer side of a support, in addition to the above-described (a) to (c) steps.

[Undercoating Step]

It is preferable that the manufacturing method for a lithographic printing plate precursor of the present invention further include (d) an undercoating step of forming an undercoat layer (also referred to as an "intermediate layer") on a support before the a step. The undercoat layer is formed under an image recording layer, strengthens adhesion between the support and the image recording layer in an exposed portion, and makes separation of the image recording layer from the support in the unexposed portion easier. Therefore, the undercoat layer contributes to an increase in developability without deteriorating the printing durability. In addition, in a case of infrared laser exposure, the undercoat layer functions as a heat insulating layer, and thus prevents heat generated by exposure from diffusing to the support so as to decrease sensitivity.

The undercoat layer in the present invention is formed by preparing a coating liquid after dispersing or dissolving each component to be described below in a well-known solvent, coating the top of a support with this coating liquid through a well-known method such as bar coater coating, and performing drying. The coating amount (solid content) of the undercoat layer is preferably 0.1 $mg/m^2$ to 100 $mg/m^2$ and more preferably 1 $mg/m^2$ to 30 $mg/m^2$.

<Composition of Undercoat Layer>

As compounds used in the undercoat layer, compounds having a crosslinkable group is preferable in order to enhance adhesiveness between an adsorption group that can be adsorbed to the surface of the support and the image recording layer. Furthermore, examples of the suitable compounds include compounds having a hydrophilicity-providing group such as a sulfo group. These compounds may be low molecules or high-molecular polymers. In addition, two or more types of these compounds may be used in combination as necessary.

In the case of the high-molecular polymers, a copolymer of a monomer having an adsorption group, a monomer having a hydrophilic group, and a monomer having a crosslinkable group is preferable. As the adsorption group that can be adsorbed to the surface of the support, a phenolic hydroxy group, a carboxy group, $—PO_3H_2$, $—OPO_3H_2$, $—CONHSO_2—$, $—SO_2NHSO_2—$, and $—COCH_2COCH_3$ are preferable. As the hydrophilic group, a sulfo group is preferable. As the crosslinkable group, a methacrylic group, an allyl group, and the like are preferable.

This high-molecular polymer may have a crosslinkable group that is introduced by forming a salt between a polar substituent of a high-molecular polymer and a compound which has a substituent having opposite charges to the polar substituent thereof and an ethylenically unsaturated bond, and may be copolymerized with a monomer other than the monomers described above, preferably with a hydrophilic monomer.

Specifically, examples thereof suitably include silane coupling agents having an ethylenic double bond reactive group that can perform addition polymerization disclosed in JP1998-282679A (JP-H10-282679A), and phosphorous compounds that may have an ethylenic double bond reactive group disclosed in JP1990-304441A (JP-H2-304441A). Crosslinkable groups (preferably ethylenically unsaturated bonding groups) disclosed in JP2005-238816A, JP2005-125749A, JP2006-239867A, and JP2006-215263A, functional groups that interact with the surface of a support or products containing low molecular or polymer compounds having hydrophilic groups are also preferably used.

More preferred examples thereof include High-molecular polymers which have crosslinkable groups, hydrophilic groups, and adsorption groups that can be adsorbed to the surface of a support and are disclosed in JP2005-125749A and JP2006-188038A.

The content of unsaturated double bonds in a polymer resin for an undercoat layer is preferably 0.1 mmol to 10.0 mmol and most preferably 0.2 mmol to 5.5 mmol per 1 g of the high-molecular polymer.

With respect to the high-molecular polymer for an undercoat layer, a weight average molecular weight is preferably greater than or equal to 5,000 and more preferably 10,000 to 300,000.

In addition to the compound for an undercoat layer, in order to prevent stains over time, it is possible to make the undercoat layer in the present invention contain a chelating agent, secondary or tertiary amine, a polymerization inhibitor, an amino group, or a compound or the like having a group that interacts with a functional group having polymerization inhibiting ability and the surface of an aluminum support (for example, 1,4-diazabicyclo[2,2,2]octane (DABCO), 2,3,5,6-tetrahydroxy-p-quinone, chloranil, a sulfophthalic acid, a hydroxyethyl ethylene diamine triacetic acid, a dihydroxyethyl ethylene diamine diacetic acid, and hydroxy ethylimino diacetic acid).

[Protective layer Forming Step]

It is preferable that the manufacturing method for a lithographic printing plate precursor of the present invention further includes (e) a protective layer forming step of forming a protective layer on the image recording layer before the c step and after the a step. The protective layer is formed on the image recording layer and has a function of preventing generation of cracks in the image recording layer and preventing ablation at the time of high illuminance laser exposure in addition to a function of suppressing image formation inhibiting reaction by oxygen blockage.

The protective layer in the present invention is formed by preparing a coating liquid after dispersing or dissolving each component to be described below in a well-known solvent, coating the top of a support with this coating liquid through a well-known method such as bar coater coating, and performing drying. The coating amount of the protective layer after drying is preferably within a range of 0.01 $g/m^2$ to 10 $g/m^2$, more preferably 0.02 $g/m^2$ to 3 $g/m^2$, and still more preferably 0.02 $g/m^2$ to 1 $g/m^2$.

<Composition of Protective Layer>

The protective layer is disclosed in, for example, U.S. Pat. No. 3,458,311A and JP1980-49729B (JP-S55-49729B). As a polymer with low oxygen permeability used in the protective layer, any of a water-soluble polymer and a water-insoluble polymer can be appropriately selected and used, and two or more types thereof can be used as necessary after being mixed with each other. Specifically, examples thereof include polyvinyl alcohol, modified polyvinyl alcohol, polyvinyl pyrrolidone, a water-soluble cellulose derivative, and poly(meth)acrylonitrile.

As the modified polyvinyl alcohol, acid modified polyvinyl alcohol having a carboxylic acid group or a sulfonic acid group is preferably used. Specifically, suitable examples thereof include modified polyvinyl alcohol disclosed in JP2005-250216A and JP2006-259137A.

In order to improve oxygen barrier properties, the protective layer preferably contains an inorganic layer-shaped compound such as natural mica and synthetic mica as disclosed in JP2005-119273A.

It is possible to make the protective layer contain well-known additives such as a plasticizer for providing flexibility, a surfactant for improving coating properties, and inorganic fine particles for controlling sliding properties of the surface. In addition, it is also possible to make a sensitizing agent described in the section of the image recording layer be contained in the protective layer.

[Step of Overlapping Compounded Paper on Support]

The manufacturing method for a lithographic printing plate precursor of the present invention preferably includes a step of overlapping compounded paper on an image recording layer side of a support before the above-described c step.

The above-described step of overlapping compounded paper thereon preferably includes a step of overlapping the support on the compounded paper after the completion of all of the included steps of the above-described a step, d step, and e step.

Specifically, the step is a step of overlapping compounded paper on the surface on a side on which the image recording layer on the support exists.

The method for overlapping compounded paper on the surface on a surface on which the image recording layer on the surface exists is not particularly limited. However, a method for overlapping compounded paper, which is previously prepared by being wound in a roll shape, on the plate through close adhesion while transporting the support on which the image recording layer is provided, for example, while delivering the compounded paper.

The material of the compounded paper according to the present invention is not particularly limited, and examples thereof include paper, non-woven fabric, a plastic sheet, a film, or a laminate sheet or film provided with a resin layer on a single surface or on both surfaces of paper.

[Drying Step]

The manufacturing method for a lithographic printing plate precursor of the present invention preferably includes a drying step after performing coating using a coating liquid for formation of each layer such as an undercoat layer, an image recording layer, and a protective layer.

The drying step may be performed plural times at each time when coating using the coating liquid for formation of each layer and using a hydrophilic coating liquid is completed, or may be collectively performed after the completion of the coating using the coating liquid for formation of a plurality of layers and using the hydrophilic coating liquid.

In addition, the manufacturing method for a lithographic printing plate precursor of the present invention may include the drying step immediately after the coating using the hydrophilic coating liquid, or may include the drying step after further performing coating using a coating liquid for formation of another layer after the coating using the hydrophilic coating liquid.

The above-described drying step can be performed using an oven or can be performed by blowing dry air.

The drying temperature is preferably 60° C. to 250° C. and more preferably 80° C. to 160° C.

<Order of Steps>

In the manufacturing method for a lithographic printing plate precursor of the present invention, the a step to c step are performed such that the c step is performed after performing either the a step and b step in this order or the b step and the a step in this order.

In addition, in a case where the manufacturing method for a lithographic printing plate precursor of the present invention includes a d step, the d step is included before the a step. In a case where the manufacturing method for a lithographic printing plate precursor of the present invention includes an e step, the e step is included before the c step.

Furthermore, in a case where the manufacturing method for a lithographic printing plate precursor of the present invention includes all steps of the a step to the e step, it is preferable that the c step is performed after performing either the b step, the d step, the a step, and the e step in this order, the d step, the b step, the a step, and the e step in this order, the d step, the a step, the b step, the e step in this order, or the d step, the a step, the e step, and the b step in this order, and it is more preferable that the c step is performed after performing either the b step, the d step, the a step, and the e step in this order or the d step, the b step, the a step, and the e step.

In addition, in the steps of forming each layer, it is also possible to perform the b step before performing the above-described drying step after performing coating using a coating liquid for formation of each layer.

Furthermore, as the manufacturing method for a lithographic printing plate precursor of the present invention, aspects of the following (1) to (5) are preferable and aspects of (2) to (5) are more preferable.

(1) An aspect of performing coating using a hydrophilic coating liquid before coating an undercoat layer.

(2) An aspect of performing coating using a hydrophilic coating liquid without drying after performing coating using an undercoat layer.

(3) An aspect of performing coating using a hydrophilic coating liquid after drying after performing coating using an undercoat layer.

(4) An aspect of performing coating using a hydrophilic coating liquid without drying after performing coating up to a protective layer.

(5) An aspect of performing coating using a hydrophilic coating liquid after drying after performing coating up to a protective layer.

The above-described aspects of (4) and (5) are preferable in that it is easy to incorporate a step of performing coating using a hydrophilic coating liquid into a current device which performs steps of forming each layer such as an undercoat layer, an image recording layer, and a protective layer at once.

The above-described aspects of (1) to (3) are preferable and the aspects of (2) and (3) are more preferable in that the effect of preventing edge stains is high.

(Lithographic Printing Plate precursor)

The lithographic printing plate precursor of the present invention has an image recording layer on a quadrilateral-shaped hydrophilic aluminum support having a hydrophilic surface, in which a hydrophilic agent is distributed on the surface of the support on the image recording layer side in each region within 1 cm from end portions of two sides, which face each other, of the above-described support, and the hydrophilic agent is not attached to the rear surface (a surface opposite to the image recording layer) of the support.

In the above-described aspects, aspects of further having the above-described undercoat layer and/or the above-described protective layer on a support are still more preferable.

The above-described hydrophilic agent is the same as that contained in the above-described hydrophilic coating liquid as essential components, and is preferably a phosphoric acid compound and/or a phosphonic acid compound and more preferably a phosphoric acid compound.

In addition, it is preferable that the hydrophilic agent is not distributed on the surface of the support on the image recording layer side in regions other than each region within 1 cm from end portions of two sides facing each other.

In addition, in a case where it is possible to check the hydrophilic agent as a layer, it is preferable that the layer is present on a lower side than the uppermost layer. There is either a case where the boundary between the above-described layer of the hydrophilic agent and another adjacent layer is clear or a case where the boundary therebetween is unclear.

The widths of the above-described regions are preferably within 0.5 cm from an end portion and more preferably within 0.3 cm from an end portion. The lower limit values of the widths of the regions are not particularly limited, but are preferably greater than or equal to 0.1 mm.

The lithographic printing plate precursor of the present invention in the above-described aspects is preferably an on-press development-type lithographic printing plate precursor and/or a lithographic printing plate precursor for newspaper printing.

It is preferable that the lithographic printing plate precursor of the present invention has any layer arrangement described the following (i) to (iv); and a layer containing a hydrophilic agent between a support and the innermost layer of the layer arrangement, between adjacent layers, or on the outermost layer other than a protective layer, in which the layer containing the hydrophilic agent comes into contact with partial regions of the support, an undercoat layer, an image recording layer, and the protective layer. The contact with the partial regions thereof means that the hydrophilic agent does not comes into contact with the whole surface of any of the support, the undercoat layer, the image recording layer, and the protective layer.

(i) support and image recording layer (ii) support, undercoat layer, and image recording layer (iii) support, image recording layer, and protective layer (iv) support, undercoat layer, image recording layer, and protective layer The innermost layer means a layer which is formed closest to the support, out of layers other than the layer containing a hydrophilic agent, and the outermost layer means a layer which is formed at a position farthest from the support, out of the layers other than the layer containing a hydrophilic agent.

For example, in the case of the above-described aspect of (iv), the undercoat layer is the innermost layer and the protective layer is the outermost layer.

The above-described layer containing a hydrophilic agent preferably is exists further inside the outermost layer of the above-described layer arrangement from the viewpoint of protecting the above-described layer.

In addition, the above-described layer containing a hydrophilic agent preferably exists further inside the undercoat layer or further outside the image recording layer from the viewpoint of easily adding a step.

Furthermore, the above-described layer containing a hydrophilic agent preferably exists further outside the undercoat layer. Moreover, the above-described layer containing a hydrophilic agent preferably exists further outside than the undercoat layer and further inside than the outermost layer from the viewpoint of the performance of preventing edge stains.

In addition, the lithographic printing plate precursor of the present invention more preferably has the following layer arrangements of (v) to (xii).

(v) support, layer containing hydrophilic agent, and image recording layer (vi) support, layer containing hydrophilic agent, undercoat layer, and image recording layer (vii) support, layer containing hydrophilic agent, image recording layer, and protective layer (viii) support, layer containing hydrophilic agent, undercoat layer, image recording layer, and protective layer (ix) support, image recording layer, and layer containing hydrophilic agent (x) support, undercoat layer, image recording layer, and layer containing hydrophilic agent (xi) support, undercoat layer, image recording layer, layer containing hydrophilic agent, and protective layer (xii) support, undercoat layer, image recording layer, layer containing hydrophilic agent, and protective layer In the above-described layer arrangements, the aspects of (ix) to (xii) are preferable, the aspects of (ix) to (x) are more preferable, and the aspect of (ix) is still more preferable.

The above-described hydrophilic agent is the same as that contained in the above-described hydrophilic coating liquid as essential components, and is preferably a phosphoric acid compound and/or a phosphonic acid compound and more preferably a phosphoric acid compound.

The lithographic printing plate precursor of the present invention in the above-described aspects is preferably an on-press development-type lithographic printing plate precursor and/or a lithographic printing plate precursor for newspaper printing.

Furthermore, the above-described layer arrangements preferably exist in a region within 1 cm from an end portion of a support, more preferably exist in a region within 0.5 cm from an end portion of a support, and still more preferably exist in a region within 0.3 cm from an end portion of a support. The lower limit value of the width of the region is not particularly limited, but is preferably greater than or equal to 0.1 mm.

(Manufacturing Method for Lithographic Printing Plate)

The manufacturing method for a lithographic printing plate of the present invention includes a preparation step of preparing the lithographic printing plate precursor obtained through the manufacturing method of the present invention; an exposure step of performing image exposure on the above-described lithographic printing plate precursor; and a processing step of removing an unexposed portion of the image-exposed lithographic printing plate precursor.

The above-described processing step is preferably performed through on-press development.

In addition, the manufacturing method for a lithographic printing plate of the present invention is preferably a manufacturing method for a lithographic printing plate for newspaper printing.

<Exposure Step>

As a light source used for image exposure in the present invention, a laser is preferable. The laser used in the present invention is not particularly limited, and suitable examples thereof include a solid laser and a semiconductor laser apply infrared rays with wavelengths of 760 nm to 1,200 nm.

The output of the infrared laser is preferably greater than or equal to 100 mW, the exposure time per one pixel is preferably within 20 microseconds, and the irradiation energy amount is preferably 10 mJ/cm$^2$ to 300 mJ/cm$^2$. In order to reduce the exposure time, a multibeam laser device is preferably used.

<Processing Step>

The development in the manufacturing method for a lithographic printing plate of the present invention after the exposure can also be performed through development using a processing liquid, but is preferably performed through an on-press development method. As the above-described processing liquid, an alkaline developer or a gum developer is preferably used. As the gum developer, a "rubber solution" disclosed in paragraphs 0016 to 0028 in JP2007-538279A can be used. The on-press development method has a step of performing image exposure on a lithographic printing plate precursor and a printing step of performing printing by supplying oily ink and an aqueous component without subjecting the lithographic printing plate precursor after the exposure to a development processing, in which an unexposed portion of the lithographic printing plate precursor is removed in the middle of the above-described printing step. After mounting the lithographic printing plate precursor on a printing press, the image-wise exposure may be performed on the printing press or may be independently performed using a plate setter or the like. In the latter case, the exposed lithographic printing plate precursor is mounted on the printing press as it is without the development processing step. Thereafter, on-press development processing is performed, that is, an image recording layer with an unexposed region is removed, in an initial stage in the middle of printing by performing the printing while supplying oily ink and an aqueous component using the above-described printing press. Accordingly, the surface of a hydrophilic support is exposed, and a non-image portion is formed. As the oily ink and the aqueous component, general printing ink for lithographic printing and dampening water are suitably used.

In a case where the development is performed through the on-press development method, the exposed lithographic printing plate precursor is mounted on a plate cylinder of the printing press. In addition, in a case of a laser exposure device-attached printing press, image exposure is performed after the lithographic printing plate precursor is mounted on the plate cylinder of the printing press.

If printing is performed by supplying dampening water and printing ink to the image-wisely exposed lithographic printing plate precursor, an exposed image recording layer in the exposed portion of the image recording layer forms a printing ink reception portion which has a lipophilic surface. In contrast, in an unexposed portion, an uncured image recording layer is removed by being dissolved or dispersed by the supplied dampening water and/or printing ink, and the hydrophilic surface is exposed to the portion. As a result, the dampening water is attached to the exposed hydrophilic surface and the printing ink is deposited on the image recording layer of the exposed region to start printing.

Here, the one first supplied to the surface of the plate may be dampening water or printing ink. However, it is preferable to first supply printing ink in view of preventing contamination caused by the components of the image recording layer from which dampening water is removed.

In this manner, it is preferable that the lithographic printing plate precursor of the present invention is subjected to on-press development on an offset printing press, and is used for printing a large number of sheets as it is.

[Dampening Water]

Dampening water used in the present invention preferably contains the following compounds.

(1) Aqueous resin (2) Auxiliaries ((2-1) organic solvent and/or (2-2) surfactant) for improving wettability (3) pH adjuster (4) Others ((i) preservative, (ii) chelating agent, (iii) colorant, (iv) rust inhibitor, (v) anti-foaming agent, (vi) masking agent, and the like)

The dampening water used in the present invention preferably contains, in the concentration after adjustment, at least one of (1) an aqueous resin of which the content is 0.001 mass % to 1 mass % with respect to the total amount of the above-described dampening water, (2-1) an organic solvent in which the content of (i) is 0.01 mass % to 1.0 mass % with respect to the total amount of the above-described dampening water, or (2-2) a surfactant in which the content of (ii) is 0.001 mass % to 0.1 mass % with respect to the total amount of the above-described dampening water.

In addition, the pH of the dampening water is preferably 7 to 11.

(1) Aqueous Resin

The dampening water used in the present invention preferably contains an aqueous resin. Examples of the aqueous resin used in the dampening water used in the present invention include natural products such as gum arabic, starch derivatives (for example, dextrin, enzymatic degradation dextrin, hydroxypropylated enzymatic degradation dextrin, a carboxymethylated starch, starch phosphate, and an octenyl succinated starch), alginic acid salt, and cellulose derivatives (for example, carboxymethyl cellulose, carboxyethyl cellulose, methyl cellulose, and hydroxyethyl cellulose) and modified products thereof; polyethylene glycol and a copolymer thereof; compounds of polyvinyl alcohol and derivatives thereof, polyacrylamide and a copolymer thereof, a polyacrylic acid and a copolymer thereof, a vinyl methyl ether/maleic anhydride copolymer, a vinyl acetate/maleic anhydride copolymer, and a polystyrene sulfonate and a copolymer thereof; and polyvinyl pyrrolidone. Among these, carboxymethyl cellulose and hydroxyethyl cellulose are particularly preferable. The content of the water-soluble polymer compound is suitably 0.001 mass % to 1 mass % and more preferably 0.005 mass % to 0.2 mass % with respect to the dampening water.

(2-1) Organic Solvent

The dampening water used in the present invention preferably contains an organic solvent in order to improve wettability. Examples thereof include ethylene glycol monomethyl ether, diethylene glycol monomethyl ether, triethylene glycol monomethyl ether, tetraethylene glycol monomethyl ether, ethylene glycol monoethyl ether, diethylene glycol monoethyl ether, triethylene glycol monoethyl ether, tetraethylene glycol monoethyl ether, ethylene glycol monopropyl ether, diethylene glycol monopropyl ether, triethylene glycol monopropyl ether, tetraethylene glycol monopropyl ether, ethylene glycol monoisopropyl ether, diethylene glycol monoisopropyl ether, triethylene glycol monoisopropyl ether, tetraethylene glycol monoisopropyl ether, ethylene glycol monobutyl ether, diethylene glycol monobutyl ether, triethylene glycol monobutyl ether, tetraethylene glycol monobutyl ether, ethylene glycol monoisobutyl ether, diethylene glycol monoisobutyl ether, triethylene glycol monoisobutyl ether, tetraethylene glycol monoisobutyl ether, ethylene glycol mono tertiary butyl ether, diethylene glycol mono tertiary butyl ether, triethylene glycol mono tertiary butyl ether, tetraethylene glycol monotertiary butyl ether, propylene glycol monomethyl ether, dipropylene glycol monomethyl ether, tripropylene glycol monomethyl ether, propylene glycol monoethyl ether, dipropylene glycol monoethyl ether, tripropylene glycol monoethyl ether, tetrapropylene glycol monoethyl ether, propylene glycol monopropyl ether, dipropylene glycol monopropyl ether, tripropylene glycol monopropyl ether, propylene glycol monoisopropyl ether, dipropylene glycol monoisopropyl ether, tripropylene glycol monoisopropyl ether, dipropylene glycol monobutyl ether, tripropylene glycol monobutyl ether, propylene glycol monoisobutyl ether, dipropylene glycol monoisobutyl ether, tripropylene glycol monoisobutyl ether, propylene glycol monotertiary butyl ether, dipropylene glycol mono tertiary butyl ether, tripropylene glycol mono tertiary butyl ether, and polypropylene glycol having a molecular weight of 200 to 1,000 and monomethyl ether, monoethyl ether, monopropyl ether, monoisopropyl ether, and monobutyl ether thereof, propylene glycol, dipropylene glycol, tripropylene glycol, tetrapropylene glycol, and pentapropylene glycol, ethylene glycol, diethylene glycol, triethylene glycol, butylene glycol, hexylene glycol, 2-ethyl-1,3-hexane diol, 3-methoxy-3-methyl-1-butanol, 1-butoxy-2-propanol, glycerin, diglycerin, polyglycerin, trimethylolpropane, and a 2-pyrrolidone derivative which is substituted with an alkyl group having 1 to 8 carbon atoms at the 1-position. Among these, ethylene glycol mono tertiary butyl ether, 3-methoxy-3-methyl-1-butanol, and 1-butoxy-2-propanol are particularly preferable. These solvents may be used singly or two or more types thereof may be used in combination. In general, these solvents are preferably used within a range of 0.01 mass % to 1.0 mass % based on the total mass of the dampening water.

(2-2) Surfactant

The dampening water used in the present invention preferably contains a surfactant for improving wettability. In surfactants, examples of the anionic surfactant include fatty acid salts, abietic acid salts, hydroxyalkane sulfonic acid salts, alkanesulfonic acid salts, dialkyl sulfosuccinate salts, linear alkyl benzene sulfonic acid salts, branched alkyl benzene sulfonic acid salts, alkyl naphthalene sulfonic acid salts, alkyl phenoxy polyoxyethylene propyl sulfonic acid salts, polyoxyethylene alkyl sulfenyl ether ester salts, N-methyl-N-oleyl taurine sodium salts, N-alkyl sulfosuccinic acid monoamide disodium salts, petroleum sulfonic acid salts, sulfated castor oil, sulfated beef tallow oil, sulfate ester salts of a fatty acid alkyl ester, alkyl sulfate ester salts, polyoxyethylene alkyl ether sulfuric ester salts, fatty acid monoglyceride sulfuric acid ester salts, polyoxyethylene alkylphenyl ether sulfuric acid ester salts, polyoxyethylene styryl phenyl ether sulfuric acid ester salts, alkyl phosphoric acid ester salts, polyoxyethylene alkyl ether phosphoric acid ester salts, polyoxyethylene alkyl phenyl ether phosphoric acid ester salts, partially saponified products of a styrene-maleic anhydride copolymer, partially saponified products of an olefin-maleic anhydride copolymer, and naphthalene sulfonate formalin condensates. Among these, dialkyl sulfosuccinate salts, alkyl sulfuric acid ester salts, and alkylnaphthalene sulfonic acid salts are particularly preferably used.

Examples of the nonionic surfactant include polyoxyethylene alkyl ethers, polyoxyethylene alkyl phenyl ethers, polyoxyethylene polystyryl phenyl ethers, polyoxyethylene polyoxypropylene alkyl ethers, glycerin fatty acid partial esters, sorbitan fatty acid partial esters, pentaerythritol fatty acid partial esters, propylene glycol mono fatty acid esters, sucrose fatty acid partial esters, polyoxyethylene sorbitan fatty acid partial esters, polyoxyethylene sorbitol fatty acid partial esters, polyethylene glycol fatty acid esters, polyglycerol fatty acid partial esters, polyoxyethylenized caster oil, polyoxyethylene glycerin fatty acid partial esters, fatty acid diethanolamides, N,N-bis-2-hydroxyalkylamines, polyoxyethylene alkylamines, triethanolamine fatty acid esters, polyoxyethylene-polyoxypropylene block polymers, and trialkylamine oxides. In addition, it is also possible to use a fluorinated surfactant and a silicone-based surfactant. In a case of using a surfactant, when considering a foaming point, generally, the content thereof is preferably 0.001 mass % to 0.1 mass % and more preferably 0.002 mass % to 0.05 mass %. In addition, two or more thereof can be used in combination.

(3) pH Adjuster (3) the pH adjuster used in the dampening water used in the present invention can also be used in an alkaline region at a pH of 7 to 10 which contains alkali metal hydroxide, a phosphoric acid, an alkali metal salt, a carbonic acid alkali metal salt, a silicic acid, and the like.

In addition, at least one type selected from a water-soluble organic acid, a water-soluble inorganic acid, or salts thereof can be used. These compounds are effective for pH adjustment, pH buffering, proper etching of a support of a lithographic printing plate, or corrosion prevention. Preferred examples of the organic acid include a citric acid, an ascorbic acid, a malic acid, a tartaric acid, a lactic acid, an acetic acid, a gluconic acid, a hydroxyacetic acid, an oxalic acid, a malonic acid, a levulinic acid, a sulfanilic acid, a p-toluene sulfonic acid, a phytic acid, and an organic phosphonic acid. Examples of the inorganic acid include a phosphoric acid, a nitric acid, a sulfuric acid, and a polyphosphoric acid. Furthermore, organic acid and/or inorganic acid alkali metal salts thereof, an alkaline-earth metal salt, an aluminum salt, or an organic amine salt can also be suitably used. One type out of an organic acid thereof, an inorganic acid thereof, and a salt thereof may be used singly or may be used as a mixture of two or more types thereof.

(Printing Method)

In a case where printing is performed using a lithographic printing plate obtained through the manufacturing method for a lithographic printing plate of the present invention, an object to be printed is not particularly limited, but printing is preferably performed using printing paper of which the width is wider than that of the lithographic printing plate thereof, and the printing paper is more preferably newspaper.

In addition, it is preferable that printing is performed on the surface of paper by winding the lithographic printing plate of the present invention on a rotating cylindrical plate cylinder of a printing press, making ink be attached to the top of an image portion in the presence of dampening water, and transferring the ink to a rubber blanket.

EXAMPLES

The present invention will be more specifically described with reference to Examples below. The material, the used amount, the proportion, the processing content, the processing procedure and the like shown in the following Example can be appropriately modified within the scope not departing from the gist of the present invention. Accordingly, the scope of the present invention is not limited to the specific example shown below. Unless particularly stated otherwise, the units "parts" and "%" are on a mass basis.

(Production of Lithographic Printing Plate precursor (1))

<Production of Support>

In order to remove rolling oil on the surface of an aluminum sheet (material: JIS A 1050) having a thickness of 0.3 mm, degreasing processing was performed for 30 seconds at 50° C. using 10 mass % of a sodium aluminate aqueous solution, an aluminum surface was grained using three bundle-implanted nylon brushes having a brush diameter of 0.3 mm and a pumice-aqueous suspension liquid (specific gravity: 1.1 g/cm$^3$) having a median diameter of 25 μm, and the aluminum sheet was then well washed with water. This aluminum sheet was immersed for 9 seconds in 25 mass % of the sodium hydroxide aqueous solution at 45° C., etched, washed with water, further immersed for 20 seconds in 20 mass % of a nitric acid aqueous solution at 60° C., and washed with water. At this point, the etching amount of the grained surface was about 3 g/m$^2$.

Subsequently, electrochemical roughening processing was continuously performed using 60 Hz of the alternating current voltage. The electrolyte at this point was a 1 mass % nitric acid aqueous solution (containing 0.5 mass % of aluminum ion), and the liquid temperature was 50° C. Electrochemical roughening processing was performed with a carbon electrode as an opposite pole using a trapezoidal rectangular wave alternating current having an alternating current power waveform in which the time TP until a current value reached the peak from zero was 0.8 msec and the duty ratio was 1:1. A ferrite was used as an auxiliary anode. The current density was 30 A/dm$^2$ in terms of a peak value of an electric current, and 5% of the electric current flowing from the power source in the auxiliary anode was distributed. The electricity amount in the nitric acid electrolysis was 175 C/dm$^2$ which was the electricity amount when the aluminum sheet was an anode. Thereafter, washing with water through spraying was performed.

Subsequently, electrochemical roughening processing was performed through the same method as that of nitric acid electrolysis using the electrolyte of a 0.5 mass % hydrochloric acid aqueous solution (containing 0.5 mass % of an aluminum ion) at a liquid temperature of 50° C. under the condition of 50 C/dm$^2$ of the electricity amount when the aluminum sheet was an anode, and then, washing with water through spraying was performed.

Subsequently, direct current anodic oxidation coating of 2.5 g/m$^2$ was provided in the aluminum sheet using a 15 mass % sulfuric acid aqueous solution (containing 0.5 mass % of an aluminum ion) as the electrolyte, in an electric current density of 15 A/dm$^2$, and then, the aluminum sheet was washed with water and dried to produce a support (1).

Thereafter, in order to secure hydrophilicity of the non-image portion, silicate processing was performed on the support (1) for 10 seconds at 60° C. using a 2.5 mass % aqueous solution of sodium silicate No. 3, and then, washing with water was performed so as to obtain a support (2). The deposition amount of Si was 10 mg/m$^2$. The center line average roughness (Ra) of the support (2) was measured using a needle having a diameter of 2 and was 0.51 μm.

<Layer Forming Step>

[Formation of Undercoat Layer]

Next, a support having an undercoat layer was produced by coating the top of the above-described support (2) with a coating liquid (1) for an undercoat layer which has the following composition such that the dry coating amount became 20 mg/m$^2$.

[Coating Liquid (1) for Undercoat Layer]

Compound (1) for undercoat layer having the following structure: 0.18 parts

Hydroxy ethylimino diacetic acid: 0.10 parts

Methanol: 55.24 parts

Water: 6.15 parts

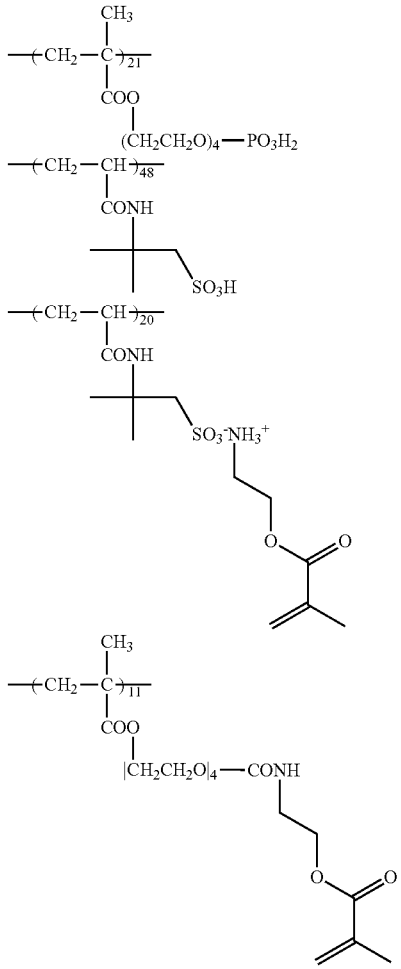

Compound (1) for undercoat layer
Mw: 100,000

<Formation of Image Recording Layer>

The top of the undercoat layer formed as described above was bar-coated with an image recording layer coating liquid (1) having the following composition, and was then oven-dried for 60 seconds at 100° C. to form an image recording layer having a dry coating amount of 1.0 g/m$^2$.

The image recording layer coating liquid (1) was obtained by mixing and stirring a photosensitive liquid (1) and a microgel liquid (1) described below immediately before coating.

[Photosensitive Liquid (1)]

Binder polymer (1) [following structure, Mw: 55,000, n: 2 (number of E0 units)]: 0.240 parts Infrared absorber (1) [following structure]: 0.020 parts Borate compound (1) sodium tetraphenylborate: 0.010 parts Radical polymerization initiator (1) [following structure]: 0.162 parts Radical polymerizable compound tris(acryloyloxyethyl) isocyanurate (NK ESTER A-9300, manufactured by Shin-Nakamura Chemical Co., Ltd.): 0.192 parts Anionic surfactant 1 [following structure]: 0.050 parts Sensitizing agent phosphonium compound (1) [following structure]: 0.055 parts Sensitizing agent Benzyl-dimethyl-octylammonium.$PF_6$ salt: 0.018 parts Ammonium group-containing polymer (1) [following structure, Mw: 50,000, reduced specific viscosity: 45 ml/g]: 0.040 parts Fluorine-based surfactant (1) [following structure]: 0.008 parts 2-Butanone: 1.091 parts 1-Methoxy-2-propanol: 8.609 parts

[Microgel Liquid (1)]

Microgel (1): 2.640 parts

Distilled water: 2.425 parts

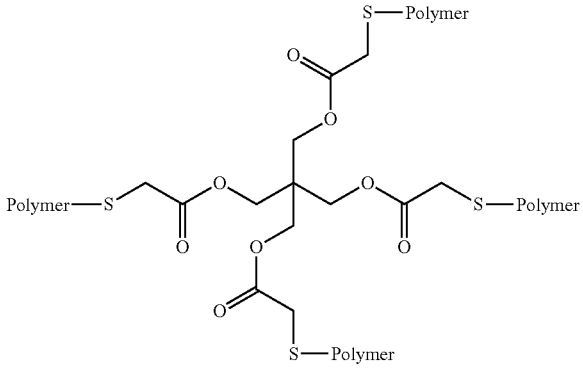

Above-Described Polymer Unit

Binder polymer (1)

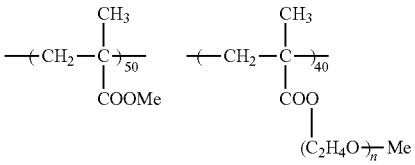

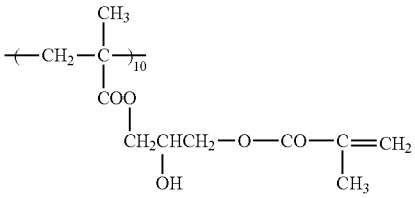

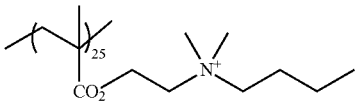

$PF_6^-$

-continued

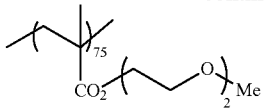

Ammonium Group-Containing Polymer

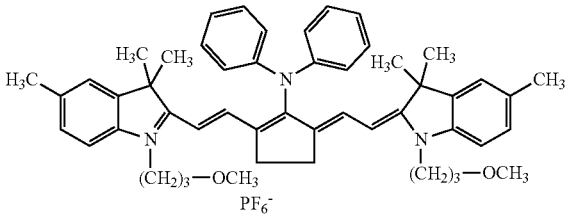

Infrared absorber (1)

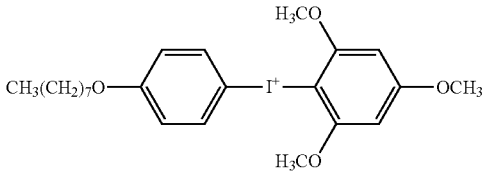

$PF_6^-$

Radical polymerization initiator (1)

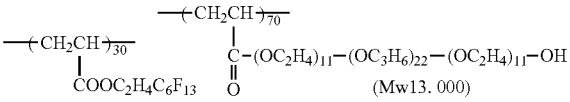

Fluorine-based surfactant (1)

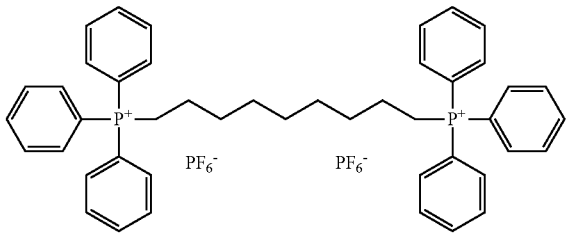

Phosphonium compound (1)

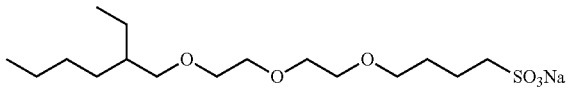

Anionic surfactant 1

A synthesis method of the above-described microgel (1) is as shown below.

<Synthesis of Microgel (1)>

As an oil phase component, 10 g of an adduct (TAKENATE D-110N manufactured by Mitsui Chemicals Polyurethanes Inc.) of trimethylol propane and xylene diisocyanate, 3.15 g of pentaerythritol triacrylate (SR444 manufactured by Nippon Kayaku Co., Ltd.), and 0.1 g of an alkyl benzene sulfonic acid salt (PIONIN A-41C manufactured by Takemoto Oil& Fat Co., Ltd.) were dissolved in 17 g of ethyl acetate. As a water phase component, 40 g of a 4 mass % aqueous solution of polyvinyl alcohol (PVA-205 manufactured by Kuraray Co., Ltd.) was prepared. The oil phase component and the water phase component were mixed with each other and emulsified for 10 minutes at 12,000 rpm using a homogenizer. The obtained emulsion was added to 25 g of distilled water, stirred for 30 minutes at room temperature, and stirred for 3 hours at 50° C. The resultant was diluted with distilled water such that the solid content concentration of the microgel liquid obtained in this manner became 15 mass %, to obtain the above-described microgel (1). The volume average particle diameter of the microgel was measured through a light scattering method, and as a result, the volume average particle diameter was 0.2 μm.

<Formation of Protective Layer>

Lithographic printing plate precursors (1) to (14) were obtained such that the top of the above-described image recording layer was bar-coated with a coating liquid (1) for a protective layer having the following composition, and was then oven-dried for 60 seconds at 120° C. to form a protective layer having a dry coating amount of 0.15 g/m$^2$.

[Coating Liquid (1) for Protective layer]

Inorganic layer-shaped compound dispersion liquid (1) (obtained below): 1.5 parts Hydrophilic polymer (1) (solid content) [following structure, Mw: 30,000]: 0.55 parts 6 mass % polyvinyl alcohol (CKS50 manufactured by The Nippon synthetic Chemical Industry Co., Ltd., sulfonic acid-modified, saponification degree of greater than or equal to 99 mol %, and polymerization degree of 300) aqueous solution: 0.10 parts 6 mass % polyvinyl alcohol (PVA-405 manufactured by Kuraray Co., Ltd., saponification degree of 81.5 mol %, and polymerization degree of 500) aqueous solution: 0.03 parts 1 mass % surfactant (product name: EMALEX 710, manufactured by Nihon Emulsion Co., Ltd.) aqueous solution: 0.86 parts Ion exchanged water: 6.0 parts Hydrophilic polymer (1)

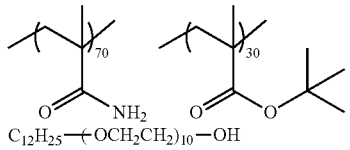

Emalex 710

<Preparation of Inorganic Layer-Shaped Compound Dispersion Liquid (1)>

6.4 g of a synthetic mica SOMASHIF ME-100 (manufactured by Co-Op Chemical Co., Ltd.) was added to 193.6 g of ion exchanged water, and was dispersed using a homogenizer until the volume average particle diameter (laser dispersion method) became 3 μm. The aspect ratio of the obtained dispersion particles was greater than or equal to 100.

(Production of Lithographic Printing Plate precursor (2))

<Layer Forming Step>

[Formation of Image Recording Layer]

The support having the undercoat layer used in the production of the above-described lithographic printing plate precursor (1) was bar-coated with an image recording layer coating liquid (2) having the following composition, and was then oven-dried for 60 seconds at 70° C. to form an image recording layer having a dry coating amount of 0.6 g/m$^2$.

<Image Recording Layer Coating Liquid (2)>

Hydrophobic thermoplastic fine particle polymer water dispersion liquid: 20.0 parts Infrared absorber (2): 0.2 parts Polymerization initiator IRGACURE 250 (manufactured by Ciba Specialty Chemicals Inc.): 0.4 parts Polymerization initiator (2): 0.15 parts Polymerizable compound SR-399 (manufactured by Sartomer): 1.50 parts Mercapto-3-triazol: 0.2 parts BYK336 (manufactured by BYK Chemie GmbH): 0.4 parts KLUCEL M (manufactured by Hercules, Inc.): 4.8 parts ELVACITE 4026 (manufactured by INEOS Acrylics, Inc.): 2.5 parts Anionic surfactant [above-described structure]: 0.15 parts n-Propanol: 55.0 parts 2-Butanone: 17.0 parts Compounds described as the product names in the above-described composition are as follows.

IRGACURE 250: (4-methylphenyl)[4-(2-methylpropyl) phenyl]iodonium=hexafluorophosphate (75 mass % propylene carbonate solution)

SR-399: dipentaerythritol pentaacrylate

BYK336: modified dimethylpolysiloxane copolymer (25 mass % xylene/methoxypropyl acetate solution)

KLUCEL M: hydroxypropyl cellulose (2 mass % aqueous solution)

ELVACITE 4026: high branched polymethyl methacrylate (10 mass % 2-butanone solution)

Infrared absorber (2)

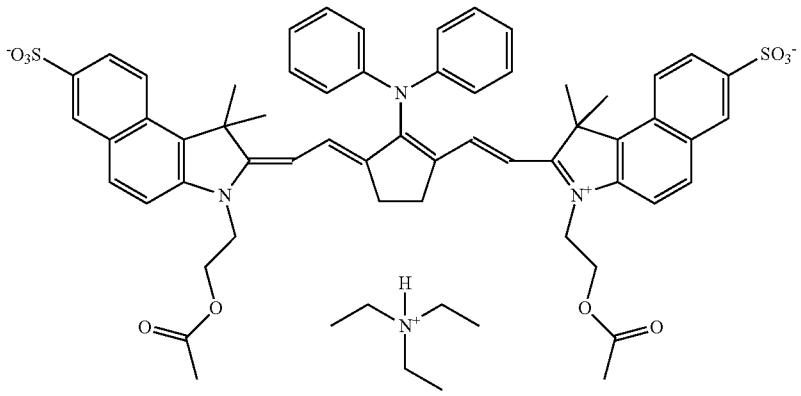

-continued

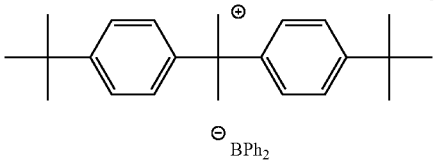

Polymerization Initiator (2)

<Preparation of Hydrophobic Thermoplastic Fine Particle Polymer Water Dispersion Liquid>

A stirrer, a thermometer, a drop rod, a nitrogen introducing pipe, and a reflux cooler were provided in a 1,000-ml 4-necked flask, 10 g of polyethylene glycol methyl ether methacrylate (PEGMA, an average repeating unit of ethylene glycol was 20), 200 g of distilled water, and 200 g of n-propanol were added thereto while deoxidation was performed by introducing nitrogen gas, and heating was performed until the internal temperature became 70° C. Subsequently, a mixture of 10 g of styrene (St) which was mixed in advance, 80 g of acrylonitrile (AN), and 0.8 g of 2,2'-azobisisobutyronitrile was dripped over 1 hour. After the completion of the dripping, a reaction was continued for 5 hours without change, 0.4 g of 2,2'-azobisisobutyronitrile was added thereto, and the internal temperature was increased to 80° C. Subsequently, 0.5 g of 2,2'-azobisisobutyronitrile was added thereto over 6 hours. When the reaction was performed for 20 hours in total, polymerization was performed by 98% or more, the hydrophobic thermoplastic fine particle polymer water dispersion liquid (1) in which PEGMA/St/AN=10/10/80 in a mass ratio was obtained. The particle diameter distribution of the hydrophobic thermoplastic fine particle polymer had a maximum value in the volume average particle diameter of 150 nm.

The particle distribution was obtained by photographing an electron micrograph of the hydrophobic thermoplastic fine particle polymer, measuring particle diameters of 5,000 fine particles in the photograph in total, dividing the obtained measurement values of the particle diameters between the maximum value and 0 into 50 with a logarithmic scale, and plotting appearance frequencies of respective particle diameters. In addition, with respect to a non-spherical particle, a particle diameter value of a spherical particle having the same particle area to the particle area on the photograph was set to a particle diameter thereof.

(Production of Lithographic Printing Plate precursor (3))

<Production of Support>

An aluminum sheet having a thickness of 0.19 mm was degreased by immersing the aluminum sheet in a 40 g/l sodium hydroxide aqueous solution for 8 seconds at 60° C., and was washed using desalted water for 2 seconds. Next, electrochemical roughening processing was performed on the aluminum sheet in an aqueous solution containing a 12 g/l hydrochloric acid and 38 g/l aluminum sulfate (octadecahydrate) at a temperature of 33° C. and at a current density of 130 A/dm$^2$ using a current for 15 seconds. After the aluminum sheet was washed for 2 seconds using desalted water, desmutting processing was performed by etching the aluminum sheet using a 155 g/l sulfuric acid aqueous solution for 4 seconds at 70° C., and the aluminum sheet was washed using desalted water for 2 seconds at 25° C. The aluminum sheet was subjected to anodic oxidation processing in a 155 g/l sulfuric acid aqueous solution for 13 seconds at a temperature of 45° C. and a current density of 22 A/dm$^2$, and was washed using desalted water for 2 seconds. The aluminum sheet was further subjected to processing using a 4 g/l polyvinyl phosphonic acid aqueous solution for 10 seconds at 40° C., washed using desalted water for 2 seconds at 20° C., and then, dried. A support obtained in this manner has a surface roughness Ra of 0.21 μm and an anodic oxidation coating amount of 4 g/m$^2$.

<Layer Forming Step>

[Formation of Image Recording Layer]

A water-based coating liquid for an image recording layer containing a hydrophobic thermoplastic fine particle polymer, an infrared absorber, and a polyacrylic acid described below was prepared, and the pH thereof was adjusted to 3.6, Thereafter, an image recording layer was formed by coating the top of above-described support with the water-based coating liquid and drying the support for 1 minute at 50° C., to produce a lithographic printing plate precursor (3). The coating amount after drying each component is shown below.

Hydrophobic thermoplastic fine particle polymer: 0.7 g/m$^2$

Infrared absorber IR-01: $1.20\times10^{-4}$ g/m$^2$

Polyacrylic acid: 0.09 g/m$^2$

The hydrophobic thermoplastic fine particle polymer, the infrared absorber IR-01, and the polyacrylic acid used in the above-described water-based coating liquid for an image recording layer are as shown below.

Hydrophobic thermoplastic fine particle polymer: styrene/acrylonitrile copolymer (molar ratio of 50/50), Tg: 99° C., and volume average particle diameter: 60 nm Infrared absorber IR-01: infrared absorber having the following structure

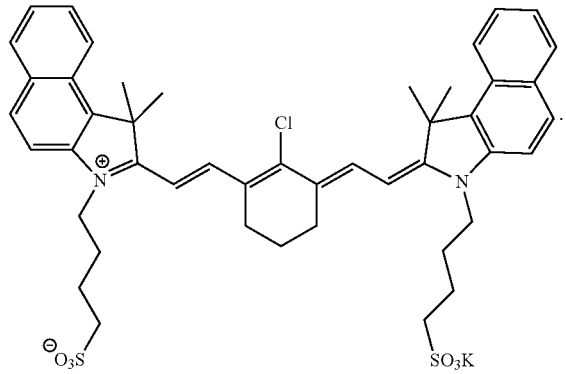

Polyacrylic acid: weight average molecular weight: 250,000

<Coating Step>

[Preparation of Hydrophilic Coating Liquid]

Compounds described in the following Tables 8 and 9 were dissolved in pure water containing a 0.1 mass % dialkyl sulfosuccinic acid salt (RAPISOL A-80 manufactured by NOF Corporation) to prepare hydrophilic coating liquids A to V. The numbers within brackets which are described on the right side of the names of the compounds represent mass % concentrations of the compounds.

In addition, the details of the compounds described as product names in Tables 8 and 9 are as follows.

NEWCOL B13 (nonionic surfactant and polyoxyethylene aryl ether manufactured by Nippon Nyukazai Co, Ltd.)

PELEX NBL (anionic surfactant and sodium alkyl naphthalene sulfonic acid manufactured by Kao Corporation)

CEROGEN 7A (sodium carboxymethyl cellulose manufactured by DKS Co., Ltd., average polymerization degree of 120 to 150)

In addition, the following compounds described in Tables 8 and 9 are compounds having the following structures.

Vinyl phosphonic acid/acrylamide copolymer (molar ratio of 10/90)

POLYPHOSMER (compound represented by the following Formula P1)

Polymer A (compound represented by the following Formula P2)

(P1)

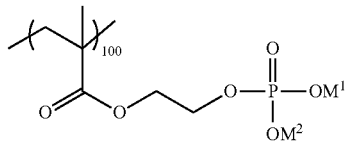

(P2)

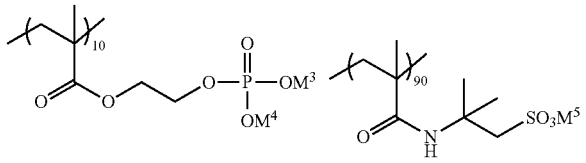

$M^1$ and $M^2$ in Formula P1 each independently represent a hydrogen atom or a sodium atom.

$M^3$, $M^4$, and $M^5$ in Formula P2 each independently represent a hydrogen atom or a sodium atom.

In addition, in Formulas P1 and P2, the numbers in brackets on the right side represent content rates (mol %) of monomer units with respect to total monomer units of a polymer.

TABLE 8

| Hydrophilic coating liquid | Hydrophilic agent 1 (mass %) | Hydrophilic agent 2 (mass %) | Water-soluble resin (mass %) |
|---|---|---|---|
| A | NEWCOL B13 (7.50) | Sodium dihydrogen phosphate (1.50) | — |
| B | Sodium 1-naphthalene sulfonate (7.50) | Sodium dihydrogen phosphate (1.50) | — |
| C | PELEX NBL (7.50) | Sodium hexametaphosphate (1.50) | — |
| D | Sodium 1-naphthalene sulfonate (3.48) | Sodium dihydrogen phosphate (0.70) | — |
| E | Sodium 1-naphthalene sulfonate (1.50) | Sodium dihydrogen phosphate (1.50) | — |
| F | Sodium 1-naphthalene sulfonate (0.75) | Sodium dihydrogen phosphate (1.50) | — |
| G | Sodium 1-naphthalene sulfonate (3.48) | — | CEROGEN 7A (0.70) |
| H | Sodium m-xylene sulfonate (3.48) | Sodium monohydrogen phosphate (0.70) | — |
| I | Sodium 1-naphthalene sulfonate (7.50) | — | — |
| J | — | Sodium dihydrogen phosphate (1.50) | — |
| K | Sodium 1-naphthalene sulfonate (7.50) | Polyvinyl phosphonic acid (1.50) | — |

TABLE 9

| Hydrophilic coating liquid | Hydrophilic agent 1 (mass %) | Hydrophilic agent 2 (mass %) | Water-soluble resin (mass %) |
|---|---|---|---|
| L | — | Polyvinyl phosphonic acid(0.70) | — |
| M | Poly(sodium 4-styrenesulfonate) (3.48) | Vinyl phosphonic acid/acrylamide copolymer (0.70) | — |
| N | Poly(sodium 2-acrylamide-2-methylpropane sulfonate) (3.48) | Polyvinyl phosphonic acid(0.70) | — |
| O | Poly(sodium 2-acrylamide-2-methylpropane sulfonate) (7.50) | Polyvinyl phosphonic acid(1.50) | — |
| P | — | POLYPHOSMER (0.70) | — |
| Q | Poly(sodium 4-styrenesulfonate) (3.48) | POLYPHOSMER (0.70) | — |
| R | Poly(sodium 4-styrenesulfonate) (3.48) | Sodium dihydrogen phosphate (0.70) | — |
| S | — | Polymer A (0.70) | — |
| T | Poly(sodium 4-styrenesulfonate) (0.10) | Polymer A (0.70) | — |
| U | Sodium 1-naphthalene sulfonate (0.10) | Polymer A (0.70) | — |
| V | — | Polymer A (0.70)<br>Sodium dihydrogen phosphate (0.10) | — |

Examples 1 to 46 and Comparative Examples 1 and 2

[Coating Timing of Hydrophilic Coating Liquid]

Lithographic printing plate precursors described in Tables 10 and 11 below were respectively coated with the prepared hydrophilic coating liquids described in Tables 10 and 11 at the following timings of (1) to (6).

(1) An uncoated plate before being coated with an undercoat layer was coated with a hydrophilic coating liquid and was dried for 30 seconds at 85° C. The coating amount became 0.5 g/m$^2$. Thereafter, the plate was coated with an image recording layer and a protective layer.

(2) The plate was coated with a hydrophilic coating liquid without drying after performing coating up to the protective layer (after performing coating using the image recording layer in a case where formation of protective layer is not performed), and was dried for 1 minute at 150° C. The coating amount of the hydrophilic coating liquid is 1.7 g/m$^2$.

(3) After performing coating up to the protective layer, the plate was coated with a hydrophilic coating liquid after being dried for 1 minute at 120° C. Thereafter, the plate was dried for 1 minute at 120° C. The coating amount of the hydrophilic coating liquid is 1.7 g/m$^2$.

(4) After performing coating up to the undercoat layer, the plate was coated with a hydrophilic coating liquid without being dried, and was dried for 30 seconds at 80° C. The coating amount of the hydrophilic coating liquid is 0.35 g/m$^2$.

(5) After performing coating up to the undercoat layer, the plate was coated with a hydrophilic coating liquid without being dried, and was dried for 20 seconds at 150° C. The coating amount of the hydrophilic coating liquid is 0.10 g/m$^2$.

(6) After performing coating up to the undercoat layer, the plate was coated with a hydrophilic coating liquid after being dried for 30 seconds at 80° C. Thereafter, the plate was dried for 30 seconds at 80° C. The coating amount of the hydrophilic coating liquid is 0.35 g/m$^2$.

In addition, in Examples or Comparative Examples, the timings of the above-described (1) to (6) at which the coating is performed are described in the sections in Tables 10 and 11.

[Coating Method of Hydrophilic Coating Liquid]

As a coating device, 2NL04 manufactured by Heishin Ltd. was used.

In Examples in which the coating was performed at the above-described timing of (1), the transporting speed was adjusted at a clearance of 0.3 mm and at a feeding amount of 5 cc/minute, and the coating was performed such that the coating amount of a solid content became 0.5 g/m$^2$.

In Examples in which the coating was performed at the above-described timings of (2) to (6), the transporting speed was adjusted at a clearance of 0.3 mm and at a feeding amount of 5 cc/minute, and the coating was performed such that the coating amount of a solid content became a predetermined amount.

The coating was performed in regions with a width of 5 mm at respective positions 3 cm from both end portions of two sides, which face each other, of a support.

<Cutting Step>

Cutting was performed using rotary blade as shown in FIG. 10 such that the shape of an end portion has a predetermined sag amount described in Tables 10 and 11 by adjusting the gap between an upper cutting blade and a lower cutting blade, the biting amount, and the blade tip angle. The sag width is set to 150 μm.

The position of the center of the coated region was set as a cutting position, and two sites of the support was cut under the above-described cutting conditions.

(Manufacturing of Lithographic Printing Plate)

<Image Exposure>

A lithographic printing plate precursor produced above-described described above was exposed using LUXEL PLATESETTER T-6000 III manufactured by FUJIFILM Corporation which is equipped with an infrared semiconductor laser under the conditions of the number of revolutions of an outer surface of a drum of 1,000 rpm, an laser output of 70%, and a resolution of 2,400 dpi. In the exposure image, a solid image and a 50% halftone dot chart were included.

(Evaluation of Lithographic Printing Plate)

<Evaluation of Performance of Preventing Edge Stains>

The lithographic printing plate precursor exposed as described above was mounted on an offset rotary printing press, and printing was performed using SOIBI KKST-S (red) manufactured by The Inctec Inc. as printing ink for newspaper and TOYOA LKY manufactured by Toyo Ink CO., LTD. as dampening water at a speed of 100,000 sheets/hour. The 1,000 sheet of a printed matter was sampled to evaluate the degree of linear stains of edge portions according to the following criteria.

5: No stain at all

4: Intermediate level between 5 and 3

3: Slight stain in permissible level

2: Intermediate level between 3 and 1

1: Obvious stains in impermissible level

<Evaluation of Stains in Setter or Vendor>

None: There is no attachment of plate material components to a transport belt and a roller and there is no problem in practical use.

Present: There is an attachment of plate material components to a transport belt and a roller and there is a problem in practical use.

TABLE 10

| | Plate material | Processing liquid | Processing timing | Sag amount (μm) after cutting plate which has been coated with processing liquid | Performance of preventing edge stains | Stains in setter and vendor |
|---|---|---|---|---|---|---|
| Example 1 | 1 | A | 3 | 60 | 5 | None |
| Example 2 | 1 | B | 3 | 60 | 5 | None |
| Example 3 | 1 | C | 3 | 60 | 5 | None |
| Example 4 | 2 | B | 3 | 60 | 4 | None |
| Example 5 | 3 | B | 3 | 60 | 4 | None |
| Example 6 | 1 | D | 2 | 60 | 5 | None |
| Example 7 | 1 | E | 2 | 60 | 5 | None |

TABLE 10-continued

| | Plate material | Processing liquid | Processing timing | Sag amount (μm) after cutting plate which has been coated with processing liquid | Performance of preventing edge stains | Stains in setter and vendor |
|---|---|---|---|---|---|---|
| Example 8 | 1 | F | 2 | 60 | 4 | None |
| Example 9 | 1 | G | 2 | 60 | 3 | None |
| Example 10 | 1 | H | 2 | 60 | 4 | None |
| Example 11 | 2 | D | 2 | 60 | 3 | None |
| Example 12 | 3 | D | 2 | 60 | 3 | None |
| Example 13 | 1 | D | 1 | 60 | 4 | None |
| Example 14 | 1 | I | 3 | 60 | 4 | None |
| Example 15 | 1 | J | 3 | 60 | 4 | None |
| Example 16 | 2 | I | 3 | 60 | 3 | None |
| Example 17 | 2 | J | 3 | 60 | 3 | None |
| Example 18 | 3 | I | 3 | 60 | 3 | None |
| Example 19 | 3 | J | 3 | 60 | 3 | None |
| Example 20 | 1 | B | 3 | 20 | 3 | None |
| Example 21 | 1 | B | 3 | 80 | 5 | None |
| Example 22 | 1 | B | 3 | 170 | 3 | None |
| Example 23 | 1 | K | 3 | 60 | 5 | None |
| Example 24 | 1 | L | 1 | 60 | 4 | None |

TABLE 11

| | Plate material | Processing liquid | Processing timing | Sag amount (μm) after cutting plate which has been coated with processing liquid | Performance of preventing edge stains | Stains in setter and vendor |
|---|---|---|---|---|---|---|
| Example 25 | 1 | M | 1 | 60 | 5 | None |
| Example 26 | 1 | N | 1 | 60 | 5 | None |
| Example 27 | 2 | N | 1 | 60 | 4 | None |
| Example 28 | 3 | N | 1 | 60 | 4 | None |
| Example 29 | 1 | O | 2 | 60 | 5 | None |
| Example 30 | 1 | O | 3 | 60 | 5 | None |
| Example 31 | 1 | N | 4 | 60 | 5 | None |
| Example 32 | 1 | P | 4 | 60 | 4 | None |
| Example 33 | 1 | Q | 4 | 60 | 5 | None |
| Example 34 | 1 | R | 4 | 60 | 5 | None |
| Example 35 | 1 | S | 4 | 60 | 5 | None |
| Example 36 | 1 | S | 1 | 60 | 5 | None |
| Example 37 | 1 | T | 4 | 60 | 5 | None |
| Example 38 | 1 | T | 5 | 60 | 5 | None |
| Example 39 | 1 | T | 6 | 60 | 5 | None |
| Example 40 | 1 | U | 4 | 60 | 5 | None |
| Example 41 | 2 | S | 4 | 60 | 5 | None |
| Example 42 | 3 | S | 4 | 60 | 5 | None |
| Example 43 | 1 | T | 4 | 60 | 5 | None |
| Example 44 | 1 | U | 4 | 60 | 5 | None |
| Example 45 | 1 | V | 4 | 60 | 5 | None |
| Example 46 | 1 | V | 1 | 60 | 5 | None |
| Comparative Example 1 | 1 | No processing | — | 60 | 1 | None |
| Comparative Example 2*1) | 1 | D | 3 | 60 | 4 | Present |

*1)Coating and drying of an undercoat layer, an image recording layer, and a protective layer was performed. Thereafter, cutting (sag amount: 60 μm) was performed, and then, coating and drying of a hydrophilic coating liquid D was performed in the same manner as in Example 13.

EXPLANATION OF REFERENCES

1: support
2: image recording layer
3: support
4: region coated with a hydrophilic coating liquid
4*a*, 4*b*, 4*c*: single layer containing a hydrophilic agent
5: protective layer
6: undercoat layer
10: cutting blade
10*a*: upper cutting blade
10*b*: upper cutting blade
11: rotary shaft
20: cutting blade
20*a*: lower cutting blade
20*b*: lower cutting blade
21: rotary shaft
30: support
$A_1$ to $A_{28}$: widths in coated regions after cutting
X: sag amount
Y: sag width

What is claimed is:

1. A lithographic printing plate precursor, comprising a layer arrangement according to any one of the following (i) to (iv):

(i) a support and an image recording layer;

(ii) a support, an undercoat layer, and an image recording layer;

(iii) a support, an image recording layer, and a protective layer; or (iv) a support, an undercoat layer, an image recording layer, and a protective layer, wherein:

the image recording layer is a water-developed layer, the image recording layer contains a polymer particle, a layer containing a hydrophilic agent is included in the layer arrangement between the support and an innermost layer, between adjacent layers, or on an outermost layer other than the protective layer, the layer containing a hydrophilic agent contacts a region of at least one of, but not all of, the support, the undercoat layer, the image recording layer, or the protective layer, and an amount of sag of an end portion of the lithographic printing plate precursor is from 30 μm to 150 μm.

2. The lithographic printing plate precursor according to claim 1, wherein the layer arrangement is (i) or (ii).

3. The lithographic printing plate precursor according to claim 1, wherein the layer containing a hydrophilic agent is at least partially in contact with the recording layer.

4. The lithographic printing plate precursor according to claim 2, wherein the layer containing a hydrophilic agent is at least partially in contact with the recording layer.

5. The lithographic printing plate precursor according to claim 1, wherein:

the polymer particle comprises a copolymer containing styrene and acrylonitrile.

6. The lithographic printing plate precursor according to claim 2, wherein:

the polymer particle comprises a copolymer containing styrene and acrylonitrile.

7. The lithographic printing plate precursor according to claim 3, wherein:

the polymer particle comprises a copolymer containing styrene and acrylonitrile.

8. The lithographic printing plate precursor according to claim 4, wherein:

the polymer particle comprises a copolymer containing styrene and acrylonitrile.

9. The lithographic printing plate precursor according to claim 1, wherein:

the polymer particle comprises a hydrophobic thermoplastic fine particle polymer.

10. The lithographic printing plate precursor according to claim 2, wherein:

the polymer particle comprises a hydrophobic thermoplastic fine particle polymer.

11. The lithographic printing plate precursor according to claim 3, wherein:

the polymer particle comprises a hydrophobic thermoplastic fine particle polymer.

12. The lithographic printing plate precursor according to claim 4, wherein:

the polymer particle comprises a hydrophobic thermoplastic fine particle polymer.

13. The lithographic printing plate precursor according to claim 1, wherein:

the image recording layer contains a polymerization initiator; and the polymerization initiator comprises a borate compound and an onium salt compound.

14. The lithographic printing plate precursor according to claim 1, wherein:

the image recording layer contains a polymerizable compound; and the polymerizable compound comprises a monomer of an ester of a polyhydric alcohol and an unsaturated carboxylic acid.

15. The lithographic printing plate precursor according to claim 1, wherein the image recording layer further contains a cyanine coloring matter as an infrared absorber.

16. The lithographic printing plate precursor according to claim 1, wherein the image recording layer further comprises a hydrophilic polymer.

17. The lithographic printing plate precursor according to claim 1, wherein the hydrophilic agent comprises at least one of a phosphoric acid compound or a phosphonic acid compound.

18. The lithographic printing plate precursor according to claim 17, wherein the at least one of the phosphoric acid compound or the phosphonic acid compound is a polymer compound.

19. The lithographic printing plate precursor according to claim 18, wherein the hydrophilic agent further comprises an anionic or nonionic surfactant.

20. The lithographic printing plate precursor according to claim 19, wherein the anionic or nonionic surfactant is a polymer compound.

21. The lithographic printing plate precursor according to claim 13, wherein:

the polymerization initiator comprises a borate compound and an iodonium salt compound.

22. The lithographic printing plate precursor according to claim 5, wherein:

the image recording layer contains a polymerization initiator; and the polymerization initiator comprises a borate compound and an onium salt compound.

23. The lithographic printing plate precursor according to claim 22, wherein:

the polymerization initiator comprises a borate compound and an iodonium salt compound.

24. The lithographic printing plate precursor according to claim 1, wherein:

the polymer particle has a volume average particle diameter of from 10 nm to 60 nm.

25. The lithographic printing plate precursor according to claim 23, wherein:

the polymer particle has a volume average particle diameter of from 10 nm to 60 nm.

* * * * *